United States Patent [19]

Hiyoshi et al.

[11] 4,158,978

[45] Jun. 26, 1979

[54] ELECTRONIC MUSICAL INSTRUMENT CAPABLE OF PRODUCING "CHORD PYRAMID" ARPEGGIO EFFECTS

[75] Inventors: Teruo Hiyoshi; Akira Nakada; Shigeru Yamada; Eiichiro Aoki; Eiichi Yamaga, all of Hamamatsu, Japan

[73] Assignee: Nippon Gakki Seizo Kabushiki Kaisha, Hamamatsu, Japan

[21] Appl. No.: 809,160

[22] Filed: Jun. 23, 1977

[30] Foreign Application Priority Data

Jul. 2, 1976 [JP] Japan ..... 51-78574

[51] Int. Cl.[2] ..... G10H 1/00; G10H 5/00

[52] U.S. Cl. ..... 84/1.03; 84/1.24; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,718,748 | 2/1973 | Bunger | 84/1.24 |
| 3,725,562 | 4/1973 | Munch, Jr. et al. | 84/1.24 |
| 3,780,203 | 12/1973 | Petrie | 84/1.17 |
| 3,842,182 | 10/1974 | Bunger | 84/1.03 |
| 3,842,184 | 10/1974 | Kniepkamp et al. | 84/1.01 |
| 3,854,366 | 12/1974 | Deutsch | 84/1.24 |
| 4,019,417 | 4/1977 | Carlson | 84/1.01 |

*Primary Examiner*—Stanley J. Witkowski
*Attorney, Agent, or Firm*—Spensley, Horn, Jubas & Lubitz

[57] ABSTRACT

An electronic musical instrument capable of producing a performance effect resembling arpeggio. Tones corresponding to one or more depressed keys are sequentially produced from the lowest tone or the highest tone and an octave range in which tones are produced is shifted toward a higher octave or a lower octave at completion of each cycle of the tone production sequence. This shift of octave is continued to a certain predetermined octave and, after the tone production in the predetermined last octave has been completed, the tone production is repeated from the original octave or the tone production is conducted with the octave range being shifted in a reverse direction.

For realizing simulation of arpeggio, plural key information produced by depressing a plurality of keys needs to be selected in a predetermined sequence. To this end, an up-down counter is employed in an example of the present invention. In a mode of arpeggio-like performance in which the tone pitch sequentially rises, for example, counting in the up-down counter is started from 0 for comparing contents of the counter with the key information and, when there is coincidence, the counting is suspended and the lowest tone is produced in response to the key information. After the lapse of a set time, the counting is resumed for repeating the comparison and a next higher tone is produced. The same operation is repeated until the counter overflows, when the octave is shifted to a next octave. The tone production is made at a predetermined time interval (a regular mode) or at a preset time interval from start of depression of the key (a random mode).

30 Claims, 27 Drawing Figures

49
520
KONR
CON
TRIG
RE
OSE1
OSE2
"1"
ADDER
OVF
OSEQ
ZR
TM
D
U
CARRY
H·A
F·A
S/R (10/1) 7
S/R (10/1)
OCTAVE COUNTER
RESET
COUNT
OCRE
UM
TM TP WR
OCTV1
OCTV2
OSE1
OSE2
OS1
OS2
CON KONR

56
APP
CC
CG
CCF
CCV
LR
FF
VF
FF1
FF2
FF3
VF1
VF2
VF3
SY
CG'
CG12
LE:DS
CPS
OCTV1
OCTV2
CPV
CPF
RAF
RAV
KONR
CON AP
LE2
LE11
WR
RE
S/R (12/1)
S/R (10/1)
S/R (11/1)
S/R (12/1)
S/R (10/1)
S/R (12/1)
125
126
127
128
129
130
131
132
133
135
136
139
140
141
142
143
144
145
154
155
156
157
158
159
160
161
113
240
241
248
249
250
251
277
278
279
280
281
282
283
322
323
324
325
326
327
328
329
330
331
332
333
334
335
336
337
338
339
340
341
342
59

40
ORO
TCL
OTL
CPL
CPON
LKDP
S/R (4/1)
S/R (12/1)
RESET
COUNT
FOSC
ROSC
K1
K2
DS
SM
FM
SS
SY
CPON
CPF
CPV
BT1
BT2
R1
R2
VDD

430
ADDER
S/R (12/1)
S/R (10/1)
OR'S
AND'S
ENCODER
OCTAVE SLIDE AMOUNT ENCODER
TRIG
TM
U
D
KONR
CON
AP
LE2
LE11
CPF
CPS
IC
FS
FR
CPSL
CPSS
APP
CC
CCF
FF
COUNT
RESET
OCTV1
OCTV2
OSEQ
OSE1
OSE2
OS1
OS2
TP
WR
UM
OCRE
U/D
U/T
ZR
SY1

ELECTRONIC MUSICAL INSTRUMENT CAPABLE OF PRODUCING "CHORD PYRAMID" ARPEGGIO EFFECTS

BACKGROUND AND SUMMARY OF THE INVENTION

This invention relates to an electronic musical instrument and, more particularly, to an electronic musical instrument capable of realizing a performance effect resembling arpeggio by producing tones associated with one or more depressed keys one by one at a predetermined time interval.

Performance of arpeggio generally requires a considerable performance skill. It is particularly difficult for a beginner to play arpeggio with one hand while playing melody with the other hand.

It is therefore an object of the present invention, to provide an electronic musical instrument enabling even a beginner to exercise a muscial technique resembling arpeggio. For this purpose, the electronic musical instrument according to the present invention automatically realizes a musical effect resembling arpeggio by producing musical tones one by one at a predetermined interval in response to depression of one or more selected keys and repeatedly changing pitches of these tones over selected octave ranges. The musical effect resembling arpeggio produced by the electronic musical instrument according to the invention will hereinafter be referred to as "chord pyramid" performance. This reference is derived from one mode of the arpeggio-like musical effect achieved by the present invention in which mode plural tones of depressed keys contituting a chord are produced one tone after another over one or more octave ranges in such a manner that tone pitches of the tones thus produced rise and fall in a pyramidal form.

It is another object of the invention to provide an electronic musical instrument of a type which generates key data representative of a key name of a depressed key, e.g. a digital code signal (i.e. key code) and produces a musical tone signal on the basis of such digital code signal with capability of automatically conducting the chord pyramid performance. More specifically, the instrument according to the invention can automatically conduct the chord pyramid performance in such a form that one or more notes selected on the keyboard are repeatedly produced over a plurality of octaves, each note rising in its octave pitch when it is produced next time (This form of chord pyramid performance will hereinafter be referred to as "up mode"). The instrument can further conduct the chord pyramid performance in such a form that selected notes repeatedly rise and fall in their pitch. (This form of chord pyramid performance will hereinafter be referred to as "turn mode"). A basic form of arpeggio can be simulated by such repetition of the rise in the tone pitch and repetition of the rise and fall in the tone pitch. If required, the rise, or the rise and fall, in the tone pitch is not repeated but conducted only once.

It is another object of the invention to provide an electronic musical instrument capable of producing a tone at a turning point from the rise portion to the fall portion only once and not twice while conducting the chord pyramid performance of the turn mode. Such avoidance of redundant playing of the same tone is effective for creating a closer simulation of arpeggio.

It is another object of the invention to provide an electronic musical instrument which, when a key to be depressed on the keyboard is continuously changed as in a legato performance while the chord pyramid performance is being conducted, can effect a new chord pyramid performance without interrupting an octave progress in the previous chord pyramid performance and thereby realize a smooth chord shifting. According to the invention, the octave progress in the previous chord pyramid performance may be interrupted in the case of legato performance and a new octave may be started depending upon a new key to be depressed. Accordingly, the performer can select either of the two ways of octave progress in the case of the legato type shift in a key to be depressed.

It is another object of the invention to provide an electronic musical instrument which is capable of not only producing tones of a plurality of depressed keys one by one from the lowest tone upwardly or vice versa at a predetermined interval without regard to the order of depression of the keys but also repeatedly producing tones of notes which the performer arbitrarily selects at an interval he desires and in the order of depression of the keys over a plurality of octaves. The performer therefore can select either of the two functions of the instrument in the chord pyramid performance. The former function in the chord pyramid performance will hereinafter be referred to as "regular mode" whereas the latter function as "random mode". If the performer selects the random mode, he can automatically play arpeggio over a plurality of octaves while maintaining the interval of tone production selected at his will.

For achieving the above described objects, the electronic musical instrument according to the invention is adapted to generate, in response to depression of a key, a key code consisting of binary data and representing the note-name, octave-name and keyboard-name of the depressed key, drive a chord pyramid counter at a high rate for counting operation in response to a timing signal determining an interval of tone generation in the chord pyramid performance, stop the counting operation of the counter temporarily every time the counting contents of the counter and contents of the key code coincide with each other, and generate a musical tone identified by the key code. Key codes for a plurality of depressed keys are supplied in a time sharing manner through a tone generation channel assigning circuit which is herein referred to as a "key assigner" or a "channel processor" for comparison with the contents of the chord pyramid counter. The chord pyramid counter which has suspended its counting operation resumes counting from the suspended counting contents upon receipt of a next timing signal appearing when a predetermined tone production interval has elapsed and continues counting until coincidence of another key code and the counting contents. Upon detection of the coincidence, the counter again stops counting and a tone identified by the key code is produced. In the foregoing manner, tones identified by one or more keys depressed on the keyboard are produced one by one at a predetermined time interval.

The chord pyramid counter is composed of, for example, an up-down counter having a modulo corresponding to the number of keys provided on a keyboard. When counting contents overflow (or become a predetermined maximum or minimum value) in the course of counting and a carry signal is produced, this signifies completion of detection for one cycle of the coincidence between the key codes with respect to all of the depressed keys and the counting contents of the counter. In response to this carry signal, an octave number is counted and stored by a chord pyramid octave counter. The performer selects a desired octave range (i.e. an octave number) in which the chord pyramid performance is to be conducted. When the selected octave number coincides with the octave number in the octave counter, the contents of the octave counter are returned to the original state in the case of the "up mode," whereas counting modes of the chord pyramid counter and the octave counter are changed in the case of the "turn mode".

In other words, the chord pyramid performance in the up mode can be conducted with the chord pyramid counter always being set in an up-counting mode but in the case of the chord pyramid performance in the turn mode, the counting modes of the chord pyramid counter and the octave counter must be changed from an up-counting mode to a down-counting mode or vice versa each time the performance through a desired number of octaves has been completed.

BRIEF DESCRIPTION OF THE DRAWING

FIG. 5(*b*) is a graphical diagram showing an envelope shape of a sustained tone used in the filter system musical tone forming system;

DESCRIPTION OF THE PRINCIPLE OF THE INVENTION

Figure 1:
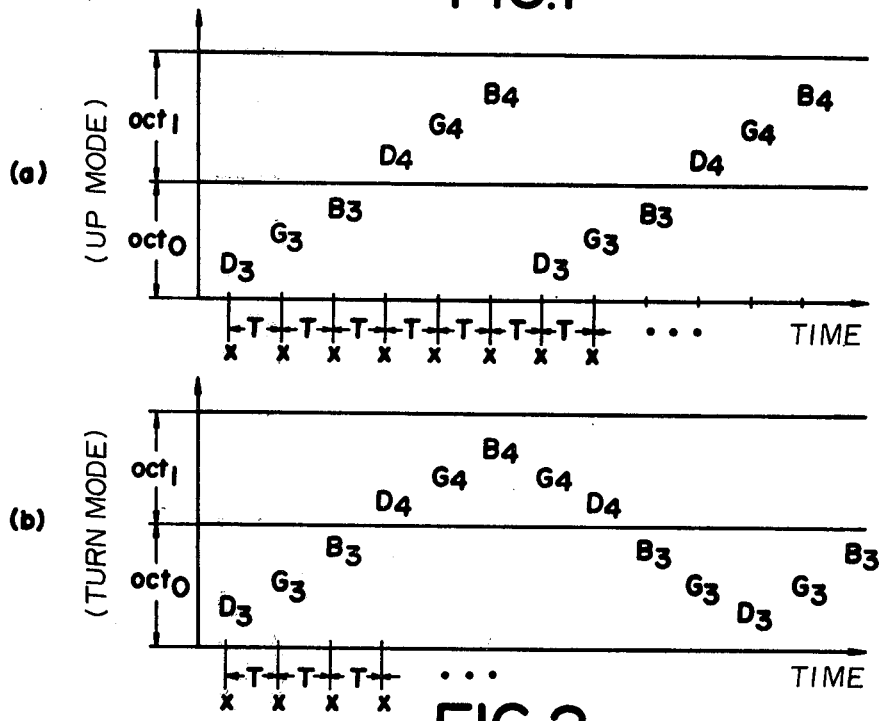
FIGS. 1(*a*) and 1(*b*) are graphical diagrams showing examples of a tone pitch variation in the chord pyramid performance with respect to the regular mode.

For a better understanding of the above described principle of the present invention, timing of tone generation of respective notes constituting a chord in the chord pyramid performance will be described with reference to FIGS. 1(*a*) and 1(*b*) which illustrate a case where three keys of $D_3$, $G_3$ and $B_3$ are depressed and two octaves are selected as the arpeggio range. FIG. 1(*a*) shows a case where the up mode has been selected as the tone pitch change mode in the chord pyramid performance. In the figure, reference characters "oct 0" designate an octave range in which actually depressed keys are located and "oct 1" an octave range which is one octave higher than the "oct 0". A tone production interval T is constant for each tone (i.e. constant in hearing). The tone production interval herein signifies a period of time from the beginning of production of a tone till the beginning of production of a next tone. There is a period of time designated by reference character X. This period of time X is illustrated in the figure as if it was a time point having no time length at all. The period of time X however is actually a period during which the chord pyramid counter is counting and scanning at an extremely high rate, though this period is such a short length of time that the audience can hardly appreciate it. In the example shown in FIG. 1(*a*), counting for scanning is resumed from counting contents corresponding to the key code of the note $B_3$ (or the note $B_4$) immediately after the tone production time interval T has lapsed since the start of the note $B_3$ (or the note $B_4$). The chord pyramid counter produces a carry signal in the course of counting for scanning as has previously been described. As the scanning operation is continued, coincidence between the counting contents and a key code for the note $D_4$ (or $D_3$) is detected when the counting contents have amounted to those corresponding to the key code for the note $D_4$ (or $D_3$) and thereupon the tone of the note $D_4$ (or $D_3$) is produced.

FIG. 1(*b*) shows a case where the turn mode has been selected as the tone pitch change mode. In the two octave range in which the tone pitch of the produced tone rises from "oct 0" to "oct 1", the chord pyramid counter and the chord pyramid octave counter are set at an up-counting mode, whereas in the two octave range in which the tone pitch falls from "oct 1" to "oct 0", these counters are set at a down-counting mode. For preventing redundant production of the same tone at a turning point from rising to falling of the tone pitch, the instrument according to the invention is so constructed that a previously stored code is rewritten each time a key code coincides with contents of the chord pyramid counter and the new key code coincidence of which has been detected is stored, whereas the stored coincidence code is written in the chord pyramid counter and the count of this counter is caused to advance by 1 count when the chord pyramid counter produces a carry signal on the condition that the contents of the octave counter have amounted to a set octave number (e.g. "oct 1") in the period during which the tone pitch is rising or to the original octave number (i.e. "oct 0") in the period during which the tone pitch is falling. In the example shown in FIG. 1(*b*), as the counting by the chord pyramid counter is resumed from the count corresponding to the note $B_4$ (or $D_3$) immediately before the lapse of the interval T from starting of production of the note $B_4$ (or $D_3$) at the turning point, the counting is once stopped when a carry signal is produced by the chord pyramid counter and the previously stored coincidence code for $B_4$ (or $D_3$) is loaded in the chord pyramid counter. The counting mode of the chord pyramid counter and octave counter is now changed from the up-mode to the down-mode (or from the down mode to the up-mode) and the count of the chord pyramid counter is caused to advance by 1 count. Then the counting is resumed. By this arrangement, the previous coincidence code $B_4$ (or $D_3$) is jumped over in down-counting (or up-counting) carried out by the chord pyramid counter and, accordingly, coincidence is detected when the counting contents become a count corresponding to the key code for the note $G_4$ which is the first note below the turning point (or the key code for the note $G_3$ which is the first note above the turning point). Thus a tone corresponding to this coincidence code (i.e. $G_4$ or $G_3$) is produced. The foregoing description has been made on the assumption that the value of the key code increases as the tone pitch rises (i.e. the note rises in the order of C#, D, . . . C and the octave also rises).

According to the invention, timing of production of the respective notes constituting the chord pyramid (arpeggio tones) is controlled by the timing signal of the interval T, whereas an octave in which each note finds its position (i.e. shift of each note by octave) is designated in accordance with an octave number stored in the chord pyramid octave counter or an amount of octave slide (e.g. "oct 0", "oct 1", etc.). This designation is effected by modifying the code portion representing an octave in the key code in response to the contents of the octave counter. Alternatively, the designation is effected by shifting a binary digit of a reading address in response to the contents of the octave counter in reading contents of a waveform memory by cumulatively adding numerical values proportionate to frequencies read out in accordance with the key code.

According to the invention, change of a key to be depressed in a legato performance is detected upon depression of one or more new keys while a previously depressed key or keys are still being depressed. If the player desires a new chord pyramid performance while continuing the octave of a previous chord pyramid performance, the octave stored in the chord pyramid octave counter is continuously used without being cancelled. If the octave of the previous chord pyramid performance is not used, the octave stored in the octave counter is cancelled and counting is newly started.

Figure 2:
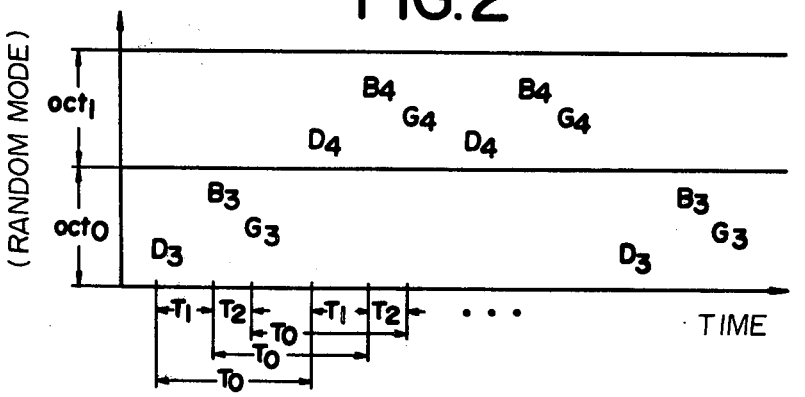
FIG. 2 is a graphical diagram showing another example of the tone pitch variation in the chord pyramid performance with respect to the random mode.

The chord performance such as shown in FIGS. 1(*a*) and 1(*b*) in which tones of notes constituting a chord are produced one by one at the interval T is a basic form, i.e. "regular mode", of the chord pyramid performance. For achieving the "random mode" of the chord pyramid performance, the above described chord pyramid counter is not used but the chord pyramid octave counter is used independently for each tone production channel. In the case of the random mode, if a certain key is depressed, a tone associated with the depressed key is produced with its octave being shifted. More specifically, the tone associated with the depressed key is initially produced in the octave range ("oct 0") to which the note of the depressed key belongs, as shown in FIG. 2. When a period of time $T_0$ has elapsed from the start of production of the tone, the octave counter for the tone production channel of this tone is caused to advance its count by 1 count whereby the associated tone is produced in an octave ("oct 1") designated by this octave counter. Assume now that a key for a note $D_3$ is initially depressed, then a key for a note $B_3$ is depressed at the lapse of a time interval $T_1$ and further a key for a note $G_3$ is depressed at the lapse of a time interval $T_2$. Each of tones associated with these keys is independently produced at a time interval $T_0$ with its octave being shifted each time it is produced (i.e., $D_3 \rightarrow D_4$, $B_3 \rightarrow B_4$ and $G_3 \rightarrow G_4$). The initial tone production intervals $T_1$ and $T_2$ between the respective notes D, B and G for the depressed keys are maintained in the subsequent tone production.

Selection between the "turn mode" and the "up mode" is possible also in the random mode of the chord pyramid performance. FIG. 2 illustrates a case where the turn mode has been selected. According to the invention, selection between the regular mode and the random mode is possible by switching operation of a selection switch of any suitable type. In accordance with switching of such selection switch, the operation system of the chord pyramid counter is brought into operation or the chord pyramid octave counter is brought into operation independently for each tone production channel.

DESCRIPTION OF PREFERRED EMBODIMENTS

Figure 3:
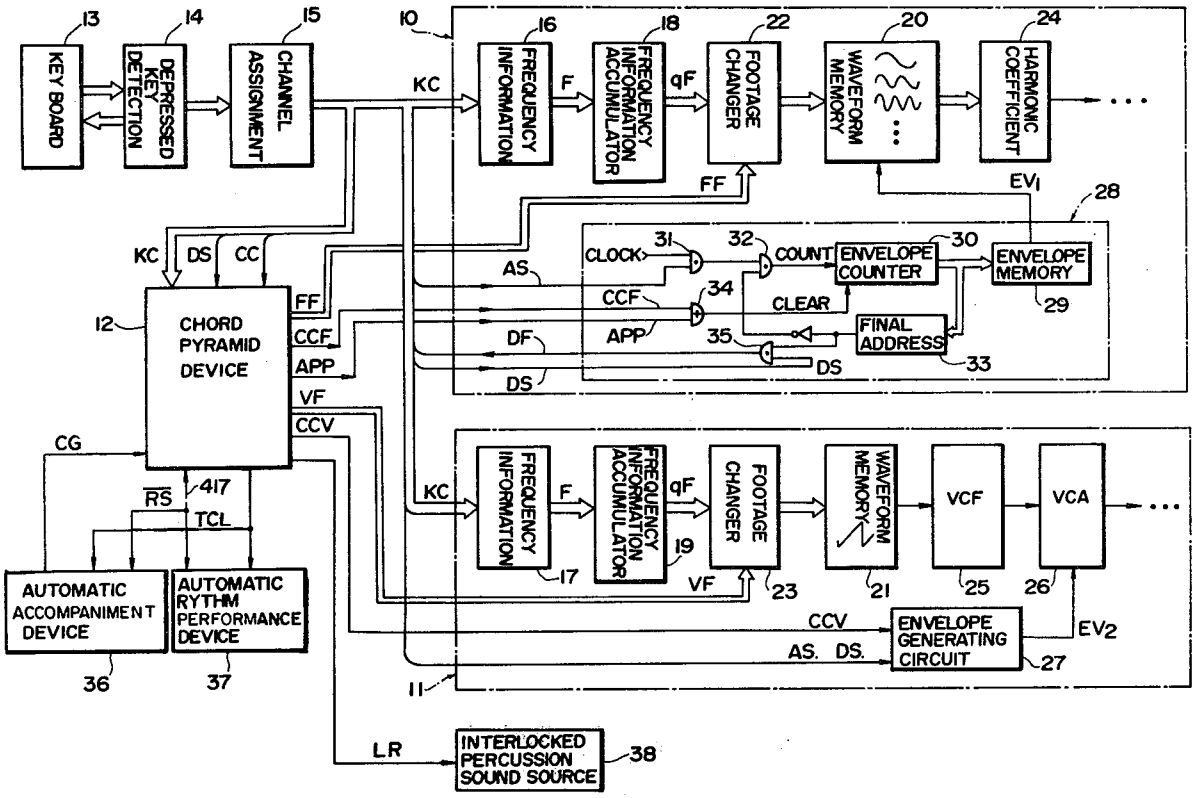
FIG. 3 is a block diagram showing an embodiment of the electronic musical instrument according to the invention.

FIG. 3 shows an example wherein the invention has been applied to an electronic musical instrument comprising two different musical tone forming systems 10 and 11 and forming musical tones by those two different systems. An inventive feature of this instrument resides in a chord pyramid device 12. For convenience of explanation, an overall construction of the musical instrument will be described first.

The electronic musical instrument comprising the two different musical tone forming systems 10 and 11 is disclosed in detail in the specification of U.S. Pat. No. 4,082,027 filed Apr. 20, 1976 and assigned to same assignee as the present application. so that an outline of the instrument will be only briefly described in this specification.

A depressed key detection circuit 14 detects an ON-OFF operation of key switches for respective keys arranged on a keyboard 13 and outputs information identifying a depressed key. A tone production channel assignment circuit 15 receives this information identifying the depressed key from the depressed key detection circuit 14 and thereupon assigns production of a tone for the key represented by this information to any one of channels which are provided in the number which defines a maximum number of tone which the instrument can produce simultaneously. The tone production channel assignment circuit 15 has storage positions corresponding to the respective channels, storing a key code KC representing the depressed key in a storage position corresponding to the channel to which production of the tone of the depressed key has been assigned and outputting the key code KC stored in storage positions corresponding to respective channels sequentially and repetitively in a time sharing manner. If, accordingly, a plurality of keys are depressed on the keyboard 13, tone productions of the respective depressed keys are assigned to mutually different channels and a key code KC representing each of the assigned keys is stored in a storage position corresponding to a channel to which the key has been assigned. The respective storage positions may, for example, be constituted by circulating type shift registers. Assuming now that a key code for specifying each key on the keyboard 13 is, for example, a 9-bit code as shown in the following Table 1 which consists of a 2-bit keyboard code $K_2$, $K_1$ representing a kind of keyboard, a 3-bit octave code $B_3$, $B_2$, $B_1$ representing an octave range and a 4-bit note code $N_4$, $N_3$, $N_2$, $N_1$ representing a note name in one octave range and also assuming that a total number of the channels is 12, a shift register of 12 stages (1 stage consisting of 9 bits) may be employed.

Table 1

| | | KEY CODE KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| keyboard | upper | 0 | 1 | | | | | | | |
| | Lower | 1 | 0 | | | | | | | |
| | Pedal | 1 | 1 | | | | | | | |
| | 1 | | | 0 | 0 | 0 | | | | |
| | 2 | | | 0 | 0 | 1 | | | | |

Table 1-continued

| | | KEY CODE KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Octave range | 3 | | | 0 | 1 | 0 | | | | |
| | 4 | | | 0 | 1 | 1 | | | | |
| | 5 | | | 1 | 0 | 0 | | | | |
| | 6 | | | 1 | 0 | 1 | | | | |
| Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

Figure 4:
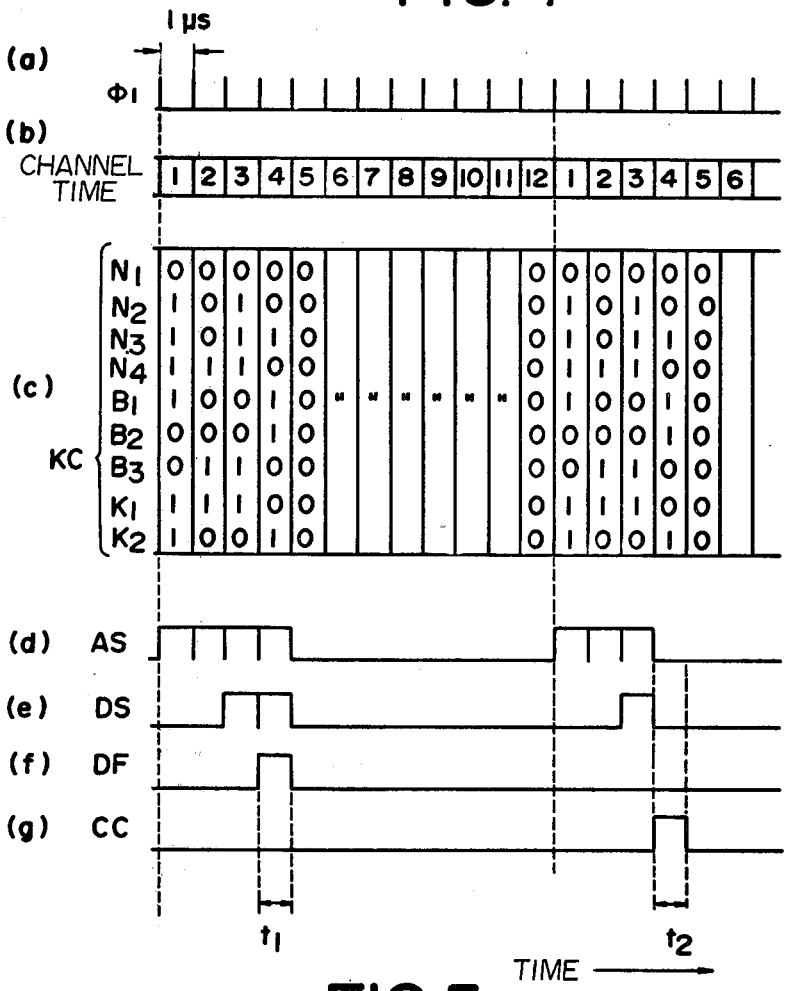
FIGS. 4(*a*) through 4(*g*) are a time chart for explaining the operation of the tone production assignment circuit shown in FIG. 3.

In the present embodiment in which various counters, logical circuits and memories are constructed in dynamic logics so that they are commonly used in time sharing for enabling a plurality of tones to be produced simultaneously, time relations between clock pulses used for controlling these counters etc. are very important. FIG. 4(*a*) shows a main clock pulse $\phi_1$. This main clock pulse $\phi_1$ is used for controlling a time sharing operation of respective channels and has a pulse period of e.g. 1 $\mu$s ($10^{-6}$ second). Since the number of the channels is 12, time slots each having a width of 1 $\mu$s successively defined by the main clock pulse $\phi_1$ correspond sequentially to the first through twelfth channels. As shown in FIG. 4(*b*), these time slots are referred to as first channel time second channel time . . . twelfth channel time, respectively. Each of these channel times occurs circulatingly sequentially and repetitively. Accordingly, the key codes KC representing the keys whose tone productions have been assigned by the channel assignment circuit 15 (i.e. the key code stored in the shift register) are sequentially outputted in time sharing in synchronism with the channel time of the respective assigned channels. Assume, for example, a note C in a second octave of a pedal keyboard has been assigned to the first channel, a note G in a fifth octave of an upper keyboard to the second channel, a note C in a fifth octave of the upper keyboard to the third channel, a note E in a fourth octave of a lower keyboard to the fourth channel and no tone production has been assigned to the fifth to twelfth channels. Contents of key codes KC in this case outputted from the tone production assignment circuit 15 in time sharing in synchronism with the respective channel times are as shown in FIG. 4(*c*). The outputs from the fifth to twelfth channels are all "0".

The tone production assignment circuit 15 produces, in time sharing and in synchronism with each channel time, an attack start signal (or a key-on signal) AS indicating that a tone should be generated in the channel to which the depressed key has been assigned. The circuit 15 further produces, also in time sharing and in synchronism with each channel time, a decay start signal (or a key-off signal) DS indicating that the key assigned to the channel has been released and the tone of that key should therefore decay. These signals As and DS are used for an amplitude envelope control (tone production control of the musical tone. The tone production assignment circuit 15 receives a decay finish signal DF representing completion of tone production in the particular channel from an envelope generation circuit to be described later and thereupon produces a clear signal CC which clears various storage concerning the particular channel and thereby cancels tone production in the channel. In the example shown in FIG. 4(*c*), keys assigned to the first channel and the second channel are being depressed, key assigned to the third channel and the fourth channel have already been released and tones for these released keys are decaying, tone production is completed and the decay finish signal DF is generated in the fourth channel at a time slot $t_1$, and the clear signal CC is produced in the fourth channel at a time slot $t_2$ which is 12 channel times after the time slot $t_1$. In the given case, signals AS, DS, DF and CC are produced as shown in FIGS. 4(*d*) through 4(*g*). The attack start signals AS and the decay start signal DS in the fourth channel are cancelled at the time slot $t_2$ since at this time the clear signal CC is produced. Further, the key code KC in the fourth channel time in FIG. 4(*c*) is actually cancelled, though it is depicted as existing in the figure for convenience of description.

As will be understood from FIG. 4, a channel to which the signals KC, AS, DS and CC provided by the tone production assignment circuit 15 belong is identified by the channel time.

Detailed circuit constructions of the channel assignment circuit 15 and the depressed key detection circuit 14 are not illustrated in this specification. As these circuits, circuits disclosed in the specification of U.S. Pat. No. 3,882,751 may be utilized. Alternatively, these circuits may be constituted by devices disclosed in the specifications of U.S. Pat. application Ser. Nos. 712815 filed Aug. 9, 1976 and 714084 filed Aug. 13, 1976, both assigned to the same assignee as the present application.

The key code KC, the attack start signal AS and the decay start signal DS are respectively supplied to the musical tone forming systems 10 and 11, and the key code KC, the decay start signal DS and the clear signal CC are supplied to the chord pyramid device 12.

In the musical tone forming systems 10 and 11, the key code KC supplied from the channel assignment circuit 15 is used as an address signal for reading from frequency information memories 16 and 17 numerical information specifically allotted to a musical tone frequency for a key corresponding to the key code KC.

The frequency information memories 16 and 17 are constituted by, e.g., read-only memories previously storing frequency information F (constants). If a key code KC is applied to them, frequency information F stored in the address designated by the key code KC is read out. The read out frequency information F is successively and cumulatively added by frequency information accumulators 18 and 19 and the result of the cumulative addition of the frequency information F is used for sampling a musical tone waveform at a regular time interval. Accordingly, the frequency F is a digital numerical value proportional to the musical tone frequency for the key consisting of a binary signal of, e.g., 15 bits are disclosed in the specification of U.S. Pat. No. 3,882,751.

This frequency information F is a numerical value which includes a value under a decimal point if it is expressed in a decimal notation. The most significant bit of 15 bits constituting the frequency information F corresponds to an integer and the rest of 14 bits to a portion under a decimal point.

The value of the frequency information F is determined if a value of the musical tone frequency is specified at a specific sampling rate. Assume, for example, that sampling of one cycle of the musical tone waveform is completed when a value qF (where q is 1, 2, 3 . . . ) obtained by cumulatively adding the frequency information F by the frequency information accumulators 18 and 19 has amounted to 64 in decimal notation and that this cumulative addition is conducted every 12 μs in which the entire channel times complete one cycle. The value of the frequency information F is determined by the following equation:

$$F=12\times 64\times f\times 10^{-6}$$

(where f represents frequency of the musical tone)

The value F corresponding to the frequency f to be obtained is stored in the memories 16 and 17. For example, a musical tone frequency corresponding to a note $C_2$ is 65.406 Hz and the value F is 0.052325. As for other notes, the value F is similarly determined.

Relationship between the frequency f and the frequency information F is shown in the following Table 2.

Table 2

| | | Frequency information F | | | | | | | | | | | | | | | |
|---|---|---|---|---|---|---|---|---|---|---|---|---|---|---|---|---|---|
| | | Binary number | | | | | | | | | | | | | | | |
| | Frequency | Integer portion | Fraction portion (bit) | | | | | | | | | | | | | | Decimal |
| note | (Hz) | 15 | 14 | 13 | 12 | 11 | 10 | 9 | 8 | 7 | 6 | 5 | 4 | 3 | 2 | 1 | Value |
| $C_2$ | 65.406 | 0 | 0 | 0 | 0 | 0 | 1 | 1 | 0 | 1 | 0 | 1 | 1 | 0 | 0 | 1 | 0.052325 |
| $C_3$ | 130.813 | 0 | 0 | 0 | 0 | 1 | 1 | 0 | 1 | 0 | 1 | 1 | 0 | 0 | 1 | 0 | 0.104650 |
| $C_4$ | 261.626 | 0 | 0 | 0 | 1 | 1 | 0 | 1 | 0 | 1 | 1 | 0 | 0 | 1 | 0 | 1 | 0.209300 |
| $C_5$ | 523.251 | 0 | 0 | 1 | 1 | 0 | 1 | 0 | 1 | 1 | 0 | 0 | 1 | 0 | 1 | 0 | 0.418600 |
| $C_6$ | 1046.502 | 0 | 1 | 1 | 0 | 1 | 0 | 1 | 1 | 0 | 0 | 1 | 0 | 1 | 0 | 0 | 0.837200 |
| $D_6$# | 1244.508 | 0 | 1 | 1 | 1 | 1 | 1 | 1 | 1 | 0 | 1 | 1 | 1 | 0 | 0 | 0 | 0.995600 |
| $E_6$ | 1318.510 | 1 | 0 | 0 | 0 | 0 | 1 | 1 | 1 | 0 | 0 | 0 | 0 | 0 | 0 | 1 | 1.054808 |
| $C_7$ | 2093.005 | 1 | 1 | 0 | 1 | 0 | 1 | 1 | 0 | 0 | 1 | 0 | 1 | 0 | 0 | 1 | 1.674400 |

The accumulators 18 and 19 are provided for cumulatively adding the frequency information F at a constant sampling rate (e.g. at a rate of 12 μs for each channel time as in the present embodiment) and thereby obtaining resulting values qF (where q=0, 1, 2 . . . ) for advancing the phase of the musical tone waveform to be read out. These accumulators produce an overflow output and return to 0 when the value qF has amounted 64 in decimal notation thereby completing reading out of one cycle of the musical tone waveform. Since 63 in decimal notation can be expressed by a 6-bit binary signal, a counter whose one stage consists of 20 bits (14 bits thereof on a less significant bit side thereof constituting a fraction section and 6 bits thereof on a more significant bit side constituting an integer section) for holding a result of accumulation until the accumulated value qF becomes 64 in the cumulative addition of the frequency information F of which the fifteenth bit constitutes the first digit of integer section. Each of the accumulators 18 and 19 should preferably be composed of an adder of 20 bits and a 12 stage-20 bit shift register so that it may be commonly used for the respective channels in a time sharing manner. The musical tone waveform is defined at a plurality of sample points (e.g. 64) and the sampled amplitudes of the musical tone waveform are successively stored in musical tone waveform memories 20 and 21. The value qF which is the output of the accumulators 18 and 19 constitutes input to the waveform memories 20 and 21 used for designating an address for reading out the stored amplitudes. Since the number of address of the waveform memories 20 and 21 is 64, data of 6 bits on a more significant bit side which corresponds to an integer portion of the value qF is applied to the waveform memories 20 and 21 as the address input. Data of 14 bits on a less significant bit side which corresponds to a fraction section of the value qF is used only for cumulative addition in the accumulators 18 and 19.

As the value qF increases in the accumulators 18 and 19, the address designating a sampled amplitude to be read out is successively shifted and the sampled amplitude valus of the musical tone waveform are sequentially and successively and repetitively read from the waveform memories 20 and 21.

Footage changer circuits 22 and 23 are respectively provided between the accumulators 18, 19 and the musical tone waveform memories 20, 21. These footage changer circuits 22 and 23 are so constructed that they can shift the digit of the binary signal qF outputted by the accumulators 18 and 19 for accessing the waveform memories 20 and 21 in accordance with octave change designation signals FF and VF. Accordingly, when there is no designation of an octave change, the output qF (i.e. 6 bit data on the more significant bit side which represents an integer portion) of the accumulators 18 and 19 is applied directly to the waveform memories 20 and 21, whereas when the octave change is instructed, the output qF is converted to a value of twice, four times or eight times . . . as large as an original value in accordance with the designated octave number and thereafter is applied to the waveform memories 20 and 21. By conversion of the value qF to a value twice, four times or eight times . . . as large as the original value in the footage changer circuits 22 and 23, a sampled amplitude value at an addresse which is twice, four times or eight times . . . ahead of an address actually designated by the accumulators 18 and 19 is read from the waveform memories 20 and 21. The shift in the address by twice, four times or eight times in a constant sample period (i.e. 12 $\mu$s in the present embodiment) signifies that the phase of the read out musical tone waveform advances by twice, four times or eight times . . . , that is, the frequency of the produced musical tone becomes twice, four times or eight times or, alternatively stated, the octave of the musical tone is changed by one octave, two octaves or three octaves . . .

The octave change designation signals FF and VF designating an octave number to which the octave of the musical tone should be changed are provided by the chord pyramid device 12. The signal FF designates an octave number in the musical tone forming system 10, whereas the signal VF designates an octave number in the musical tone forming system 11. The chord pyramid performance can therefore be made in the two systems 10 and 11 independently from each other.

In the musical tone forming system 10, the waveform memory 20 comprises a plurality of tone source waveform (sine waveforms) memories respectively storing waveforms of respective harmonics. These harmonic waveforms stored in the tone source waveform memories are simultaneously read out in response to the address signal applied from the accumulator 18 through the footage change circuit 22. A harmonic coefficient circuit 24 connected to the waveform memory 20 is a circuit for controlling relative amplitudes of the read out harmonic waveforms. A musical tone waveform of a desired tone color is synthesized by adding together the respective harmonic waveforms thus having been controlled in their relative amplitudes. As described in the foregoing, the musical tone forming system 10 produces a musical tone of a desired tone color by a harmonics synthesizing process.

In the other musical tone forming system 11, the musical tone waveform memory 21 stores a tone source waveform containing an abundant harmonic content (e.g. a saw-tooth waveform). The tone source waveform read from the waveform memory 21 is applied to a voltage-controlled type filter (VCF) 25 for a tone color control and thereafter to a voltage-controlled type amplifier (VCA) 26 for providing it with an amplitude envelope. The voltage-controlled type filter 25, the voltage-controlled type amplifier 26 and an envelope generation circuit 27 for the VCA 26 to be described later are provided in parallel for the respective channels, though illustration thereof is omitted.

Since the tone source signal read from the waveform memory 21, the attack start signal AS and the decay start signal DS from the channel assignment circuit 15 and a filter system clear signal CCV from the chord pyramid device 12 are time division multiplexed signals for the respective channels, these signals need to be distributed to the parallel tone production circuits in correspondence to the respective time shared channels through a reassignment circuit (not shown) in case these signals are supplied to the parallel circuits each including the voltage-controlled type filter 25 and the envelope generation circuit 27. This arrangement however is not a subject matter of the present invention so that a detailed description thereof will be omitted.

In the musical tone forming system 10 employing a harmonics synthesizing system, a tone pitch of a produced tone is determined by contents of the key code KC from the channel assignment circuit 15 and the octave change designation signal FF of the harmonics synthesizing system from the chord pyramid device 12. Timing of tone production responds to the fall of the harmonics synthesizing system clear signal CCF provided by the chord pyramid device 12 when the attack start signal AS is being produced. In the musical tone forming system 11 of the filter system, a tone pitch of a produced tone is determined by contents of the key code KC and the filter system octave change designation signal VF and timing of tone production responds to the fall of the filter system clear signal CCV provided by the chord pyramid device 12 when the attack start signal AS is being produced.

Tone production in the musical tone forming systems 10 and 11 is controlled by envelope signals $EV_1$ and $EV_2$ supplied from envelope generation circuits 28 and 27. In the musical tone forming system 10, for example, a tone source waveform having an amplitude corresponding to magnitude of the envelope signal $EV_1$ is read from the musical tone waveform memory 20. In the musical tone forming system 11, gain of the voltage-controlled type amplifier 26 is controlled in response to magnitude of the envelope signal $EV_2$ and, accordingly, a musical tone waveform signal having a amplitude corresponding to the magnitude of the signal $EV_2$ is outputted. An example of circuit construction of the envelope generation circuits 27 and 28 is schematically shown in a block 28. An envelope memory 29 previously stores an amplitude envelope of a musical tone which corresponds to variation of volume with time. An address for reading contents of the envelope memory 29 is shifted in response to counting output of an envelope counter 30. A clock for causing the counter 30 to carry on its counting (i.e. shifting the address of the envelope memory 29) is supplied to the counter 30 through AND gates 31 and 32. The AND gate 31 receives as its other input the attack start signal AS. When a count of the counter 30 has amounted to one corresponding to a final address of the envelope memory 29, a final address detection logic 33 produces an output "1" and application of the clock to the envelope counter 30 is thereby inhibited at the AND gate 32. When the clear signal CCF has been applied to the counter 30 through an OR gate 34. The counter 30 is cleared and the reading address of the envelope memory becomes 0. When the clear signal CCF has fallen, the counter 30 starts counting from 0 if the attack start signal AS has been supplied to the counter 30 whereby the envelope signal $EV_1$ is read from the envelope memory 29.

Timing of tone production is controlled by the clear signal CCF (or CCV) in the case of the chord pyramid performance as described above, whereas in a case where the chord pyramid performance is not conducted (i.e. in a case of a conventional performance), timing of tone production is controlled by an attack pulse APP. The attack pulse APP is a pulse of a small width produced at the beginning of depression of a key on the keyboard 13. In the present embodiment, the attack pulse APP is generated through a circuit in the chord pyramid device 12. If the decay start signal DS has been produced when a final address is detected in the final address detection logic 33, the decay finish signal DF is produced through an AND gate 35 and supplied to the channel assignment circuit 15.

Figure 5:
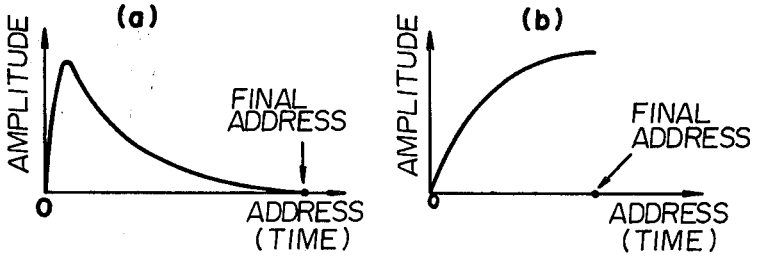
FIG. 5(*a*) is graphical diagram showing an envelope shape of a decaying tone used in the harmonics synthesizing system musical tone forming system.

According to the present embodiment, a percussive type envelope signal $EV_1$ as shown in FIG. 5(*a*) is read from the envelope memory 29 of the envelope generation circuit 28 of the harmonics synthesizing system, whereas a sustain type envelope signal $EV_2$ as shown in FIG. 5(*b*) is read from the envelope generation circuit 27 of the filter system. Accordingly, in the case of the harmonics synthesizing system, when accessing of the envelope memory is stopped at the final address, the envelope signal $EV_1$ becomes 0 and tone production is thereby stopped, whereas in the case of the filter system, a high amplitude level at the final address continues to be produced and tone production therefore is continued even after stopping of reading of the envelope memory at the final address. If the chord pyramid performance of the regular mode is desired in the filter system, arrangements are made for cancelling tone production of a sustained tone previously produced and producing a new sustained tone so as to simulate arpeggio to a maximum possible degree (i.e., to produce tones more articulately). This arrangement will now be described.

In the electronic musical instrument shown in this embodiment, an automatic accompaniement apparatus 36 capable of conducting an automatic bass accompaniment and an automatic chord accompaniment and an automatic rhythm playing apparatus 37 may be incorporated in addition to the chord pyramid device 12. In this case, the chord pyramid device 12 operates in association with these apparatuses 36 and 37. More specifically, a reset signal $\overline{RS}$ is inputted and outputted between these devices 12, 36 and 37 for controlling start and stop of performance of these devices in synchronization with each other. Further, a basic tempo clock pulse TCL of the automatic accompaniment apparatus 36 and automatic rhythm playing apparatus 37 are provided through the chord pyramid device 12 so that the basic tempo of the automatic performance is synchronous throughout the devices 12, 36 and 37. Furthermore, a signal CG representing timing of a chord outputted by the automatic accompaniment apparatus 36 is converted to the filter system clear signal CCV through the chord pyramid device 12.

This arrangement is necessary in the present embodiment in which the chord pyramid device 12 and the automatic accompaniment apparatus 36 are simultaneously operated, for a chord pyramid tone is produced in the harmonics synthesizing system type tone forming system 10 and an automatic accompaniment tone is produced in the filter system type tone forming system 11.

In the present embodiment, the chord pyramid tone is produced not only in the harmonics synthesizing system type musical tone forming system 10 or the filter system type musical tone forming system 11 but also as an interlocked percussion sound to be described later. A signal LR representing timing of production of a chord pyramid tone as an interlocked percussion sound is supplied from the chord pyramid device 12 to an interlocked percussion sound source 38 so that the interlocked percussion sound is produced at a timing of production of the chord pyramid tone.

Figure 6:
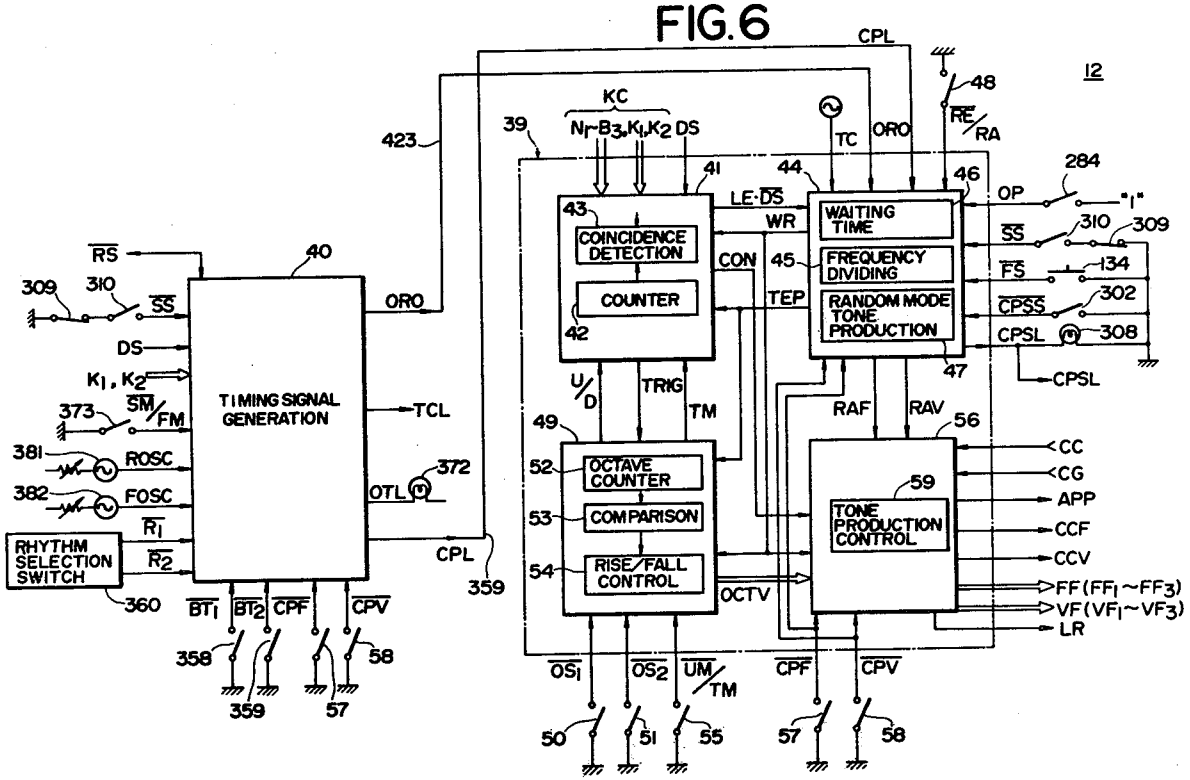
FIG. 6 is a block diagram of an example of construction of the chord pyramid device in FIG. 3 showing interrelations between five circuit portions separately illustrated in FIGS. 7 through 11.

An example of circuit construction of the chord pyramid device 12 is shown in FIGS. 7 through 11 in a divided form. FIG. 6 schematically shows relations between respective component parts of the chord pyramid device 12. In FIG. 6, entire connections between the component parts are not shown but connections representing main relations therebetween only are illustrated. A chord pyramid device main body circuit 39 is divided in four circuit portions 41, 44, 49 and 56 in FIG. 6 and FIGS. 7–10. It will be appreciated, however, that this division of the circuit 39 is of no significant importance but is simply made for convenience of drafting of the drawings.

Figure 7:
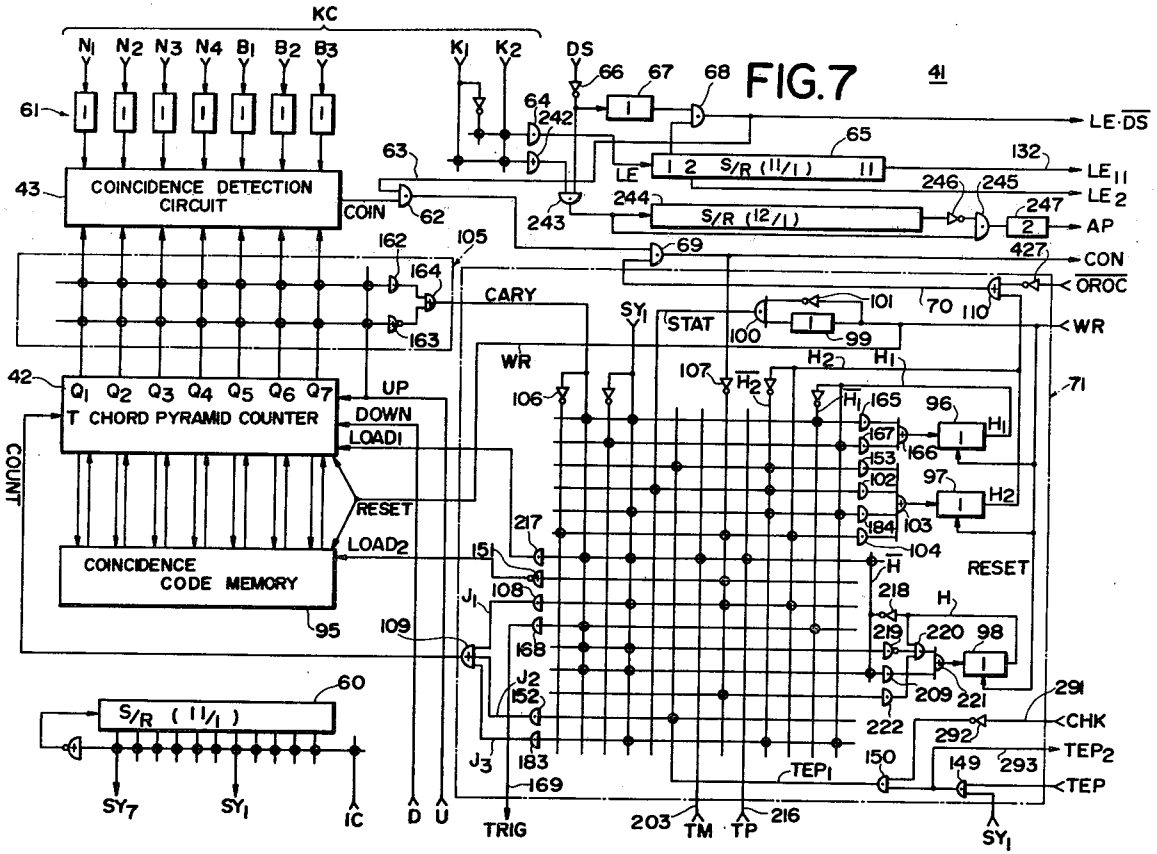
FIG. 7 is a circuit diagram showing a circuit portion 41 in FIG. 6 in detail.

In FIG. 6, the chord pyramid device 12 comprises portions 39 and 40 and various switches connected to these portions. The portion 39 constitutes the chord pyramid device main body circuit and the portion 40 constitutes a timing signal circuit for the chord pyramid device. In the circuit portion 41, a chord pyramid counter 42 conducts counting at a high rate for scanning operation. A coincidence detection circuit 43 compares contents of the counter 42 with the key code KC (i.e. note code $N_1$–$N_4$ and block code $B_1$–$B_3$) from the tone production assignment circuit 15 and, when there is coincidence between them, produces a coincidence signal CON. The counter 42 thereupon stops counting and resumes it from the position in which it has stopped when a tone production timing pulse TEP is provided by the circuit portion 44. Then, if another key code KC coincides with countents of counter 42, the coincidence signal CON is again produced. Accordingly, key codes ($N_1$–$B_3$) of a plurality of keys being depressed on the keycoard 13 among keys for notes $N_1$–$B_3$ causes the coincidence signal CON to occur one after an other in the order of scanning of the counter 42 each time the tone production pulse TEP is produced. This coincidence signal CON is produced in synchronization with the channel times assigned to the key codes corresponding to the signal CON. Accordingly, a channel in which tone production should be made, i.e., a key code tone of which should be produced when the coincidence signal CON has been produced can be known by the chnnel time. Details of the portion 41 are shown in FIG. 7.

The circuit portion 44 receives the chord pyramid basic tempo clock CPL and produces the tone production timing pulse TEP by frequency-dividing this clock CPL in a frequency dividing circuit 45. A waiting time setting circuit 46 is also provided in the circuit portion 44 for setting a predetermined waiting time in an initial stage of key depression during which the circuit 46 produces a waiting time setting reset signal WR for resetting circuits in the chord pyramid device main body circuit 39. Even though the performer intends to depress a plurality of keys simultaneously, some slight difference actually occurs in a starting time of depression of these keys. In view of this, an insensitive time zone, i.e. the waiting time, is provided in the initial stage of depression of each key so that the start of tone production will comply with a human sense.

Figure 8:
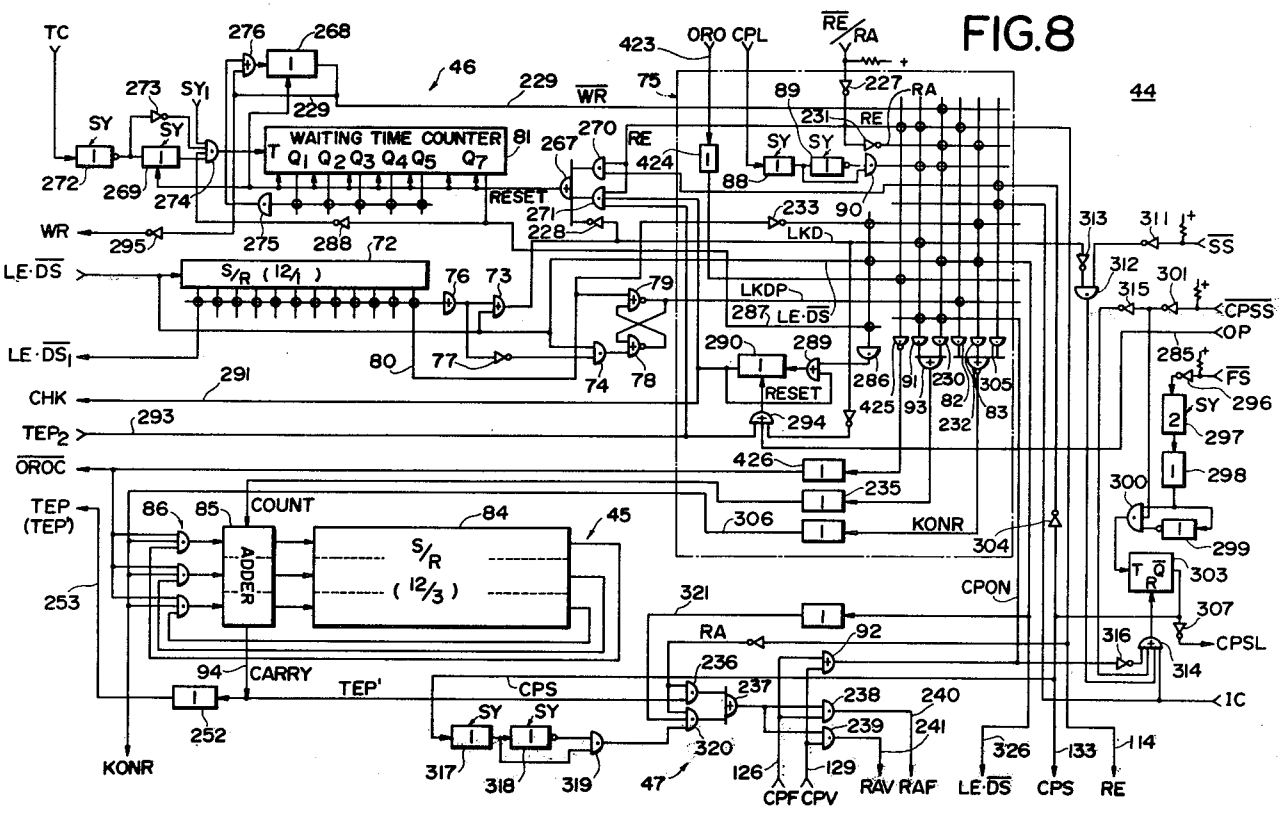
FIG. 8 is a circuit diagram showing a circuit portion 44.

It is only in the chord pyramid performance of the regular mode that the circuit portion 41 operates to produce the coincidence signal CON. In the case of the chord pyramid performance of the random mode, a tone production timing signal RAF or RAV is produced by a random mode tone production control circuit 47 in the circuit portion 44. Selection between the regular mode and the random mode is made by manipulation of a selection switch 48. If the switch 48 is closed, a regular mode selection signal RE becomes "1" ($\overline{RE}$="0") and the regular mode thereby is selected. If the switch 48 is opened, a random selection signal RA becomes "1" ($\overline{RE}$="1", RE="0") and the random mode thereby is selected. Details of the circuit portion 44 are shown in FIG. 8.

Figure 9:
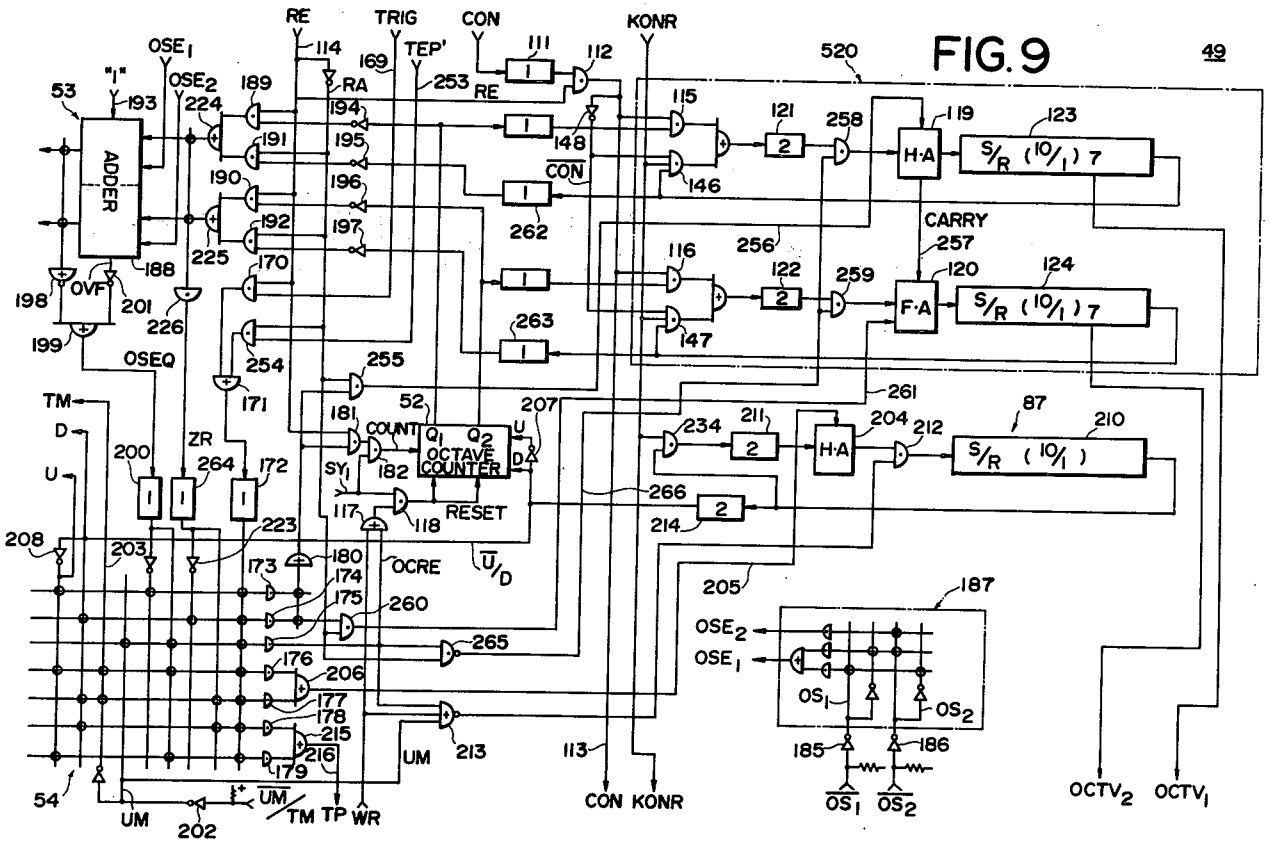
FIG. 9 is a circuit diagram showing a circuit portion 49 in detail.

The circuit portion 49 comprises a circuit for controlling an automatic octave change in the chord pyramid performance (hereinafter referred to as "octave slide") and a circuit for designating up-counting or down-counting in accordance with selection of the up-mode or the turn-mode. An amount of the octave slide in the chord pyramid performance can be set in a 2-bit digital value by octave slide amount setting switches 50, 51. An octave change pulse TRIG is produced each time the chord pyramid counter 42 overflows and outputs a carry signal. A chord pyramid octave counter 52 counts the pulse TRIC and produces an octave instruction signal OCTV. An octave comparison circuit 53 compares the amount of octave slide set by the switches 50 and 51 with contents of the octave instruction signal OCTV and, if there is coincidence, supplies its output to an octave rise and fall control circuit 54. The octave rise and fall control circuit 54 controls rise and fall of the tone pitch or the octave number and repetition of the octave change in response to the output of the comparison circuit 53 and an up-mode turn-mode selection switch 55. Details of the circuit portion 49 are shown in FIG. 9.

Figure 10:
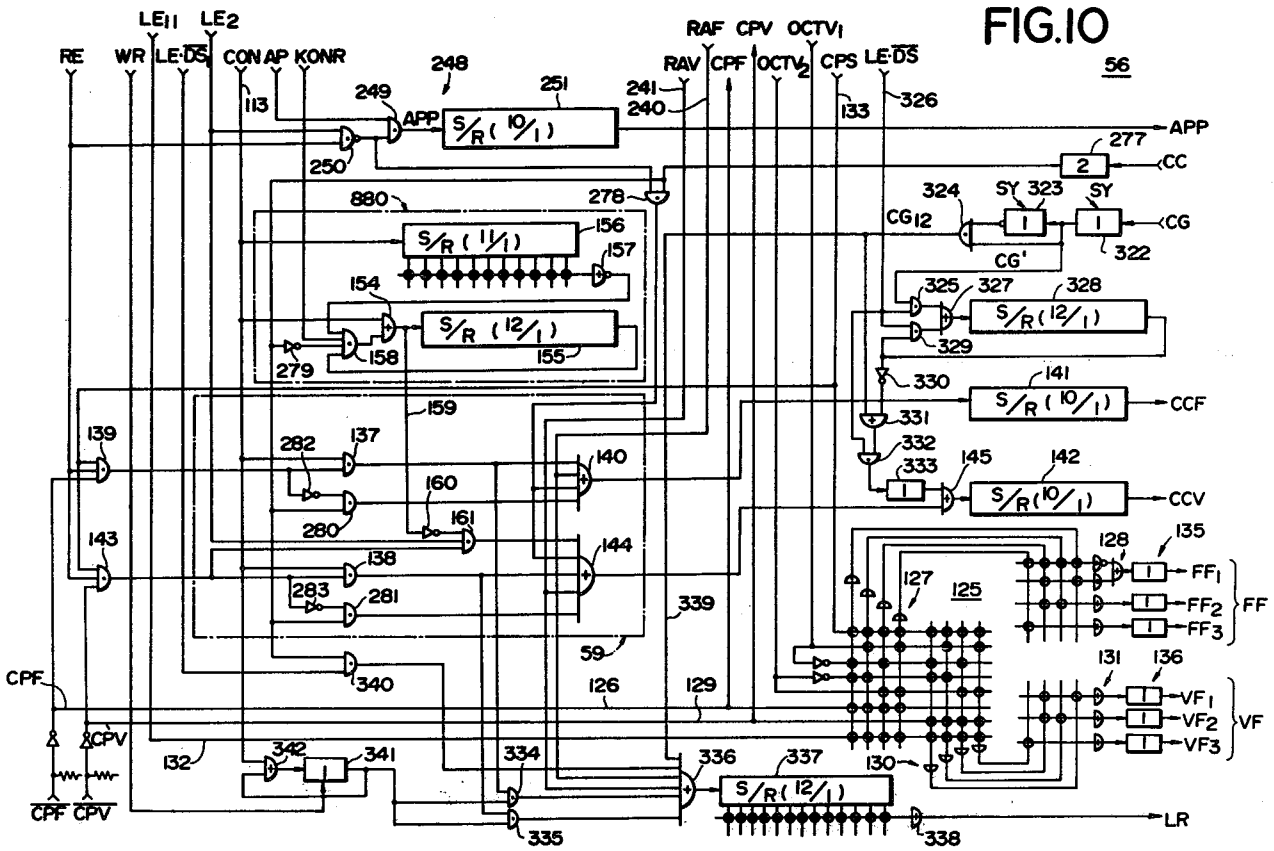
FIG. 10 is a circuit diagram showing a circuit portion 56 in detail.

The circuit portion 56 generates the harmonics synthesizing system clear pulse CCF or the filter system clear pulse CCV on the basis of the coincidence signal CON in the regular mode and in response to the signal RAF or RAV for instructing a timing of tone production of the chord pyramid tone in the musical tone forming system 10 or 11. The circuit portion 56 also generates an octave change instruction signal FF for the harmonics synthesizing system or an octave change instructing signal VF for the filter system on the basis of the octave change designation signal OCTV. If the chord pyramid performance is desired in the musical tone forming system 10 of the harmonics synthesizing system, a chord pyramid selection switch 57 is closed to turn a chord pyramid selection signal $\overline{CPF}$ for the harmonics synthesizing system to "0" (CPF="1"). If the chord pyramid performance is desired in the musical tone forming system 11 of the filter system, a selection switch 58 is closed to turn a chord pyramid selection signal $\overline{CPV}$ for the filter system to "0" (CPV="1"). Since the musical tone forming systems 10 and 11 respectively generate musical tones having tone colors and amplitude envelope characteristics which are different from each other, chord pyramid tones of mutually different tonal qualities can be obtained by adopting the above described arrangement according to which the chord pyramid performance can be selected in either of the two systems. The clear pulses CCF and CCV are supplied through a tone production control circuit 59. Details of the circuit portion 56 are shown in FIG. 10.

Figure 11:
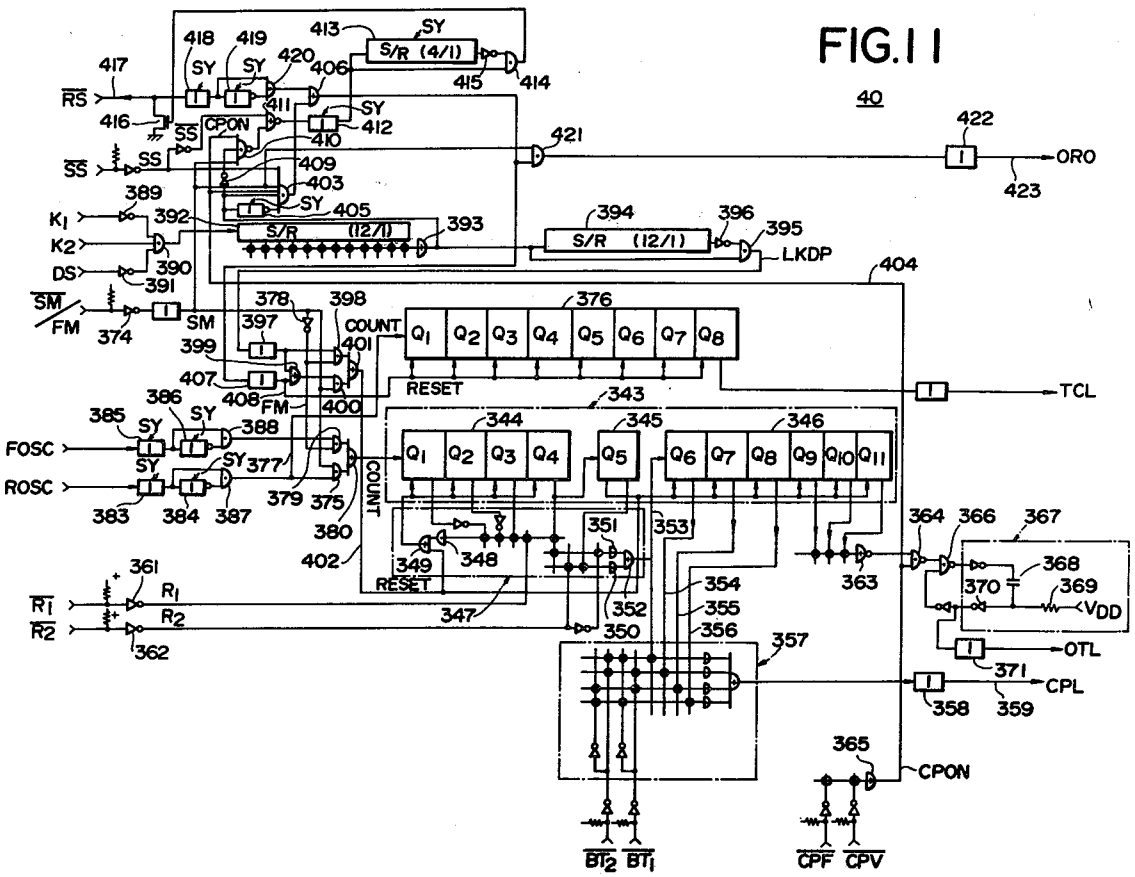
FIG. 11 is a circuit diagram showing a timing signal generation circuit portion in detail.

The timing signal generation circuit 40 is capable of variably adjusting the rate of the chord pyramid basic tempo clock pulse CPL. The circuit 40 generates also signals for synchronizing the operation of the chord pyramid device with the other automatic performance apparatuses 36 and 37, the reset pulse $\overline{RS}$ and the basic tempo clock pulse TCL. Details of the timing signal generation circuit 40 are shown in FIG. 11.

Figure 12:
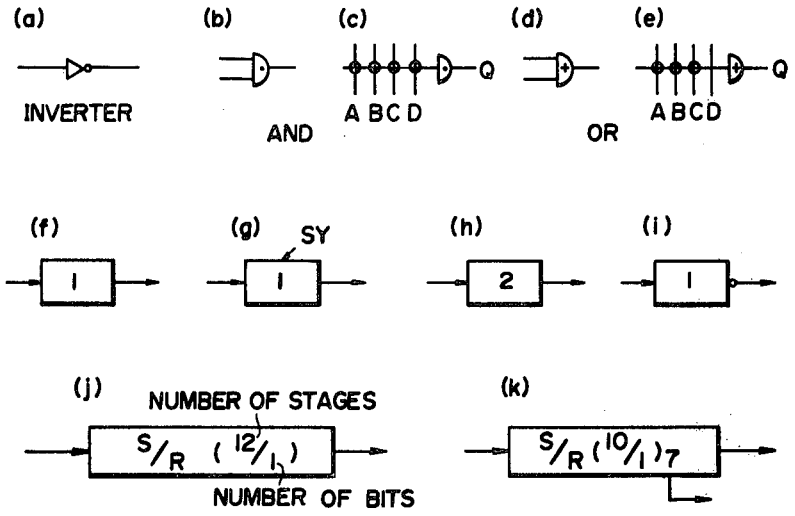
FIGS. 12(*a*) through 12(*k*) are diagrams for explaining logical circuit elements, delay flip-flop and a shift register.

Before entering into detailed description with reference to FIGS. 7 through 11, explanation will be made with reference to FIG. 12 about symbols used in FIG. 7 and the subsequent figures for expressing circuit elements. FIG. 12(*a*) designates an inverter, FIGS. 12(*b*) and 12(*c*) AND gates and FIGS. 12(*d*) and 12(*e*) OR gates respectively. If input lines to the AND and OR gates are few, the symbols of FIGS. 12(*b*) and 12(*d*) are used, whereas if there are many input lines or if signals are inputted on some of many signal lines, the symbols shown in FIGS. 12(*c*) and 12(*e*) are employed. In FIGS. 12(*c*) and 12(*e*), a single input line is drawn on an input side of the AND or OR gate, a plurality of signal lines are drawn in such a manner that they cross the input line and crossing points of the input line and signal lines through which signals are supplied to the AND or OR gate are marked by small circles. Accordingly, a logical formula in the example shown in FIG. 12(*c*) is Q=A·B·D and that in the example shown in FIG. 12(*e*) is Q=A+B+C. FIGS. 12(*f*), 12(*g*) and 12(*h*) show delay shift register for delaying 1 bit signals (i.e. delay flip-flops). Numerals (e.g. "1" or "2") in the blocks in FIGS. 12(*f*) through 12(*h*) represent delay stages. In FIG. 12(*f*), there is no illustration of a shift clock. In such a case, the shift register is shifted by the main clock pulse $\phi_1$ (in practice, a two-phase clock is used). For example shift of "1" stage in such a case means delay of 1 μs. In a case where a signal SY is illustrated as a shift clock as in FIG. 12(*g*), the shift register is shifted by two-phase clocks $SY_1$, $SY_7$ supplied from a shift registers 60 shown in FIG. 7 at a period of 12 μs. In such a case, shift of "1" stage means delay of 12 μs. A small circle shown on the output side of a circuit as in FIG. 12(*i*) represents that a logical value of a delay signal is inverted. FIG. 12(*j*) represents a shift register of multiple stages. A numeral of denominator (e.g. 1) in a fraction "S/R (12/1)" represents a bit number and a numeral of numerator (e.g. 12) a stage number. If there is no illustration of a shift clock, the multi-stage shift register is shifted by the main clock $\phi_1$ (1 μs). If the shift clock SY is shown, the shift register is shifted by two phase clocks $SY_1$, $SY_7$ (12 μs). In FIG. 12(*k*), there appears a numeral in a block from which numeral an output line is drawn. This means that an output is delivered out of a stage designated by the numeral. In the case of the example of FIG. 12(*k*), an output is delivered out of the seventh stage of a 10-stage 1-bit (10/1) shift register (S/R).

In this embodiment in which signals of the respective channels are processed in a time sharing fashion, timing of signals for the same channel should be synchronized in processing of the signals through various delay elements. To this end, shift registers as shown in FIGS. 12(*f*) through 12(*i*) are used in many places in the circuits shown in FIGS. 7 through 11. Accordingly, as for shift registers provided simply for the purpose of synchronizing timing of singals, a description by referring to reference numerals will be omitted and these shift registers will be simply illustrated in the manner shown in FIGS. 12(*f*) through 12(*i*).

DETECTION OF DEPRESSED KEYS ON A CHORD PYRAMID KEYBOARD

The key codes KC for keys which are being depressed or which have been released with tones thereof being decaying are repeatedly outputted from the tone production assignment circuit 15 in synchronization with their respective channel times. The note code $N_1$–$N_4$ and the octave code $B_1$–$B_3$ in the key code KC are supplied to the coincidence detection circuit 43 through a flip-flop group 61 in FIG. 7. The coincidence detection circuit 43 receives as its other input a counting output of the chord pyramid counter 42 consisting of a 7-bit up-down counter (modulo $2''=128$). The counter 42 is advanced by one step every 12 μs will be described later and contents thereof do not change during the 12 μs period in which all of the channel times complete one cycle of circulation. When contents of the key code $N_1$–$B_3$ coincide with those of the counter 42, a coincidence signal COIN is delivered out of the coincidence detection circuit 43 during the time width 1 μs of the particular key code. This coincidence signal COIN is delivered regardless of the kind of the keyboard and a coincidence signal COIN corresponding to a desired keyboard is selected by an AND gate 62. In the present embodiment, the chord pyramid performance is conducted with the lower keyboard and, accordingly, a signal representing key depression on the lower keyboard is supplied on another input line 63 of the AND gate 62. More specifically, an AND gates 64 delivers a lower keyboard detection signals LE upon detecting that the contents of the keyboard code $K_1$, $K_2$ in the key code KC are those for the lower keyboard (i.e.. $K_2$="1", $K_1$="0") and this signal LE is applied to a shift register 65. In the meanwhile, the decay start signal DS is inverted by an inverter 66 and thereafter is applied to an AND gate 68 through a delay flip-flop 67. When the inverted output of the inverter 66 is "1", it signifies that the key is being depressed. Thus, the AND gate 68 which receives as its other input the lower keyboard detection signal LE having been delayed by one stage by the shift register 65 outputs a signal "1" if a key on the lower keyboard is being depressed. This signal "1" from the AND gate 68 is supplied to the AND gate 62 through a line 63. Accordingly, if at this time the key code $N_1$–$B_3$ of the key on the lower keyboard coincides with the contents of the counter 42, the AND gate 62 passes the coincidence signal COIN to an AND gate 69.

The AND gate 69 is enabled only at a predetermined tone production timing by a gate signal provided through a line 70. Accordingly, the coincidence signal COIN selected by the AND gate 69 corresponds to the specific tone production timing. The gate signal provided through the line 70 is generated by a chord pyramid system control unit 71 which is provided mainly for controlling the counting-scanning operation of the chord pyramid counter 42. The AND gate 69 is enabled by the gate signal on the line 70 during the counting-scanning operation of the counter 42 as will be described more in detail later.

A lower keyboard key depression signal LE·DS from the AND gate 68 is applied to a shift register 72, OR gate 73, AND gate 74 and a chord pyramid performance start-stop control unit 75 shown in FIG. 8. This signal $LE\cdot\overline{DS}$ represents that a key for the chord pyramid performance is being depressed.

In FIG. 8, an OR gate 76 which receives outputs of all stages of the shift register 72 delivers out a signal "1" in a DC manner if any one of the keys on the lower keyboard for the chord performance is being depressed (more precisely, if any channel is assigned with tone production). If no key is being depressed on the lower keyboard at all, the output of the OR gate 76 is a signal "0" and the output of an inverter 77 is "1".

Assume now that the chord pyramid performance has been commenced (i.e. production of tones of notes constituting a chord has been commenced) and a lower keyboard key depression signal $LE\cdot\overline{DS}$ concerning an initially depressed key or an initially assigned key among a plurality of depressed keys has been applied to the shift register 72. Since there was no key depressed on the lower keyboard, signals of all delayed output stages of the shift register 72 were "0" before the application of the initial lower keyboard key depression signal $LE\cdot\overline{DS}$. Accordingly, the output of the AND gate 74 becomes "1" only during 1 μs during which the initial signal $LE\cdot\overline{DS}$ is applied to the shift register 72. This output "1" of the AND gate 74 sets a flip-flop FL consisting of NOR gates 78 and 79. When the signal "1" concerning the initial lower keyboard key depression signal $LE\cdot\overline{DS}$ has been shifted to a final stage of the shift register 72 upon lapse of 12 μs, flip-flop FL are reset by a signal "1" appearing on an output line 80 leading from the final stage of the shift register 72. Accordingly, a key depression initial pulse LKDP which is an output of these flip-flops (i.e. output of the NOR gate 79) is "1" only during the 12 μs period of the initial key depression in the chord pyramid performance.

The OR gate 73 receives the output of the OR gate 76 and the signal $LE\cdot\overline{DS}$ and outputs a key depression indication signal LKD, which is a signal "1" in a DC manner while a key is being depressed on the lower keyboard.

As the key depression indication signal LKD (="1") is outputted by the OR gate 73, a waiting time counter 81 in the waiting time setting circuit 46 which has been in a reset state is released from the reset state for setting a waiting time. Upon lapse of this waiting time, a waiting time setting reset signal WR becomes "0" whereby resetting state produced by this signal WR ceases. Detailed description about the waiting time setting circuit 46 will be made later. Let it be assumed now that the waiting time has been properly set and the reset signal WR has fallen to "0" upon the lapse of this waiting time.

"Regular mode"

Description will be made first about the chord pyramid performance in the regular mode. In commencing the performance in the regular mode, the selection switch 48 (FIG. 6) is closed and the regular mode selection signal DE "is thereby turned to "1".

START OF PERFORMANCE

When a cord pyramid performance start-stop control unit 75 has received the key depression initial pulse LKDP while the regular mode selection signal RE is "1", the output of a NOR gate 83 falls to "0" during 12 μs via an AND gate 82 in synchronism with the key depression initial pulse LKDP. This signal "0" with a pulse width of 12 μs is hereinafter referred to as a key depression initial reset signal KONR. This signal KONR is used for resetting contents of all of the 12 channels of counters in the chord pyramid device 12. Each of these counters in the chord pyramid device 12 comprises a 12-stage shift register and an adder and is capable of counting operation for the respective channels in time sharing. These counters include the tempo clock frequency dividing circuit 45 consisting of a 12-stage 3-bit shift register 84, an adder 85 and an AND gate 86, and an octave memory counting circuit 520 and an up-down control memory 87 shown in FIG. 9. The reset signal KONR is supplied also to a filter system clear signal generation control circuit 880 shown in FIG. 10.

The chord pyramid performance start-stop control unit 75 receives the chord pyramid basic tempo clock pulse CPL from the timing signal generation circuit 40 (FIG. 11). A differentiation circuit consisting of a delay flip-flops 88 and 89 and an AND gate 90 rectifies the rise portion of the pulse CPL to a pulse of a pulse width of 12 μs. More specifically, the waveform of the rise portion of the pulse CPL is delayed by the first delay flip-flop 88 and thereafter outputted therefrom at a timing of the signal SY (i.e. signals $SY_1$, $SY_7$ synchronized with given channel times). The outputted signal is applied to the AND gate 90. Since the inverted output of the next-stage delay flip-flop 89 is still "1", the AND gate 90 is enabled. When the waveform of the rise portion delayed by the delay flip-flop 89 by 12 μs is inverted and outputted and the input of the AND gate 90 thereby becomes "0", the output of the AND gate 90 falls to "0". Accordingly, a pulse of 12 μs width which is synchronized with all of the channel times is obtained at the rise portion of the pulse CPL. Frequency of this pulse of 12 μs width is entirely the same as the basic tempo clock pulse CPL.

When the regular mode selection signal RE, the lower keyboard key depression indication signal LKD and a chord pyramid selection signal CPON provided through an OR gate 92 in accordance with closing of the chord pyramid selection switches 57 and or 58 are all "1", the basic tempo clock pulse CPL whose waveform has been rectified to the waveform of 12 μs pulse width is selected by an AND gate 91 and thereafter is applied to a counting input of the adder 85 of the frequency dividing circuit 45 through an OR gate 93. Although the 12-stage shift register 84 is capable of conducting counting for each individual channel in a time sharing manner, contents of counting in the regular mode are the same throughout all the channels because the counting pulse is given with the pulse width of 12 μs. In the present embodiment, the frequency dividing circuit 45 is capable of effecting $\frac{1}{8}$ frequency dividing. A carry signal having a pulse width of 12 μs provided on a line 94 when the most significant bit of a 3-bit half adder 85 overflows constitutes the tone production timing pulse TEP. Accordingly, the tone production timing pulse TEP is a pulse with a 12 μs width obtained by frequency dividing the basic tempo clock pulse CPL into $\frac{1}{8}$.

The period of generation of this tone production timing pulse TEP corresponds to the tone production interval T(FIG. 1) between the respective tones produced in the chord pyramid performance in the regular mode. Accordingly, the tone production timing pulse TEP is produced substantially upon the lapse of time T from the time when a key on the lower keyboard is initially depressed and the basic tempo clock pulse CPL having the pulse width of 12 μs can be selected by the AND gate 91.

According to the invention, arrangement are made such that the tone production timing of a tone which is first produced after the start of the chord pyramid performance depends not on the tone production timing pulse TEP but on a falling time of the waiting time setting reset signal WR. If production of the first tone was made upon receipt of the first timing pulse TEP, an appreciable time delay would be produced between the key depression and the production of the first tone. In the device according to the invention, the first chord pyramid tone is produced immediately upon the lapse of the waiting time so as to increase responsibility between the key depression and the start of tone production and thereby improve the performance efficiency.

When the waiting time set by the waiting time setting circuit 46 (FIG. 8) has elapsed, the waiting time setting reset signal WR falls from "1" to "0". When this reset signal WR is "1", it resets the chord pyramid counter 42 (FIG. 7), a coincidence code memory circuit 95 and delay flip-flops 96, 97 and 98 thereby causing the chord pyramid device 12 to prepare for starting the chord pyramid performance. In the circuit shown in FIG. 7, when the waiting time setting reset signal WR falls from "1" to "0" (FIG. 13(*a*)), a negative differentiation circuit consisting of a delay flip-flop 99, AND gate 100 and an inverter 101 in the chord pyramid system control unit 71 produces a differentiated pulse having a pulse width of 1 μs in synchronism with the fall portion of the signal WR. Thus, the AND gate 100 outputs a start pulse STAT (="1") having a pulse width of 1 μs (FIG. 13(*b*)). In the chord pyramid system control unit 71, the delay flip-flop 97 is provided for controlling scanning-counting operation of the chord pyramid counter 42, the delay flip-flop 96 for securing time required for processing the carry signal from the counter 42 and the delay flip-flop 98 for preventing double production of the same tone at the turning point in the turn mode. Further, the waiting time setting reset signal WR disenables an AND gate 212 through a NOR circuit 213 (FIG. 9) thereby changing the contents of the up-down control memory 87 to "0" and bringing the counters 42 and 52 into an upcounting mode.

PRODUCTION OF THE FIRST TONE (PART I)

Referring to a column of 1T (time section) in FIG. 13, production of the first tone will now be described.

When the start pulse STAT has become "1", an output $H_2$ of the delay flip-flop 97 is "0" (because the delay flip-flop 97 has been reset by the reset signal WR) and an inverted signal $\overline{H}_2$ of the signal $H_2$ therefore is "1". Accordingly, an AND gate 102 produces an output "1" which is loaded in the delay flip-flop 97 via an OR gate 103. An AND gate 104 is provided for circulating the contents of the flip-flop 97. The AND gate 104 causes the flip-flop 97 to circulatingly store a logical value "1" of the output $H_2$ thereof (FIG. 13(*c*)) under conditions that (1) A carry signal CRAY is not being produced by a carry detection circuit 105 of the counter 42(i.e. the output of an inverter 106 is "1") and: (2) The coincidence signal CON is not being produced through the AND gate 69(i.e. the output of an inverter 107 is "1").

As the output $H_2$ of the flip-flop 97 becomes "1", the chord pyramid counter 42 becomes capable of scanning and counting. More specifically, an AND gate 108 of the chord pyramid system control unit 71 outputs, upon receipt of the system clock pulse $SY_1$ (FIG. 13(*d*)), a count pulse $J_1$(FIG. 13(*e*)) which is in synchronism with the system clock pulse $SY_1$ under conditions that (1) the output signal $H_2$ of the flip-flop 97 is "1" and (2) the coincidence signal CON is not being produced (i.e. the output of the inverter 107 is "1"). This count pulse $J_1$ is supplied to a count input terminal of the chord pyramid counter 42 via an OR gate 109. The system clock pulse $SY_1$ is outputted from the shift register 60 at a period of 12 μs and in synchronisation with its associated channel time. Accordingly, for a duration of time until the coincidence signal CON is produced within a period during which the output $H_2$ of the counting operation control delay flip-flop 97 is "1", the counter 42 is caused to advance its count by one step every 12 μs by the count pulse $J_1$.

Since the contents of the up-down control memory 87(FIG. 9) is initially "0", an up-counting signal U is "1" whereas a down-counting signal D is "0" so that the counting mode of the chord pyramid counter 42 starts from upcounting. Accordingly, the count of the chord pyramid counter 42 increases from O upwardly. The contents of the counter 42 is compared with the key code $N_1$–$B_3$ in the coincidence detection circuit 43. During 12 μs, key codes $N_1$–$B_3$ for all of the 12 channels appear in a time sharing manner, whereas the contents of the counter 42 remain unchanged. Accordingly, the contents of the counter 42 are compared with all of the key codes $N_1$–$B_3$ assigned to the respective channels each time the contents of the counter 42 advance by one step, the comparison thus being repeated.

As will be apparent from Table 1, the value of the key code consisting of the not code $N_1$–$N_4$ and the octave code $B_1$–$B_3$ increases in the order of the tone pitch (In the Table, the bit $N_1$ constitutes the least significant bit and the bit $B_3$ the most significant bit). In other words, a key code for a key of a low tone pitch is of a small value whereas a key code for a key of a high tone pitch is of a large value. Accordingly, when the contents of the upcounting counter 42 coincide with a value of a key code for the lowest note among the key codes $N_1$–$B_3$ assigned to the respective channels, a first coincidence detection signal COIN is produced by the coincidence detection circuit 43(FIG. 13(*h*)). If this coincidence signal COIN is one for the lower keyboard, the signal is applied to the AND gate 69 through the AND gate 62, as has previously been described. At this time, the output $H_2$ of the flip-flop 97 representing that the counter 42 is performing counting is provided on the gate line 70 of the AND gate 69 via an OR gate 110. Accordingly, if the coincidence detection signal COIN (associated with the lower keyboard) is produced during the scanning-counting operation of the chord pyramid counter 42, the AND gate 69 outputs the coincidence signal CON("1") as shown in FIG. 13 (*i*).

The output of the inverter 107 becomes "0" by the coincidence signal CON which is "1" and the AND gate 104 provided for the circulation purpose is thereby disenabled. The output $H_2$ of the flip-flop 97 therefore becomes "0" 1 μs later. This stops the scanning-counting operation of the counter 42 and disenables the AND gate 69. Consequently, only one shot of the coincidence signal CON is produced in synchronism with a channel time to which the key code $N_1$–$B_3$ coinciding with the contents of the counter 42 is assigned.

Assume, for example, that three key of notes $D_3$, $G_3$ and $B_3$ on the lower keyboard have been depressed almost simultaneously as shown in FIGS. 1(*a*) and 1(*b*). A first coincidence signal CON is produced in accordance with the key code for the note $D_3$ which is the lowest one of the three notes. The following description will be made on the assumption that these three keys are having depressed.

A signal "0" outputted from the inverter 107 when the coincidence signal CON has become "1" is applied to a NOR gate 151 which has a single input. Accordingly, the NOR gate 151 produces an output "1" in synchronism with the coincidence signal CON. This output "1" of the NOR gate 151 constitutes a load instruction signal LOAD 2 (FIG. 13(*j*)) for the coincidence code memory circuit 95. As the load instruction signal LOAD 2 is applied to the coincidence code memory circuit 95, the counting contents at that time of the chord pyramid counter 42 are loaded in the coincidence code memory circuit 95 and stored therein. Accordingly, count data which is the same contents as the key code $N_1$–$B_3$ in accordance with which the coincidence signal CON has been produced is stored in the coincidence code memory circuit 95. As for the note $D_3$, data "0100001" which is the same as the key code ($B_3$, $B_2$, $B_1$, $N_4$, $N_3$, $N_2$, $N_1$) is stored in the memory circuit 95.

The coincidence signal CON is supplied from the AND gate 69 to a delay flip-flop 111 (FIG. 9) provided for synchronizing purpose and is gated out of an AND gate 112 on a condition that the regular mode selection signal RE is "1". The regular mode selection signal RE is supplied to the circuit shown in FIG. 9, through a line 114 (FIG. 8). The coincidence signal CON which has been delayed by 1 μs is supplied on the line 113 from the AND gate 112 and thereby enables AND gates 115 and 116 of an octave memory counting circuit 520. The signal CON is supplied also to the circuit shown in FIG. 10 through a line 113. The AND gates 115 and 116 receive bit outputs $Q_1$, $Q_2$ of the octave counter 52(FIG. 9). Since the counter 52 has now been reset by the waiting time setting reset signal WR supplied through an OR gate 117 and an AND gate 118, the counting outputs $Q_1$, $Q_2$ are "00". The fact that the contents of the octave counter 52 are 0 indicates that tone production should be made in the octave range in which the key depression has been made.

The octave memory counting circuit 520 includes a half adder 119 and a full adder 120. These adders, however, are used for the counting operation in the randum mode. In the regular mode, the circuit 520 is used simply as a memory comprising a 12-stage 2-bit circulating shift register including 2-stage shift registers 121, 122 and 10-stage shift registers 123, 124 and storing the counting contents of the octave counter 52 with respect to each of the channels (through the contents are the same throughout all of the channels). The contents of the octave counter 52 loaded in the octave memory counting circuit 520 by the coincidence signal CON are delivered out of the seventh output stages of the shift registers 123 and 124 and supplied as octave instruction signals $OCTV_1$ and $OCTV_2$ to an octave encoder 125 shown in FIG. 10.

AND gates 146 and 147 in FIG. 9 are circuits for circulating the stored contents of the shift registers 121, 123 and 122, 124. If the coincidence signal CON has been produced, the counting contents of the octave counter 52 are loaded in the octave memory counting circuit 520 through the AND gates 115 and 116 thereby rewriting the stored contents of the circuit 520, whereas if the coincidence signal CON has not been produced, the stored contents of the circuit 520 are held by an output "1" ($\overline{CON}$) of an inverter 148 through AND gate 146 and 147.

As described in the foregoing, the first coincidence signal CON produced by the circuit in FIG. 7 is supplied to the circuit in FIG. 10 through the circuit in FIG. 9 to generate the clear signals CCF and CCV required for production of the chord pyramid tones and rewrite values of the octave change designation signals $FF(FF_1-FF_3)$ and $VF(VF_1-VF_3)$ in accordance with the contents of the octave counter 52.

GENERATION OF THE OCTAVE DESIGNATION SIGNAL

In the octave encoder 125 shown in FIG. 10, the octave instruction signals $OCTV_1$ and $OCTV_2$ provided by the octave memory counting circuit 520 are encoded as shown in the following Table 3. In table 3, octave slide amount O represents an octave range in which the key depression has been made. Octave slide amount 1, 2 or 3 indicates respectively an octave range which is one octave, two octaves or three octaves higher than the octave range in which the key has been depressed.

Table 3

| Input | | Output | | | | | | |
|---|---|---|---|---|---|---|---|---|
| | | Harmonics synthesizing system | | | Filter system | | | Octave slide amount |
| $OCTV_2$ | $OCTV_1$ | $FF_3$ | $FF_2$ | $FF_1$ | $VF_3$ | $VF_2$ | $VF_1$ | |
| 0 | 0 | 0 | 0 | 1 | 0 | 0 | 1 | 0 |
| 0 | 1 | 0 | 1 | 0 | 0 | 1 | 0 | 1 |
| 1 | 0 | 0 | 1 | 1 | 0 | 1 | 1 | 2 |
| 1 | 1 | 1 | 0 | 0 | 1 | 0 | 0 | 3 |

The octave change designation signal $FF_1-FF_3$ of the harmonics synthesizing system is generated in an encoder consisting of an AND gate group 127 and an OR gate group 128 in accordance with the contents of the octave instruction signals $OCTV_1$ and $OCTV_2$ under conditions that the harmonics synthesizing system chord pyramid selection switch 57 (FIG. 6) is closed and therefore the selection signal CPF on a line 126 is "1". The octave change designation signal $VF_1-VF_3$ for the filter system is generated in an encoder consisting of an AND gate group 130 and an OR gate group 131 in accordance with the contents of the signals $OCTV_1$ and $OCTV_2$ under a condition that the filter system chord pyramid selection switch 58(FIG. 6) is closed and therefore the selection signal CPV on a line 129 is "1".

For the purpose or producing the octave change designation signals FF and VF only during the tones of the lower keyboard keys for the chord pyramid performance, a lower keyboard detection signal $LE_{11}$ which has been delayed by 11 μs in the shift register 65 in FIG. 7 is applied to a condition of the encoder 125 through a line 132. The chord pyramid start-stop signal CPS applied to the encoder 125 through 125 through a line 133 is signal "0" when the chord pyramid performance is stopped by operation of a foot switch 134 (FIG. 6) and a signal "1" when the chord pyramid performance is not stopped.

There is a delay of 12 μs between the time when the key code coincidence of which was detected by the coincidence detection circuit 43 is applied to the chord pyramid device 12 and the time when the octave change designation signals $FF_1-FF_3$, $VF_1-VF_3$ concerning the key code are outputted. The 12 μs delay time consists of 2 μs by the delay flip-flops 61 and 111, 9 μs by the seventh stages of the shift registers 121, 122 and 123, 124 and 1 μs by the delay flip-flop groups 135 and 136 provided on the output side of the octave encoder 125. For the same reason, the lower keyboard detection signal LE has been delayed by 11 μs by the shift register 65 to form the signal $LE_{11}$.

As has previously been described, the octave instruction signals $OCTV_1$ and $OCTV_2$ are "00" in the case of the first tone. The octave change designation signals FF and/or VF are therefore "1" only in the bits $FF_1$ and/or $VF_1$ so that tone production in an octave range in which the key depression has been made is instructed.

GENERATION OF CLEAR SIGNALS CCP AND CCV

The coincidence signal CON of a 1 μs width delivered through the line 113 is applied to AND gate 137 and 138 in FIG. 10. In the chord pyramid performance of the harmonics synthesizing system, the AND gate 137 is enabled by an output "1" of an AND gate 139 when the signal CPF, the regular mode selection signal RE and the chord pyramid start-stop signal CPS from the line 133 are all "1". The coincidence signal CON therefore is gated out of the AND gate 137 and applied to 10-stage shift register 141 through an OR gate 140. The coincidence signal CON outputted from the shift register 141 constitutes the harmonics synthesizing system clear signal CCF.

In the same manner as in the generation of the octave change designation signals FF and VF, the clear signal CCF (and/or CCV) is produced 12 μs after the time when the key code $N_1-B_3$ coincidence of which has been detected is applied to the chord pyramid device 12. The delay time consists of 2 μs by the flip-flops 61 and 111, and 10 μs by the shift register 141(or 142). Accordingly, the key code KC, octave change designation signals FF, VF and the clear signals CCF, CCV are completely synchronized with one another in their channel times.

In the chord pyramid performance of the filter system, an output of an AND gate 143 becomes "1" on conditions that the filter system chord pyramid selection signal CPV, the regular mode selection signal RE and the chord pyramid start-stop signal CPS are all "1". An AND gate 138 is enabled by this output "1" of the AND gate 143. Accordingly, the coincidence signal CON delivered through the line 113 is delivered out of the shift register 142 via the AND gate 138, an OR gate 144 and an OR gate 145. This output of the shift register 142 constitutes the filter system clear signal CCV.

PRODUCTION OF THE FIRST TONE (PART II)

Figure 14:
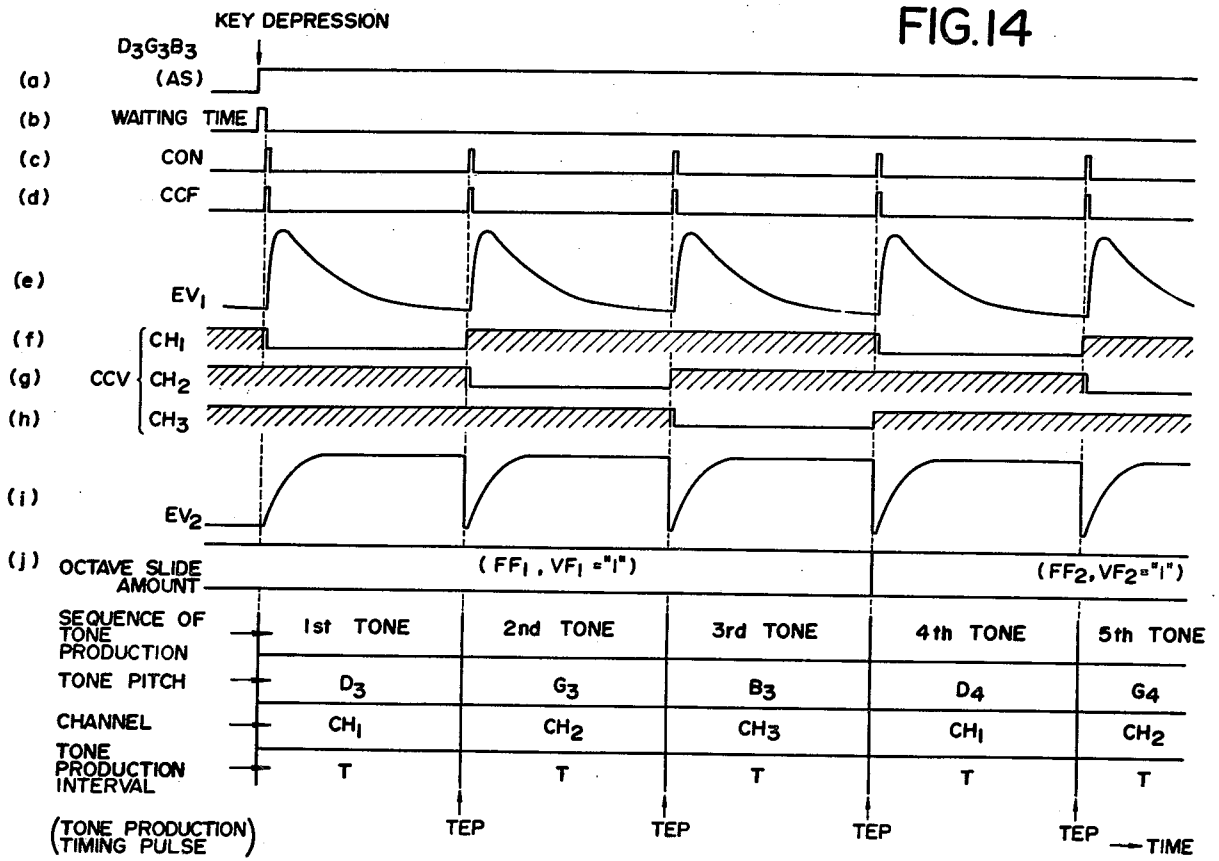
FIGS. 14(*a*) through 14(*j*) are a time chart for explaining, macroscopically in relation to the circuits shown in FIGS. 7–10, an operation for producing an envelope signal in response to a coincidence signal and generating chord pyramid tones one by one.

FIG. 14 illustrates a tone production timing of the respective tones in the chord pyramid performance. For convenience of illustration, minute time relations such as 1 μs or 12 μs are not precisely shown. Further, a period of time during which the chord pyramid counter 42 conducts the scanning-counting operation is not particularly shown. In FIG. 14, tone production for the keys of the notes $D_3$, $G_3$ and $B_3$, for example, have been assigned to the first channel $CH_1$, the second channel $CH_2$ and the third channel $CH_3$ respectively. In the timing chart of FIG. 14, times of the tone production channels $CH_1$, $CH_2$ and $CH_3$ only are extracted and shown in the time regions designated as $CH_1$, $CH_2$ and $CH_3$ (except for FIGS. 14(*f*), 14(*g*) and 14(*h*)). In FIGS. 14(*f*), 14(*g*) and 14(*h*), each of time periods of the tone production channels $CH_1$, $CH_2$ and $CH_3$ is independently shown.

FIG. 14(*a*) shows generation of the attack start signal AS in the respective tone production assignment channels upon depression of the keys for $D_3$, $G_3$ and $B_3$ on the lower keyboard almost simultaneously (in the waiting time at the latest). FIG. 14(*b*) shows that the waiting time is set in the waiting time setting circuit 46(FIG. 8) for a predetermined period of time from detection of the first key depression. Keys depressed within this waiting time are treated as being depressed simultaneously.

As will be apparent from the foregoing description, a tone of the lowest note among the depressed keys, i.e. the one of the note $D_3$ in the present embodiment, is produced as the first tone. Accordingly, in accordance with the first coincidence signal CON(FIG. 14(*c*)), one shot of each of the harmonics synthesizing system clear signal CCF (FIG. 14(*d*)) and the filter system clear signal CCV(FIG. 14(*f*)) having a pulse width of 1 μs is produced in synchronization with the channel time of the channel $CH_1$ to which production of the $D_3$ tone has been assigned.

In a macroscopic illustration such as FIG. 14, the period of time during which the chord pyramid counter 42 conducts the scanning-counting operation may be deemed to be the same as the position of the coincidence signal CON shown in a somewhat exagerated from in FIG. 14(*c*). In other words, this period is such a short period of time that it is hardly distinguishable from the position of the signal CON as viewed macroscopically.

In the envelope generation circuit 28(FIG. 3) of the musical tone forming system 10 which receives the harmonics synthesizing system clear signal CCF, the envelope counter 30 is shared commonly for all of the channels in a time sharing manner. When the clear signal CCF is applied, counting contents at that channel (i.e. the first channel $CH_1$) are cleared to 0. Accordingly, when the clear signal CCF falls (more exactly, when the clear signal CCf becomes "0" at the same channel time upon the lapse of 12 μs from the channel time at which the clear signal CCF has become a signal "1" having a pulse width of 1 μs), the envelope counter 30 starts counting from "0" and an envelope signal $EV_1$ of a percussive type waveform as shown in FIG. 5(*a*) is generated by the envelope generation circuit 28 during that channel time ($CH_1$) (see the time region of $CH_1$ in FIG. 14(*e*)). Consequently, the $D_3$ tone assigned to that channel is produced from the musical tone forming system 10 with rising of the percussive type envelope signal $EV_1$ and decays with a decay of the envelope signal $EV_1$.

In the filter system musical tone forming system 11 which generates a sustained tones as has previously been described, the clear signal CCV must constantly be provided to maintain the envelope generation circuit 27(FIG. 3) of the respective channels in a cleared state when the system 11 does not produce a tone. For this reason, the clear signal CCV for the filter system is illustrated individually for each of the channels in FIGS. 14(*f*), 14(*g*) and 14(*h*). In the case of the first tone, reference has only to be made to FIG. 14(F) because the first tone has been assigned to the first channel $CH_1$. The shaded portion of signal "1" in FIGS. (14(*f*), 14(*g*) and 14(*h*) shows the clear signal supplied by a filter system clear signal generation control circuit 880 (FIG. 10) when a tone is not produced. The clear signal CCV having a pulse width of 1 μs provided in response to the coincidence signal CON for the tone production is the unshaded portion of signal "1" in FIGS. 14(*f*), 14(*g*) and 14(*h*).

The envelope generation circuit 27 for the filter system (FIG. 3) is provided individually for each of the channels in correspondence to a VCF 25 and a VCA 26 provided for each of the channels in parallel for processing signals which are static and not time shared. The clear signal CCV generated in accordance with the coincidence signal CON is supplied to the musical tone forming system 11 and applied to the envelope generation circuit 27 corresponding to the specific channel ($CH_1$). An envelope counter in the envelope generation circuit 27 is cleared by the clear signal CCV and when the clear signal CCV has fallen to "0" 1 μs later (FIG. 14(*f*)), the envelope counter starts counting. Accordingly, an envelope signal $EV_2$ of a sustain type as shown in FIG. 5(*b*) is generated by the envelope generation circuit 27 (Refer to the time region $CH_1$ in FIG. 14(*i*)). Consequently, with the build-up of the envelope signal $EV_2$, the musical tone for $D_3$ assigned to the channel $CH_1$ is generated from the filter system musical tone forming system 11 and the generated tone is sustained until a next clear signal CCV is given to the channel $CH_1$.

As described in the foregoing, the octave slide amount in the case of the first tone is 0 (FIG. 14(*j*)). Accordingly, even if the octave change designation signals FF and FV are supplied to the footage change circuits 22 and 23 of the musical tone forming systems 10 and 11 at the same channel time as that of the clear signal CCF and CCV, the value of the output qF of the frequency counters 18 and 19 is not changed. The $D_3$ tone therefore is produced in the octave to which the depressed key belongs. As the octave change designation signals FF and FV, data corresponding to the octave instruction signals $OCTV_1$ and $OCTV_2$ stored in an octave memory counting circuit 520 (FIG. 9) is supplied to the footage change circuit 22 and 23 (FIG. 3) at each channel time at which the lower keyboard tones are assigned.

TONE PRODUCTION OF THE SECOND AND SUBSEQUENT TONES

Since the chord pyramid basic tempo clock CPL forms a basic tempo of a note which is perceptible to the human heating, it must be sufficiently longer than time required for the scanning-counting operation performed with a unit time of 12 μs in the chord pyramid counter 42. Accordingly, counting of the clock pulse CPL in the frequency dividing circuit 45 can be considered to start from a time point at which production of the first tone of the chord pyramid performance is started (i.e. a time point at which the first coincidence signal CON is produced). A carry signal therefore is provided on the line 94 (FIG. 8) upon the lapse of approximately the period T from the start of production of the first tone. This signal is applied to the AND gate 149 (FIG. 13(*k*)) of the chord pyramid system control unit 7 (FIG. 7) as the tone production timing pulse TEP with a pulse width of 12 μs. This timing pulse TEP is repeatedly produced every time period T which is of a period eight times as long as that of the clock pulse CPL.

The counting operation of the chord pyramid counter 42 as to the second and subsequent tones is started in response to the tone production timing pulse TEP and the chord pyramid tone is produced when the coincidence signal CON is generated. A timing chart for control of generation of the coincidence signal CON as to the second and third tones is shown in time regions 2T and 3T of FIG. 13.

In FIG. 7, a portion of 1 μs of the tone production timing pulse TEP having a pulse width of 12 μs is selected by the AND gate 149 in synchronism with the system clock pulse $SY_1$ of a 1 μs width and a 12 μs period. The tone production timing pulse $TEP_1$ (FIG. 13 (l)) thus having been made of a pulse width of 1 μs is applied to an AND gate 153 and an AND gate 152 of a single input through an AND gate 150. The other input of the AND gate 150 is normally "1" and the AND gate 150 is disenabled only when key depression is changed in the legato performance and a signal CHK thereby becomes "1" as well be described later.

Since the contents of the delay flip-flop 97 has become "0" when the coincidence signal CON for the first tone has been produced as was previously described, in signal $\overline{H_2}$ (a signal obtained by inverting the output $H_2$ of the flip-flop 97 by an inverter) which is applied to the AND gate 153 as another input thereof is "1". Under this condition, the tone production timing pulse $TEP_1$ with a pulse width of 1 μs is applied to the AND gate 153. A signal "1" therefore is applied to the flip-flop 97 via the AND gate 153 and the OR gate 103. Accordingly, the output signal $H_2$ of the flip=flop 97 becomes "1" 1 μs later and this signal "1" is circulatingly stored in the flip-flop 97 via the AND gate 104. By turning of the signal $H_2$ into "1", the counting operation of the chord pyramid counter 42 is resumed.

The counting operation of the chord pyramid counter 42 has been stopped and the same counting contents as the key code $N_1$–$B_3$ of the first tone ($D_3$ tone) have been held since the time point at which the coincidence signal CON for the first tone was produced. If the counting operation is resumed with this previous coinciding code being maintained and the AND gate 69 is opened, a coincidence signal CON which is the same as the previous coinciding code will be produced. In order to avoid occurrence of such inconvenience, the tone production timing pulse $TEP_1$ with a pulse width of 1 μs is used for forming a count pulse $J_2$ (FIG. 13(*f*)) via the input AND gate 152 and this count pulse $j_2$ (=$TEP_1$) is applied to the count input of the chord pyramid counter 42 via the OR gate 109. A timing at which the signal $H_2$ becomes "1" is delayed by 1 μs from the tone production timing pulse $TEP_1$ (the count pulse $J_2$) by virtue of the flip-flop 97. Accordingly, one shot of the count pulse $j_2$ is provided immediately before the counter 42 resumes counting by turning of the signal $H_2$ into "1" (i.e., the count pulse $J_1$ is provided via the AND gate 108 every 12 μs) whereby the contents of the chord pyramid counter 42 are advanced by one step from the previous coinciding code.

A coincidence detection operation for production of a next tone (second tone) is resumed from this state wherein the contents of the chord pyramid counter 42 are advanced by one step from the previous coinciding code.

When the counted value of the counter 42 has amounted by upcounting to a value which coincides with a key code for a depressed key ($G_3$) which is of a higher tone pitch than the previously produced tone ($D_3$), the coincidence signal CON of a 1 μs width is outputted in synchronism with the channel time to which the $G_3$ tone is assigned. In the same manner as has been described above, the counter 42 stops counting by turning of the signal $H_2$ to "0" and the coincidence load instruction signal $LOAD_2$ is applied to the coincidence code memory circuit 95 via a NOR circuit 51. Accordingly, the contents of the memory circuit 95 are rewritten to "0101000" which is the same data as the key code $B_3$, $B_2$, $B_1$, $N_4$, $N_3$, $N_2$, $N_1$ for the $G_3$ tone. The storage in the coincidence code memory circuit 95 is rewritten to new data (coinciding key code) each time the coincidence signal CON is produced.

When the coincidence signal CON has been generated, the harmonics synthesizing system clear signal CCF and the filter system clear signal CCV respectively of a 1 μs width are produced in synchronism with the channel time to which the key code causing generation of the coincidence signal CON is assigned, and the tone production is started in the particular channel of the musical tone forming systems 10 and 11. The octave change designation signal FF and VF remain unchanged unless the contents of the octave counter 52(FIG. 9) change.

As described in the foregoing, the counter 42 resumes counting each time the tone production timing pulse TEP is produced by the frequency dividing circuit 45(FIG. 8), i.e. at a period of the time interval T. In case the counter 42 is upcounting (U is "1"), the key code coincides with the contents of the counter 42 in the order starting from the lower tone, so that the coincidence signal CON concerning the second tone is produced in accordance with the key code for the $G_3$ tone and the coincidence signal CON concerning the third tone in accordance with the key code for the $B_3$ tone.

In upcounting of the chord pyramid counter 42, therefore, tone production is made one by one from the lower tone. If the counting mode is changed to downcounting, tone production is made from the higher tone downwardly. In both counting modes, the interval of tone production —is macroscopically the same as the period T of the tone production timing pulse TEP.

The coincidence code memory circuit 95 (FIG. 7) stores the same key code $N_1$–$B_3$ as the key code which has caused occurrence of the preceding coincidence signal CON. When, for example, the counter 42 performing the counting-scanning operation for detecting coincidence for production of the third tone, the key code for the $G_3$ tone which is coinciding tone (i.e. for the second tone) is stored in the coincidence code memory circuit 95. When the coincidence signal CON is produced upon coincidence of the key code for the $B_3$ tone and the $B_3$ tone is produced as the third tone, the key code $B_3$ is stored in the coincidence memory circuit 95. While the counter 42 is performing the counting-scanning operation for production of the fourth tone, the key code for the preceding tone, i.e. the $B_3$ tone, remains stored in the coincidence memory circuit 95.

Since musical tones produced by the harmonics synthesizing system are decaying tones in themselves, cancellation of previously produced tones is not necessary. Accordingly, as shown in FIGS. 14(*d*) and 14(*e*), the envelope signal $EV_1$ is generated in turn (at every time period T) in response to falling of the harmonics synthesizing system clear signal CCF which is produced in synchronism with the channel times $CH_2$, $CH_3$ . . . to which the tone of $G_3$, $B_3$ . . . constituting The second tone, third tone . . . respectively are assigned, whereby the tones of $G_3$, $B_3$ . . . are produced in turn.

In comparison therewith, musical tones produced by the filter system are sustained tones, so that previously produced tones must be positively cancelled for producing new tones.

CONTROL OF GENERATION OF THE FILTER SYSTEM CLEAR SIGNAL

In a filter system clear signal generation control circuit 880 shown in FIG. 10, the coincidence signal CON is applied to a 12-stage shift register 155 through an OR gate 154. The coincidence signal CON is also applied to an 11-stage shift register 156. When a delayed signal "1" responsive to the coincidence signal CON is outputted from the final stage (the twelfth stage) of the shift register 155, the output of a NOR gate 157 which has received outputs of all of the 11 stages of the shift register 156 becomes "1" thereby enabling an AND gate 158. The signal "1" obtained by delaying the coincidence signal CON therefore is circulatingly stored in the shift register 155 through the AND gate 158. Assuming that the coincidence signal CON is for the first tone, a signal "1" with a 1 μs width circulates in the timing shift register 155 corresponding to the channel $CH_1$. At timings corresponding to other channels, stored contents of the shift register 155 are all "0". The stored contents of the shift register 155 are provided on a line 159, inverted by an inverter 160 and thereafter are applied to an AND gate 161. The AND gate 161 receives as other inputs thereof an output of the AND gate 143 representing that the filter system chord pyramid performances has been selected and a lower keyboard detection signal $LE_2$ delivered out of the second stage of the shift register 65 (FIG. 7) and representing that a key on the lower keyboard for the chord pyramid performance is being depressed. Accordingly, the output of the AND gate 161 repeatedly becomes a signal "0" due to a signal on the line 159 every 12 μs during the chord pyramid performance in the regular mode at a timing of the channel at which the coincidence signal CON is produced and maintains a signal "1" at timings of the other channels. The output "1" of the AND gate 161 is passed through the OR gate 144 and becomes the filter system clear signal CCV.

The clear signal CCV thus formed in accordance with the output signal of the output line 159 of the filter system clear signal generation control circuit 880 (i.e. the output of the AND gate 161) is a signal "1" of the shaded portions shown in FIGS. 14(*f*)–14(*h*). When the clear signal CCV of a 1 μs width is produced in synchronism with the channel time of the channel $CH_1$ in accordance with the coincidence signal CON, a signal "1" is stored in the shift register 155 of the circuit 880 and, accordingly, the clear signal CCV is not produced at that channel time thereafter (Refer to the time region of the channel $CH_1$ in FIG. 14(*f*)). The envelope signal $EV_2$ therefore is generated in accordance with falling of the clear signal CCV (FIG. 14(*i*)). Since at this time the clear signal CCV is continuously generated through the AND gate 161 (Refer to the time region $CH_1$ in FIGS. 14(*g*) and 14(*h*)), the envelope signal is not generated.

When the coincidence signal CON concerning the second tone has been produced at a timing of the channel $CH_2$, a signal "1" stored at the timing of the channel $CH_1$ (i.e. the preceding coincidence signal CON) is outputted from the final stage of the 12-stage shift register 155 while a signal "1" concerning the coincidence signal CON of the second tone is in the 11-stage shift register 156(FIG. 10). An AND gate 158 is disenabled by an output "0" of the NOR gate 157 whereby the storage of the preceding coincidence signal CON is cancelled. Accordingly, the clear signal CCV is continuously outputted via the line 159 and the AND gate 161 at the timing of the channel $CH_1$ (Refer to the time region of the channel $CH_2$ in FIG. 14(*f*)) and production of the first tone assigned to the channel $CH_1$ thereby is cancelled. In other words, the contents of the envelope counter (counter 30 in FIG. 3) become "0" responsive to the signal CCV thereby inhibiting reading of the envelope amplitudes from the envelope memory. On the other hand, the coincidence signal CON is circulatingly stored in the shift register 155 at the timing of the channel $CH_2$ of the second tone so that the output of the AND gate 161 at the timing of the channel $CH_2$ becomes "0" and the clear signal CCV of the channel $CH_2$ falls to "0" as shown in the time region of the channel $CH_2$ in FIG. 14(*g*). Consequently, the envelope signal $EV_2$ is generated at the channel $CH_2$.

As described in the foregoing, if a new tone is to be produced in a certain channel in the filter system musical tone forming system 11, a sustained tone having previously been produced in the other channel is cancelled whereby tones are articulately produced one by one from the system.

OCTAVE SLIDE CONTROL (PART I)

The amount of octave slide designated by the octave change designation signals FF and FV correspond to the contents of the octave counter 52(FIG. 9). The octave counter 52 advances its count by one count upon delivery of the carry signal CARY from the chord pyramid counter 42. Accordingly, the octave of the generated tone remains unchanged until the chord pyramid counter completes its counting-scanning operation for one cycle (i.e. producing the carry signal CARY by counting the modulo number only). Thus, the octave of the produced tone changes upon delivery of the carry signal CARY.

The carry signal CARY is generated from the carry detection circuit 105(FIG. 7). The carry detection circuit 105 comprises an AND gate 162 and a NOR gate 163 respectively receiving as inputs thereof the upcounting instruction signal U and all bit outputs of the counter 42. The AND gate 162 is enabled by a "1" state of the signal U representing that the counter 42 is in the upcounting mode and delivers out a carry detection signal "1" when the output of the counter 42 has become a maximum value (i.e. all bit outputs are "1"). This output "1" of the AND gate 162 delivered through an OR gate 164 constitutes the carry signal CARY in the upcounting mode of the counter 42. The NOR gate 163 is enabled by a "0" state of the signal U representing that the counter 42 is in the downcounting mode (the downcounting instruction signal D is "1") and delivers out a carry detection output "1" when the output of the counter 42 has become a minimum value (i.e. all bit outputs are "0"). This output "1" of the NOR gate 163 delivered through an OR gate 164 constitutes the carry signal CARY in the downcounting mode of the counter 42.

When, accordingly, the chord pyramid counter 42 is in the upcounting mode, the carry signal CARY is produced (by the AND gate 162) in the course of the counting operation of the counter 42 which is resumed upon the lapse of the time period T from generation of the coincidence signal CON concerning the key code for the key of the highest note in the depressed keys. When the counter 42 is in the downcounting mode, the carry signal is produced from the NOR gate 163 in the course of the counting operation of the counter 42 which is resumed upon the lapse of the time period T from generation of the coincidence signal CON concerning the key code for the key of the lowest note in the depressed keys. The counting operation by the counter 42 is temporarily stopped upon generation of the carry signal CARY and resumed upon completion of processing of the carry signal CARY.

Assume, for example, that the $B_3$ tone which is the highest tone of all the tones of the depressed keys has been produced as the third tone as shown in FIG. 1. At this time, the key code of the $B_3$ is stored in the coincidence code memory circuit 95 (FIG. 7). When the tone production timing pulse TEP is produced upon the lapse of the time period T from the start of production of the third tone and is applied to the chord pyramid system control unit 71, the signal $H_2$ becomes "1" thereby resuming the counting of the chord pyramid counter 42. More specifically, a count clock $J_2$ is provided to the counter 42 which has stopped at the same value as the key code $N_1$–$B_3$ of the $B_3$ tone thereby changing the contents of the counter 42 to a value which is the key code of the $B_3$ tone plus 1. Subsequently, the count pulse $J_1$ is supplied at the timing of the system clock pulse $SY_1$. The counter 42 counts up by this count pulse $J_1$. Since, however, no key code higher than the key code of the $B_3$ tone is supplied (at least for the lower keyboard), no coincidence signal CON is produced and the count of the counter 42 therefore amounts to the maximum value of "1111111". Thereupon the carry signal CARY is outputted through the AND gate 162 (FIG. 13 (m)).

As the carry signal CARY becomes "1", the output of the inverter 106 becomes "0". The AND gate 104 is disenabled and the storage of the delay flip-flop 97 is cancelled. Consequently, the signal $H_2$ falls to "0" 1 μs later (Refer to the time region 4T in FIG. 13).

If the system clock pulse $SY_1$ is produced while the carry signal CARY is being generated, an AND gate 165 delivers out an output "1" under the condition that a signal "1" has not been stored yet in the delay flip-flop 96($H_1=0$, $\overline{H}=1$). This output "1" of the AND gate 165 is applied through an OR gate 166 to the flip-flop 96 and stored therein. When the output $H_1$ of the flip-flop 96 becomes "1" 1 μs later, the signal "1" is circulatingly stored in the flip-flop 96 via an AND gate 167 because the system clock pulse $SY_1$ is "0" at this time. When the system clock pulse $SY_1$ is produced 12 μs later, the AND gate 167 is disenabled and the storage of the flip-flop 96 thereby is cancelled. Accordingly, the signal $H_1$ as shown in FIG. 13(*n*) is "1" only during 12 μs.

Figure 13:
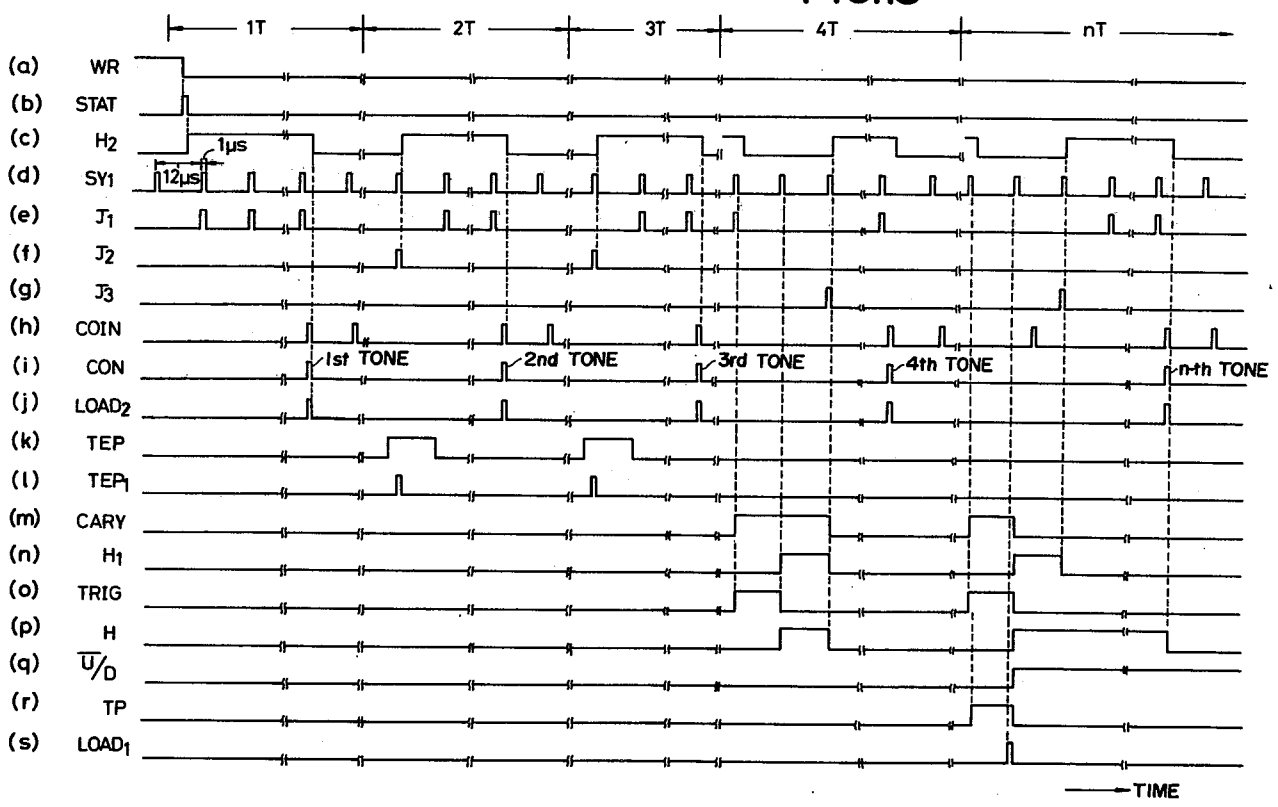
FIGS. 13(*a*) through 13(*s*) are a time chart for explaining an operation of the chord pyramid system control unit in FIG. 7.

During period of time from generation of the carry signal CARY till a time point immediately before the output $H_1$ of the flip-flop 96 builds up to "1", an AND gate 168 is enabled to deliver out the octave change pulse TR1G of a 12 μs width (FIG. 13(*O*)). This octave change pulse TRIG is applied to an AND gate 170 via a line 169 in FIG. 9. Since the AND gate 170 has been provided with the regular mode selection signal RE through the line 114, the octave change pulse TRIG is gated out of the AND gate 170 and supplied to AND gate 173–179 in the octave rise-fall control circuit 54 via an OR gate 171 and a timing matching delay flip-flop 172. If the present amount of octave slide (i.e. contents of the octave counter 52) has not amounted to a value set by the octave slide amount set switches 50 and 51 (FIG. 6), a signal "1" is delivered out of an AND gate 173 and is applied through an OR gate 180 and an AND gate 181 (being enabled by the signal RE) to an AND gate 182. Since the AND gate 182 receives as its other input the system clock pulse $SY_1$, a signal "1" with a pulse width of 1 μs is gated out of the AND gate 182 at a timing of the pulse $SY_1$ and thereafter is applied to the counting input of the octave counter 52. The octave counter therefore counts up by 1 count.

If the system clock pulse $SY_1$ is produced when the signal $H_1$ produced in accordance with the carry signal CARY is "1" and the signal $H_2$ is "0", a count pulse $J_3$ as shown in FIG. 12(*g*) is produced by an AND gate 183(FIG. 7). This count pulse $J_3$ is applied to the chord pyramid counter 42 through the OR gate 109. A signal "1" is also produced from an AND gate 184 (FIG. 7) under the same condition as in the case of the AND gate 183 and stored in the flip-flop 97. Accordingly, the signal $H_2$ becomes "1" 1 μs after the count pulse $J_3$ has been produced and the counting of the counter 42 is resumed.

The counter 42 which still receives the upcounting signal U counts up from the minimum value 0. Upon coinciding of the contents of the counter 42 with the key code for the key of the lowest tone ($D_3$), the coincidence signal CON is delivered out and thereupon production of the fourth tone is started. When the AND gates 115 and 116 of the octave memory counting circuit 520 (FIG. 9) are enabled by the coincidence signal CON for the fourth tone, the count of the octave counter 52 has increased by 1 count. Accordingly, data "01" representing the octave slide amount "1" is stored in the circuit 520. As a result, the octave change designation signals $FF_1$, $FF_2$ and $FF_3$ (and $VF_1$, $VF_2$ and $VF_3$) become "010" whereby the $D_3$ tone associated with the key code which has caused occurrence of the coincidence signal CON is slide one octave upwardly to become the $D_4$ tone. Consequently, the $D_4$ tone is produced as the fourth tone (Refer to the time region $CH_1$ in FIG. 14).

Since the contents of the octave counter 52 remain unchanged until a next shot of the carry signal CARY is produced, the coincidence signals CON concerning the key codes for the $G_3$ and $B_3$ tones are subsequently produced as the fifth and sixth tones. Even though the contents of the key code KC produced by the tone production circuit 15 (FIG. 3) are those for the $G_3$ and $B_3$ tones, they are changed to the $G_4$ and $B_4$ tones which are one octave above by the octave change designation signals FF and VF. Accordingly, the $G_4$ and $B_4$ tones are produced in turn as the fifth and sixth tones.

OCTAVE SLIDE CONTROL (PART II)

The maximum octave slide amount is set as desired by the performer by means of the octave slide amount set switches 50 and 51. Upon closing of the switch 50, the output thereof $\overline{OS_1}$ becomes a signal "0". This signal is inverted by an inverter 185(FIG. 9) and the inverted signal OS, becomes "1". Upon closing of the switch 51, the output thereof $\overline{OS_2}$ becomes "0". This signal is inverted by an inverter 186 and the inverted signal $OS_2$ becomes "1". The signals $OS_1$ and $OS_2$ are applied to an encoder 187(FIG. 9) and, in response thereto, octave slide amount set signals $OSE_1$, $OSE_2$ are produced. The encoder 187 encodes the signals in a manner shown in the following Table 4.

Table 4

(encoder 187)

| Input | | output | | |
|---|---|---|---|---|
| $OS_1$ | $OS_2$ | $OSE_1$ | $OSE_2$ | octave slide amount |
| 0 | 0 | 0 | 0 | 0 |
| 1 | 0 | 1 | 0 | 1 |
| 1 | 1 | 0 | 1 | 2 |
| 0 | 1 | 1 | 1 | 3 |

In Table 4, the significance of the octave slide amounts 0, 1, 2, 3 is the same as in Table 3. As will be apparent from Table 4, the encoder 187 is so constructed that closing of the switch 50 produces a slide amount of one octave, closure of the switch 50 and further the switch 51 produces a slide amount of two octaves and opening of the switch 50 and closing of the switch 51 produce a slide amount of three octaves. The present embodiment is capable of automatically producing a tone pitch variation over four octaves including the octave to which the depressed key belongs. The invention, however, is not limited to this but any desired octave ranges may be selected.

The octave slide amount set signals $OSE_1$ and $OSE_2$ produced by the encoder 187 are applied to an adder 188 of the octave comparison circuit 53 (FIG. 9). The signal $OSE_1$ has a weight of less significant bits and the signal $OSE_2$ has a weight of more significant bits. The octave comparison circuit 53 is constituted as a subtractor and subtracts, in the regular mode, the counting output of the octave counter 52 applied through AND gates 189 and 190 from the octave slide amount set signals $OSE_1$, $OSE_2$, whereas in the random mode, the counting output of the octave memory counting circuit 520 applied through AND gate 191 and 192 from the octave slide amount set signals $OSE_1$, $OSE_2$. Since subtraction is made by conducting complementing in the adder 188 (a signal "1" is constantly applied from a line 193 to the less significant bit), the counting outputs of the octave counter 52 and the octave memory counting circuit 520 are inverted by inverters 194, 195, 196 and 197 and thereafter applied to other inputs) of the adder 188. In the octave comparison circuit 53, subtraction "$OSE_2$, $OSE_1$" - "$OCTV_2$, $OCTV_1$" in 2-bit binary number, i.e. subtraction of the presently performed octave slide amount from the octave slide amount set signal binary number, is conducted.

When the present octave slide amount has reached a set value, result of subtraction becomes "00", so that the adder 188 produces an output "00". A NOR gate 198 receiving the output of the adder 188 detects the fact that the present octave slide amount has reached the set octave slide amount and thereupon produces an output "1". This output of the NOR gate 198 is applied to the octave rise-fall control circuit 54 through an OR gate 199 and a timing matching delay flip-flop 200.

If the present octave slide amount ($OCTV_1$, $OCTV_2$) is the same as or below the set octave slide amount ($OSE_1$, $OSE_2$), the adder 188 always produces an overflow signal OVF(="1") in the complementing. This overflow signal OVF is turned to "0" by an inverter 201 so that it will not affect the operation in a normal state. If the present octave slide amount becomes larger than the set octave slide amount due, for instance, to decrease in the set value $OSE_1$, $OSE_2$ by operation of the switches 50 and 51, no overflow signal OVF will be produced. Accordingly, the output of the inverter 201 becomes "1" and a fititious octave coincidence signal OSEO is produced through the OR gate 199

UP MODE

There is a difference in processing of the octave coincidence signal OSEQ between the up mode and the turn mode.

In selecting the up mode, the selection switch 55 (FIG. 6) is closed to turn a selection signal $\overline{UM/TM}$ to "0". The up mode selection signal UM thereupon becomes "1" through an inverter 202 (FIG. 9) and the turn mode section signal TM on a line 203 becomes "0". A half adder 204 of the up-down control memory 87(FIG. 9) receives at its count input line 205 signals from AND gates 178 and 177 of the octave rise-fall control circuit 54 via an OR gate 206. The AND gates 176 and 177 receive the turn mode selection signal TM from the line 203. If, accordingly, the up mode is selected, a signal "1" is not supplied to the count input line 205 of the up-down control memory 87 and the memory 87 continues to store the signal "0". Further, since an AND gate 212 of the memory 87 is disenabled by the up mode selection signal UM which has been inverted by a NOR gate 213, the stored contents of the memory 87 remain "0". Accordingly, in a case where the chord pyramid performance in the up mode is selected, a signal "0" representing the upcounting mode is always stored in the up-down control memory 87. Accordingly, the upcounting instruction signal U obtained by inverting the output of the memory 87 by inverters 207 and 208 is always "1" and the counting mode of the octave counter 52 and the chord pyramid counter 42 constructed as the up-down counter is always set in the upcounting mode.

Assuming now that the octave slide amount of the chord pyramid performance presently conducted is coinciding with a value set by the switches 50 and 51, the octave coincidence signal OSEQ is delivered from the octave comparison circuit to the AND gates 175, 176 and 179 of the octave rise-fall control circuit 54 via the OR gate 199. The AND gate 176 is in an unoperable state by the turn mode selection signal TM which is "0", whereas the AND gate 175 is enabled by the up mode selection signal UM and the AND gate 179 is enabled by the up mode instruction signal U from the inverter 208. If the contents of the chord pyramid counter 42 (FIG. 7) become a maximum value and the carry signal CARY thereby is produced in these conditions, the chord pyramid system control unit 71 processes the carry signal, generates the octave change pulse TRIG and sets the storage of the flop-flop 96 ($H_1$="1") in the same manner as has previously been described.

Upon application of the octave change pulse TRIG of a 12 μs width to the AND gates 175 and 179 via the line 169, AND gate 170, OR gate 171 and the delay flip-flop 172, the AND gates 175 and 179 which have already received the octave coincidence signal OSEQ produce an output "1". This output "1" is applied to the AND gate 118 via the OR gate 117 as an octave reset signal OCRE. The octave reset signal OCRE is turned into a pulse of a 1 μs width by the AND gate 118 at a timing of the system clock pulse $SY_1$ and thereafter is applied to a reset input of the octave counter 52. The contents of the octave counter 52 therefore are reset to a count 0.

Simultaneously with resetting of the octave counter 52 at the timing of the system clock $SY_1$, the AND gate 183 of the chord pyramid system clock control unit 71 produces the count pulse $J_3$ as has previously been described. The contents of the chord pyramid counter 42 which thus counts up by one count from the maximum value "1111111" overflow and become a count 0. The counter 42 therefore counts up from 0 again. The contents of the octave counter 52 also return to 0 and count up again 1, 2, 3 . . . each time the octave change pulse TRIG is applied. Incidentally, the output of the AND gate 179 is not used in the up mode.

Since the chord pyramid counter 42 is always set to the upcounting mode in the up mode, the coincidence signal CON is produced one by one upwardly starting from the tone for the lowest key among the depressed keys. In the meanwhile, the contents of the octave counter 52 constantly increase and, whenever the amount of the tone pitch slide has reached the octave slide amount set by the switches 50 and 51, the contents of the counter 52 are reset. MOre specifically, tone production is initially made from the lowest note upwardly to the highest note in the octave range to which the notes of the depressed keys belong. Then, in tones of the lowest note up to the highest note of the depressed keys are produced in the octave range which is one octave higher than the original octave, and this process is repeated until when the amount of the tone pitch slide in terms of octaves has reached the set octave slide amount. Thereupon, the tone production returns to the original octave range, i.e. the octave range to which the depressed keys belong and are repeated from the lowest tone.

Accordingly, tones associated with one or more depressed keys (i.e. tones of the depressed keys and tones which are in octave relations with the tones of the depressed keys) are produced one by one from the lowest tone upwardly with the predetermined interval T over one or more octave ranges whereby rise of the produced tones is repeated (or may be conducted only once, if so desired). This is the "up mode" in the chord pyramid performance. The octave ranges over which the chord pyramid performance is conducted is set by operation of the octave slide amount set switches 50 and 51. The example of FIG. 1(*a*) is one in which the octave slide amount is set at 1. According to this example, the tone pitch slides by 1 octave with a result that a tone pitch variation ranging over two octaves is achieved.

TURN MODE

For selecting the turn mode, the turn mode selection signal TM is made "1" and the up mode selection signal UM"0". In the turn mode, the tone pitch rises when the chord pyramid counter 42 and the octave counter 52 are set to the upcounting mode and it falls when these counters are set to the downcounting mode.

Referring to FIG. 1(*a*), the tone pitch falls after a turning point on the highest note side in the rise and fall variation of the tone pitch and rises after a turning point on the lowest note side. The turning point on the highest note side takes place when the octave slide amount of the produced tone coincides with the octave slide amount set by the switches 50 and 51. The turning point on the lowest note side takes place when the octave slide amount of the produced tone is 0, i.e., the tone is produced in the octave to which the depressed keys belong. Upon reaching of the tone pitch variation to these turning points, the counting mode of the chord pyramid counter 42 and the octave counter 52 are changed and the rise and fall control is thereby effected. It should be noted that arrangements are made in the present embodiment to prevent repetiteous production of the same tone at the turning points.

The above described special control in the turn mode is made when the carry signal CARY is produced in the process of counting of the chord pyramid counter 42 after production of the tones at these turning points (i.e., the highest tone and the lowest tone in the chord pyramid performance).

Processing of the carry signal CARY at the turning point from the rise portion to the fall portion in the tone pitch variation will now be described with reference to a time region designated by a reference characters nT in FIG. 13.

When the octave slide amount in the present chord pyramid performance (represented by the octave change designation signals FF and VF) coincides with the octave slide amount set by the switches 50 and 51, the coincidence signal OSEQ is produced. Since the tone pitch is rising, the output of the up-down control memory 87 is "0" and the upcounting instruction signal U is "1". The turn mode selection signal TM is also "1" and the AND gate 176 of the octave rise-fall control circuit 54(FIG. 9) thereby is in an operable state. In these conditions, if a tone at the turning point, i.e. the highest tone among tones associated with the depressed keys, is produced at a tone pitch which is higher than the original pitch by the set octave slide amount, the key code stored at this time in the coincidence code memory circuit 95(FIG. 7) is a key code $N_1$–$B_3$ for the highest tone. If, for example, the set octave slide amount is 1 and the highest tone among the tones of the depressed keys is the $B_3$ tone, the $B_4$ tone which is one octave higher is produced as the highest tone at the turning point and the key code $N_1$–$B_3$ for the $B_3$ tone is stored in the coincidence code memory circuit 95. Upon arrival of a next tone production timing caused by generation of the tone production timing pulse TEP, the chord pyramid counter 42 resumes counting and the contents of the counter 42 increase at a timing of the count pulse $J_1$ from a value obtained by adding 1 to the key code $N_1$–$B_3$ for the highest tone in response to the count pulse $J_2$. If the count of the counter 42 has amounted to a maximum value without generation of the coincidence signal CON, the carry signal CARy is delivered through the AND gate 162 and the octave change pulse TRIG of a 12 μs width is outputted through the AND gate 168. Further, the output $H_1$ of the flip-flop 96 becomes "1" upon the lapse of 1 μs of the system clock $SY_1$. Simultaneously, signal "1" is stored in the delay flip-flop 98 through an AND gate 209 and the output H becomes "1" upon the lapse of 1 μs of the system clock $SY_1$ (FIG. 13(*p*)).

As will be apparent from the time region nT in FIG. 13, the octave change pulse TRIG builds up to "1" 12 μs before building up of the signals $H_1$ and H to "1". When the signal $H_1$ builds up to "1", the AND gate 168 is disenabled and the pulse TRIG therefore disappears. This octave change pulse TRIG is delayed by 1 μs by the flip-flop 172 in FIG. 9 and thereafter is applied to the AND gates 176 and 179 which are in an operable state. The AND gates 176 and 179 produce an output "1" of a 12 μs width. This output "1" of the AND gate 176 is applied to an adder 204 of the up-down control memory 87 through an OR gate 206 and a count input line 205. Since the stored contents of the memory 87 were 0, the adder 204 which receives as other input thereof a signal "0" from a shift register 211 produces an output "1" which in turn is stored in a shift register 210 through an AND gate 212. When this signal "1" is applied to the adder 204 after being delayed by 12 μs by the 10-stage shift register 210 and the 2-stage shift register 211, the signal "1" of a 12 μs width on the count input line 205 falls to "0" and, accordingly, the signal "1" is stored and held in all of the twelve stages of the shift registers 210 and 211. Further, since the output of the shift register 210 becomes the up-down counting instruction signal U/D through a 2-stage shift register 214, the signal U/D becomes a signal "1" 13 μs after falling of the pulse TRIG, as shown in FIG. 13(*g*). Thus, the downcounting instruction signal D becomes "1" whereas the upcounting instruction signal U becomes "0" whereby the octave counter 52 and the chord pyramid counter 42 are changed over to the downcounting mode.

A turn pulse TP(FIG. 13 (*r*)) with a pulse width of 12 μs is outputted from the AND gate 179 in response to the octave change pulse TRIG which has been delayed by 1 μs. This pulse TP is applied to an AND gate 217 of FIG. 7 through OR gates 215 and 216. The AND gate 217 delivers out a pulse LOAD1 with a pulse width of 1 μs at a timing of the system clock pulse $SY_1$ on conditions that (1) the carry signal CARY is "1", (2) the turn mode selection signal TM provided by the octave rise-fall control circuit 54 via the line 203 is "1", (3) the signal $\overline{H}$ obtained by inverting the output H of the flip-flop 98 by an inverter 218 is "1" and (4) the turn pulse TP is "1". Alternatively stated, when the output of the AND gate 209 becomes "1" at the timing of the system clock pulse $SY_1$ (The signal H at this time is still "0" and the signal $\overline{H}$ is "1"), the output of the AND gate 217 simultaneously becomes "1", thereby causing the load instruction pulse LOAD1 (FIG. 13(s)) to be produced.

This load instruction pulse LOAD1 is applied to a load control input of the chord pyramid counter 42 for loading the key code for the highest tone (e.g. $B_3$ tone) produced at the turning point and stored in the coincidence code memory circuit 95. In this manner, data which is the same as the key code $N_1$–$B_3$ concerning the highest tone is preset in the counter 42, and the carry signal CARY is cancelled. Upon turning of the carry signal CARY to "0", the output of a NAND gate 219 becomes "1". Further, upon turning of the carry signal CARY to "0", the signal H builds up to "1" and this signal H is applied to the flip-flop 98 through an AND gate 220 and an OR gate 221 and self-held by the flip-flop 98. The AND gate 220 self-holds the signal H when the output of the NAND gate 219 is "1" and the converted signal $\overline{CON}$ obtained by converting the coincidence signal CON by the inverter 107 is "1". The output of the NAND gate 219 is "0" when the carry signal CARY coincides with the system clock pulse $SY_1$ and otherwise is "1". Accordingly, the signal H is self-held until the coincidence signal CON is generated from the AND gate 69. In the time region 4T in FIG. 13, it will be noted that the signal H falls upon the lapse of 12 μs. This is because the output of the NAND gate 219 becomes "0" by the coincidence of the carry signal CARY with the pulse $SY_1$.

As the preceding coincidence code has been loaded in the pyramid counter 42 by the load instruction pulse LOAD 1, a coincidence detection signal COIN is produced by the coincidence detection circuit 43 during a next 12 μs period. Since, however, the AND gate 69 is not operable, the coincidence signal CON is not produced. Upon generation of the system clock pulse $SY_1$ at the end of the signal $H_1$ of a 13 μs width, the flip-flop 97 is set through the AND gate 184 and the signal $H_2$ becomes "1" 1 μs later thereby enabling the AND gate 69. Accordingly, by generating a count pulse $J_3$ from the AND gate 183 under the same condition as the AND gate 184, the count of the counter 42 is advanced by 1 step. In the counter 42 which is already in the downcounting mode (FIG. 13(*g*)), 1 is subtracted from the value of the preceding coincidence code, i.e. the key code for the highest tone, upon application thereto of the pulse $J_3$. Upon subtraction of 1, the signal $H_2$ becomes "1" and the counting operation of the counter 42 is thereby resumed. The scanning by the counter 42 this time is downcounting.

In sum, the contents of the counter 42 are replaced by the preceding coincidence code (i.e. the key code associated with the tone generated at the turning point) upon generation of the turn pulse TP in the course of processing of the carry signal at the turning point, and the counting operation of the counter 42 is resumed for producing the coincidence signal CON after the contents of the counter 42 are decreased by 1 stop. Accordingly, the key code for the highest tone which has already been produced at the turning point is jumped over in the counting-scanning operation of the counter 42 so that the highest tone is never produced twice in succession.

As the contents of the counter 42 are successively counted down by the count pulse $J_1$ and have amounted to a value corresponding to a key code for a tone (e.g. $G_3$) among the tones of the depressed keys which tone is immediately below the highest tone, the coincidence signal CON is produced.

The coincidence signal CON delivered out of the AND gate 69 is inverted by the inverter 107 and thereafter is applied to an AND gate 222 of a single input. Accordingly, the output of the AND gate 222 becomes "0" at a timing of the coincidence signal CON, thereby releasing self-holding of the signal H produced via the AND gate 220 and OR gate 221. Simultaneously, the harmonics synthesizing system clear signal CCF and the filter system clear signal CCV are generated in response to the coincidence signal CON and thereupon a n-th tone is produced. The coincidence signal CON enables the AND gates 115 and 116 of the octave memory counting circuit 520 (FIG. 9) and causes the stored contents of the corresponding channel in the memory counting circuit 520 to be rewritten to the contents of the octave counter 52. At the turning point, however, only the counting mode of the octave counter 52 is changed (from upcounting to downcounting) and no count pulse is supplied, so that the contents of the octave counter 52 represent the highest octave slide amount set by the switches 50 and 51. Accordingly, when the set octave slide amount is 1, a produced tone is the $G_4$ tone which is one octave higher then the $G_3$ tone.

Subsequently, the chord pyramid counter 42 conducts downcounting. The coincidence signal CON is produced sequentially from the higher tone among the tones of the depressed keys, so that the tones of the depressed keys are produced from the higher tone. In the carry detection circuit 105 shown in FIG. 7, the NOR gate 163 is in an operable state by the upcounting signal U which is "0", and the NOR gate 163 produces an output "1" when the count of the counter 42 is the minimum value "0000000" thereby causing the carry signal CARY to be produced. Processing of the carry signal CARY when the tone pitch is falling is made in a manner similar to the processing thereof when the tone pitch is rising (Refer to the time region 4T in FIG. 3). Only difference is that the octave counter 52 is set to the downcounting mode by the downcounting instruction signal D. Upon delivery of the octave change pulse TRIG in response to the carry signal CARY, the AND gate 174 of the octave rise-fall control circuit 54 produces an output "1" since the AND gate 174 is in an operable state under conditions that (1) downcounting instruction signal D is "1" and (2) an octave slide amount 0 detection signal ZR is "0" (i.e., the output of an inverter 223 is "1"). Consequently, a count pulse is provided to the octave counter 52 which thereupon counts down by 1 count. Thus, the contents of the octave counter 52 are successively subtracted whereby the octave slide amount designated by the chord pyramid performance sequentially decreases and the tone pitch sequentially falls from the turning point on the highest note side to the turning point on the lowest note side.

Processing of the carry signal CARY at the turning point at which the tone pitch turns from a descending process to a rising process (i.e. the turning point on the lowest tone side) is conducted in a manner similar to the processing at the turning point on the highest note side (Refer to the time region nT in FIG. 13). In the counting process after generation of the lowest tone ($D_3$ tone in the example of FIG. 1(*b*)), the key code of the preceding tone, i.e. $D_3$ tone, is stored in the coincidence code memory circuit 95. Since at this time the octave slide amount is 0, the output of the octave counter 52 is "00". This output "00" is inverted by the inverter 194 and 196 (FIG. 9) and the inverted signal "11" is supplied through OR gates 224 and 225 to an AND gate 226. The AND gate 226 thereupon produces an output "1" which output in turn is applied to the AND gates 177 and 178 of the octave risefall control circuit 54 as the octave slide amount 0 detection signal ZR. When this octave slide amount 0 detection signal ZR is "1", it represents that the chord pyramid performance is being conducted in the octave range including the turning point on the lowest tone side, i.e., the octave range to which the depressed key belong.

The AND gate 177 is in an operable state when (1) the turn mode selection signal TM is "1", (2) the downcounting instruction signal D is "1" and (3) the octave slide amount 0 detection signal ZR is "1" and, upon receipt of the octave change pulse TRIG in these conditions, provides an output "1" of a 12 μs width. The AND gate 178 is in an operable state when (1) the downcounting instruction signal D is "1" and (2) the octave slide amount 0 detection signal ZR is "1" and, upon receipt of the octave change pulse TRIG, delivers out an output "1" of a 12 μs width.

When the contents of the chord pyramid counter 42 have become a minimum value, the carry signal CARY is applied to the chord pyramid system control unit 71 to produce the octave change pulse TRIG. The pulse of a 12 μs width delivered out of the AND gate 178 in response to the pulse TRIG is supplied as a turn pulse TP through the OR gate 215 and the line 216 (FIG. 9) to the chord pyramid system control unit 71(FIG. 7). When the turn pulse TP is being produced, the AND gate 217 produces the load instruction pulse LOAD1 at the timing of the system clock pulse $SY_1$ to load the preceding coincidence code (key code $N_1$–$B_3$ of the lowest tone $D_3$) stored in the coincidence code memory circuit 95 into the chord pyramid counter 42.

The signal "1" of a 12 μs width outputted by the AND gate 177 (FIG. 9) in response to the octave change pulse TRIG is applied to the adder 204 of the up-down control memory 87 via the OR gate 206 and the line 205. Since the storage of the memory 87 is "1" while the tone pitch is falling, a signal "1" is applied from the shift register 211. Accordingly, the output of the adder 204 of a single bit becomes 1+1="0" whereby the signal "0" is stored in the memory 87. Thus, the counters 42 and 52 are set to the upcounting mode by turning of the upcounting instruction signal U to "1".

The count pulse $J_3$ is outputted by the AND gate 183(FIG. 7) 12 μs after the preceding coincidence code (the key code of the $D_3$ tone) is loaded in the chord pyramid counter 42. Since the counting mode of the counter 42 has been changed to the upcounting mode, count 1 is added to the preceding coincidence code. Upon the lapse of 1 us thereafter, the signal $H_2$ builds up to "1" and the counter 42 is thereby set to a state wherein it is capable of counting and scanning. The counter 42 and the octave counter 52 are upcounting this time so that the tone pitch rises in the same manner as has previously been described.

SPECIAL ARRANGEMENTS IN THE TURN MODE

Figure 15:
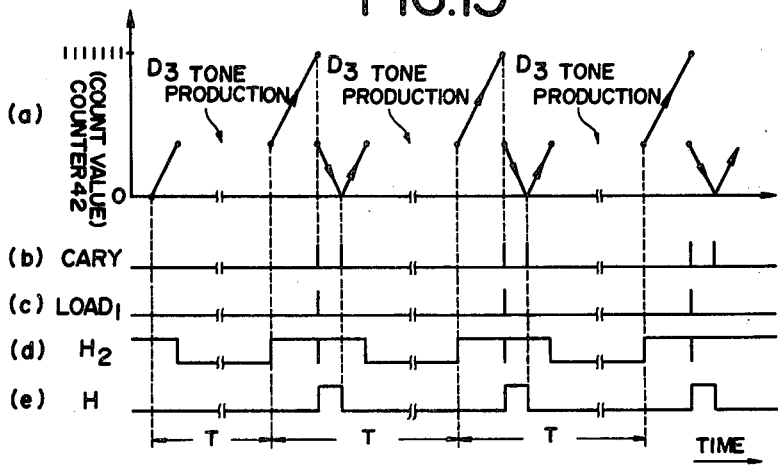
FIGS. 15(*a*) through 15(*e*) are a time chart for macroscopically explaining an operation of the chord pyramid system control unit in FIG. 7 in a case where only one key has been depressed in the turn mode of the regular mode.

In the present embodiment, arrangements are made so that the same tone will not be produced twice at the turning point in the turn mode. If, however, a single key is depressed on the lower keyboard and the octave slide amount is set to 0 by the octave slide amount set switches 50 and 51, a produced tone is only a single tone (i.e. the tone of the depressed key) and this tone constitutes a tone at the turning point. If, accordingly, the principle that the same tone is not produced twice at the turning point was applied to this case, no tone would be produced at all at the turning point. To avoid such inconvenience, the flip-flop 98 shown in FIG. 7 for storing the signal H and a circuit connected to the flip-flop 98 are provided to cope with the case where a single key is depressed and the set octave slide amount is 0. FIGS. 15(*a*) through 15(*e*) shown an example of operation of such circuit arrangement. FIG. 15(*a*) shows contents of the chord pyramid counter 42, FIG. 15(*b*) the carry signal CARY, FIG. 15(*c*) the load instruction pulse LOAD1, FIG. 15(*d*) the signal $H_2$ and FIG. 15(*e*) the signal H respectively. First, a tone of the depressed key (e.g. $D_3$ tone) is produced. Then, counting of the counter 42 is resumed and, upon reaching of the count of the counter 42 to a maximum value, the carry signal CARY is produced. The octave change pulse TRIG is produced in response to the carry signal CARY. On the other hand, the octave coincidence signal OSEQ is produced when the contents of the counter 52 are 0, for the octave slide amount is set to 0 by the switches 50 and 51. At this time, the upcoming instructing signal U is "1" and, accordingly, the AND gate 179 (FIG. 9) outputs the turn pulse TP. As has been described above, upon the generation of the pulse TP, the load pulse LOAD1 is produced at the timing of the system clock pulse $SY_1$ appearing before the signal H becomes "1" whereby a preceding coincidence code is loaded in the counter 42. Thereafter, count 1 is subtracted from the contents of the counter 42 by the count pulse $J_3$. 1 μs later, the signal $H_2$ becomes "1" and subtraction from the contents of the counter 42 is made by the count pulse $J_1$. Since, however, only one key is being depressed, the coincidence signal CON is not produced until the counter 42 has counted down to the minimum value and the carry signal CARY thereupon is produced. Consequently, self-holding in the flip-flop 98 (FIG. 7) of the signal H which has become "1" immediately after generation of the load instruction pulse LOAD 1 is sustained.

As the count of the counter 42 becomes the minimum value and the carry signal CARY is generated, the AND gate 178 (FIG. 9) which receives the douncounting instruction signal D which is "1" delivers out the turn pulse TP. This turn pulse TP is applied to the AND gate 217 (FIG. 7). Since, however, the signal H is still held in the "1" state, the AND gate 217 is not enabled and no load instruction pulse LOAD1 is generated. Accordingly, the carry signal CARY becomes a signal of a pulse width of 24 us which is the same as that shown in the time region 4T in FIG. 13. The output of the NAND gate 219 therefore becomes "0" at the timing of the system clock pulse $SY_1$ and the signal H is thereby released from the self-holding state. Simultaneously therewith, the count pulse $J_3$ is supplied to the chord pyramid counter 42. Since the upcounting instruction signal U at this time is "1", a count 1 is added to the contents of the counter 42. Upon the lapse of 1 μs, the signal $H_2$ builds up to "1" enabling the AND gate 69 which gates out the coincidence signal CON. Thus, the counter 42 counts up from a count 1 at the timing of the system clock pulse $SY_1$ and the coincidence signal CON is generated in the course of the upcounting.

As has been described above, in the case where single key has been depressed ant the octave slide amount is 0, counting in the counter 42 is conducted in such a manner that the key code of the depressed key is jumed over in the downcounting whereas in the upcounting counting is started from a minimum value. Accordingly, the tone (i.e. the same single tone) is produced without duplication at an interval of the tone production timing pulse TEP.

MODIFIED EXAMPLE OF THE TURN MODE

In the foregoing description, the example in which the same tone is not produced twice at the turning point in the turn mode has been described. The invention, however, is not limited to this but may include a case where the same tone is produced twice. Arrangements for this latter case may be readily realized only by modifying a part of the chord pyramid system control unit 71 shown in FIG. 7. More specifically, the arrangements can be achieved by removing the AND gate 217 for preventing generation of the load instruction pulse LOAD1. As the AND gate 217 is omitted, the flip-flop 98 storing the signal H and the circuit related to the flip-flop 98 as well as the coincidence code memory circuit 95 are obviated.

It is also possible to leave the performer to select whether the same tone should be produced twice or only once at the turning point in the turn mode. This selection can be made possible to providing a gate to the AND gate 217 generating the load instruction pulse LOAD1 and applying a selection signal to this gate for controlling generation of the pulse LOAD1.

RANDOM MODE

In a case where the chord pyramid performance is conducted in the random mode instead of the regular mode, the selection switch 48 (FIG. 6) is opened to turn a regular-random selection signal $\overline{RE}/RA$ to "1". This turns the output of an inverter 227 of the chord pyramid start-stop control unit 75 in FIG. 8 to "0". The regular mode selection signal RE on the line 114 thereupon becomes "0" and the random mode selection signal which is obtained by inverting the signal RE becomes "1".

START OF THE PERFORMANCE IN THE RANDOM MODE

Since the octave slide control is made with respect to each of the depressed keys in the random mode, various signal processing operations are conducted in time sharing with respect to each of the respective channels to which production of tones associated with the depressed keys is assigned.

When a key has been depressed on the lower keyboard for chord pyramid performance, the lower keyboard key depression signal $LE \cdot \overline{DS}$ of a pulse width of 1 μs is generated, as has previously been described. This signal $LE \cdot \overline{DS}$ is applied to the shift register 72 in FIG. 8 and also to an AND gate 232 of the chord pyramid start-stop control unit 75. The shift register 72 delays its input signal by 12 us and delivers out the delayed output on the output line 80 for the final stage thereof. Accordingly, channels of the input signal and the output signal are the same with each other. The signal on the output line 80 is inverted by an inverter 233 and thereafter is applied to an AND gate 232. The AND gate 232 receives as its other input the random mode selection signal RA from an inverter 231. Accordingly, when a key has been depressed and the lower keyboard key depression signal LE·DS is initially applied to the shift register 72 at the channel time corresponding to the depressed key, the signal on the output line 80 for this channel is "0". The output of an inverter 233 therefore is "1". Thus, the output of the AND gate 232 becomes "1" in response to the lower keyboard key depression signal $LE \cdot \overline{DS}$. Since the signal on the line 80 is turned to "1" 12 μs later, the AND gate 232 delivers out only one shot of pulse of a 1 μs width at the initial stage of depression of the key. This pulse of a 1 μs width is inverted to a signal "0" via the NOR gate 83, which signal constitutes an initial key depression reset signal KONR. In the case of the regular mode, the initial key depression reset signal KONR is a signal "0" with a pulse width of 12 us whereas in the case of the random mode, the signal KONR is a signal of a pulse width of 12 μs and corresponds to the channel time at which the depressed key has been assigned.

The initial key depression reset signal KONR of a 1 μs width is applied to the AND gate 86 and disenables the AND gate 86 for a period of 1 μs. The storage in the shift register 84 corresponding to the assigned channel is thereby reset. In the regular mode, the frequency dividing circuit 45 has contents which are the same throughout all of the channels, whereas in the random mode, the frequency dividing circuit operates in a time sharing manner. The initial key depression reset signal KONR is applied to the octave memory counting circuit 520 and the AND gates 146, 147 and 234 of the up-down control memory 87 (FIG. 9), resetting storage (self-holding) of the assigned channel in the respective shift registers. In the random mode, the octave memory counting circuit 520 serves as a chord pyramid octave counter operating in a time sharing manner. The octave counter 52 and the chord pyramid counter 42 are not used in the random mode. The updown control memory 87 also operates in a time sharing manner.

The initial key depression reset signal KONR of a 1 μs period is applied also to the AND gate 158 of the filter system clear signal generation control circuit 880 to disenable it and thereby reset self-held storage in the shift register 155 concerning the related channel.

In FIG. 8, the waiting time setting circuit 46 resets, as in the regular mode, the waiting time counter 81 by the output "1" of the inverter 228 when no key is being depressed on the lower keyboard. Upon turning of the depressed key indication signal LKD from the OR gate 73 to "1", the resetting of the counter 81 is cancelled and a waiting time is set. During the waiting time, the waiting time setting reset signal WR is "1" and the inverted reset signal $\overline{WR}$ on the line 229 is "0". Upon the lapse of the waiting time, the signal $\overline{WR}$ on the line 229 becomes "1" and is applied to the AND gate 230 of the start-stop control unit 75. The AND gate 230 delivers out an output "1" of a pulse width of 12 us upon application thereto of the lower keyboard key depression signal LE·$\overline{DS}$ of a pulse width of 12 μs under the following conditions:

(1) The chord pyramid selection signal CPON obtained by combining through the OR gate 92 the harmonics synthesizing system chord pyramid selection signal CPF and the filter system chord pyramid selection signal CPV supplied respectively on the lines 126 and 129 in FIG. 10 upon closure of the chord pyramid selection switches 57 and/or 58*a* is "1";

(2) The random mode selection signal RA from the inverter 231 is "1"; and (3) The chord pyramid basic tempo clock pulse CPL supplied through the AND gate 90 after being rectified into a pulse of a 12 μs width is "1".

The output pulse of the AND gate 230 is applied to the adder 85 of the frequency dividing circuit 45 through the OR gate 93 and a delay flip-flop 235 provided for synchronizing the timing. Accordingly, the basic tempo clock pulse CPL is selected for counting in the frequency dividing circuit 45 only during the channel time to which production of the tone of the depressed key has been assigned. In this way, the frequency dividing circuit 45 counts the tempo clock pulse CPL with respect to each of the channel independently and in a time sharing manner.

Upon receipt of 8 shots of the clock pulse CPL counting from start of depression of the key, the adder 85 overflows and carry signal of a 1 μs width is delivered on the line 94. This carry signal constitutes a tone production timing pulse TEP' in the random mode. This pulse TEP' is produced only in correspondence to the channel time of the channel in which the overflowing has occurred in the frequency dividing circuit 45. This pulse TEP' is applied to an AND gate 236 of the random mode tone production control circuit 47. The AND gate 236 which receives as its other input the random mode selection signal RA is thereby enabled to gate out the pulse TEP' to AND gates 238 and 239. The period To of the tone production timing pulse TEP' is eight times as long as that of the tempo clock pulse CPL and corresponds to the interval To (FIG. 2) of production of tones which are sequentially produced for each of the depressed keys (i.e. tone produced with their octaves being changed).

When the harmonics synthesizing system chord pyramid selection signal CPF is "1", the AND gate 238 is enabled and the tone production timing pulse TEP of a 1 μs width is provided on a line 240 and applied to the OR gate 140 in FIG. 10 as a harmonics synthesizing system clear signal RAF for the random mode. When the filter system chord pyramid selection signal CPV is "1", the AND gate 239 is enabled and the tone production timing pulse TEP' is provided on a line 241 and applied to the OR gate 144 in FIG. 10 as a filter system clear signal RAV for the random mode. The clear signals RAF and RAV for the random mode are respectively applied to the corresponding shift registers 141 and 142 via the OR gates 140 and 144 and outputted from the chord pyramid device as the haromonics synthesizing system clear signal CCF and the filter system clear signal CCV. Since there occurs delay of 12 bit, i.e., 2 bits through the delay flip-flops 67 (FIG. 7) and 235 (FIG. 8) and 10 bits through the shift register 141 or 142 from application of the decay start signal DS and the keyboard code $K_1$, $K_2$ to the chord pyramid device 12 till outputting of the corresponding clear signals CCF and CCV, the channel time of the key code KC applied to the musical tone forming systems 10 and 11 coincides with the channel time of the clear signals CCF and CCV.

It is with respect to the second and subsequent random mode chord pyramid tones that the clear signals CCF and CCV of a 1 μs width are produced in response to the tone production timing pulse TEP' and the clear signals CCF and CCV are not produced with respect to the first tone which is produced immediately upon start of the key depression. Tone production control for the first tone is performed in response to the attack start signal AS and the attack pulse APP.

In FIG. 7, the keyboard code $K_1$, $K_2$ is applied to an AND gate 243 through an OR gate 242. Upon generation of the attack start signal As due to depression of a key on either of the upper keyboard, lower keyboard or the pedal keyboard, the keyboard code $K_1$ or $K_2$ becomes "1" and, accordingly, the output of the OR gate 242 becomes "1". The AND gate 242 receives as its other input a signal $\overline{DS}$ obtained by inverting the decay start signal DS by the inverter 66. Accordingly, if any key is depressed on any of the keyboards (not necessarily the lower keyboard), the output of the AND gate 243 becomes "1" at a channel time to which production of the tone of the key has been assigned. The output of the AND gate 243 is applied to a shift register 244 of a 12 stages and also to an AND gate 245. The AND gate 245 receives as its other input a signal obtained by inverting the output of the final stage of the shift register 244 by an inverter 246. The output of the AND gate 245 is turned to "1" only when the first signal "1" of a 1 us width representing depression of the key is produced by the AND gate 243 at the initial stage of the key depression. This output of the AND gate 245 constitutes the attack signal AP. Whenever a key is depressed on the keyboard 13, one shot of attack signal AP is produced in accordance with a channel to which production of the tone of the key has been assigned. The attack pulse APP is produced in response to this attack signal AP.

In the chord pyramid performance in the regular mode, the attack pulse APP is not required. Accordingly, the attack signal AP which is produced also in the regular mode is not directly used as the attack pulse APP but is applied to an attack pulse processing circuit 248 (FIG. 10) through a timing matching shift register 247 of 2 stages. The attack signal AP is applied to an AND gate 249 of the attack pulse processing circuit 248. The AND gate 249 receives as its other input the output of a NAND gate 250. The NAND gate 250 receives a lower keyboard detection signal $LE_2$ delivered out of the second stage of the shift register 65 in FIG. 7 and the regular mode selection signal RE, so that the output of the NAND gate 250 is "0" only when the chord pyramid performance in the regular mode is performed and otherwise is "1".

Accordingly, in the case of the random mode (or in a case where no chord pyramid performance is conducted or where the upper keyboard or the pedal keyboard is played), the AND gate 249 is enabled by the output "1" of the NAND gate 250 to deliver out the attack pulse APP upon receipt of the attack signal AP. The attack pulse APP is delayed by 10 $\mu$s by a timing matching shift register 251 of 10 stages, and thereafter is outputted from the chord pyramid device 12. Since the attack pulse APP is delayed by a total time of 12 $\mu$s consisting of 2 $\mu$s in the 2-stage shift register 247 (FIG. 7) and 10 $\mu$s in the 10-stage shift register 251, the channel time of the input signal DS, $K_1$, $K_2$ of the chord pyramid device 12 coincides with the channel time of the attack pulse APP.

The one shot of attack pulse APP produced at the start of key depression is applied to the envelope generation circuits 28 and 27 of the musical tone forming systems 10 and 11 (FIG. 3), clearing contents of the envelope counters 30 of the corresponding channel. Since the envelope generation circuits 28 and 27 receive the attack start signal AS from the tone production assignment circuit 15, the envelope counters 30 start counting from a count 0 thereupon producing the envelope signals $EV_1$ and $EV_2$. Thus, the first tone in the random mode is produced simultaneously with start of key depression. Storage concerning the channel to which production of the first tone has been assigned has been reset by the initial key depression reset signal KONR of a 1 us width and, accordingly, the octave instruction signals $OCTV_1$ and $OCTV_2$ for the specific channel are "00" so that the octave change designation signals FF and VF concerning the first tone designate the octave slide amount 0. Consequently, the first tone is produced in the octave range to which the tone of the depressed key belongs.

As described above, a timing of tone production for the second and subsequent tones depends upon the random mode clear signals RAF and RAV produced in response to the tone production timing pulse TEP'. It should be noted that the terms "first tone", "second tone" etc. used with respect to the random mode indicate an order of tone production in one channel in which production of tones for one key has been assigned and are of a somewhat different meaning from the terms "first tone", "second tone" etc. used with respect to the regular mode in which these terms indicate an order of tone production irrespective of a tone production channel.

OCTAVE CONTROL OF THE SECOND AND SUBSEQUENT TONES

The tone production timing pulse TEP' of a 1 $\mu$s width is applied to an AND gate 254 in FIG. 9 through a delay flip-flop 252 (FIG. 8) and a line 253. The AND gate 254 which is provided with the random mode selection signal RA gates out the tone production timing pulse TEP' and supplies it to the octave rise-fall control circuit 54 via the OR gate 171 and the delay flip-flop 172.

Operations of the octave rise-fall control circuit 54 and the up-down control memory 87 in the random mode are substantially the same as those in the regular mode except that in the random mode these circuits 54 and 87 and the octave comparison circuit 53 are adapted to operate separately with respect to each channel in a time sharing manner. More specifically, memory positions corresponding to all of the 12 channels are provided by a 12-stage shift register in the up-down control memory 87 and the octave memory circuit 520. Utilizing stored contents of the respective channels the octave rise-fall control circuit 54 operates in a time sharing manner.

If stored contents of the specific channel in the up-down control memory 87 is "0" when the tone production timing pulse TEP' of a 1 us width is applied to the circuit 54 through the AND gate 254, the upcounting signal U(="1") is applied from the inverter 208 to the AND gate 173. If the octave coincidence signal OSEQ at this time is "0", the AND gate 173 is enabled to output an signal "1" of a 1 us width corresponding to the pulse TEP'. This output "1" of the AND gate 173 indicates that the octave should be raised by one octave. This output "1" is applied to the adder 119 for less significant bits of the octave memory counting circuit 520 via the OR gate 180, an AND circuit 255 enabled by the random mode selection signal RA and a line 256. Accordingly, a count 1 is added to the stored contents in the circuit 520 concerning the channel in which the tone production timing pulse has been produced (i.e. data supplied from the shift registers 121 and 122 via AND gates 258 and 259). This increases the values of the octave instruction signals $OCTV_1$ and $OCTV_2$ by 1 and thereby raises the octave slide amount designated by the octave change designation signal FF and VF by one octave. The signal from the adder 119 is applied to the adder 120 for more significant bits via a line 257.

When the storage of the up-down control memory 87 is "1", the downcounting instruction signal D is "1". If the octave slide amount 0 detection signal ZR at this time is "0" the AND gate 174 is enabled to output a signal "1" corresponding to the tone production timing pulse TEP' of a 1 μs width. This output "1" of the AND gate 174 indicates that the octave should be lowered by one octave. This output "1" is applied to the adder 119 for less significant bits of the octave memory counting circuit 520 via the OR gate 180, AND gate 255 and line 256. Simultaneously, the output "1" of the AND gate 174 is applied to the adder 120 for more significant bits (a full adder of 3 inputs) via an AND gate 260 enabled by the random mode selection signal RA and a line 261. Accordingly, data "11" is added to contents of the 2-bit adders 119 and 120 during the downcounting mode and this means substraction of 1 (i.e. "01") from the 2-bit stored data concerning the specific channel. Consequently, values of the octave instruction signal $OCTV_1$ and $OCTV_2$ concerning the channel decreases by 1 and the octave slide amount designated by the octave change designation signals FF and VF is lowered by one octave.

In the foregoing manner, the octave memory counting circuit 520 conducts addition and subtraction individually with respect to each of the channels in a time sharing manner.

The signals $OCTV_1$, $OCTV_2$ outputted respectively from the shift registers 123 and 124 of the octave memory counting circuit 520 are applied to the octave comparison circuit 53 via delay flip-flops 262 and 263. These signals are then inverted by the inverters 195 and 197 and thereafter are applied to the adder 188 via the AND gates 191 and 192 and the OR gates 224 and 225. The AND gates 191 and 192 are enabled by the random mode selection signal RA. In the octave comparison circuit 53, the values of the signals $OCTV_2$ and $OCTV_1$ stored in the octave memory counting circuit 520 representative of the octave slide amount of the octave now being played are subtracted from the values of the octave slide amount set signals "$OSE_2$, $OSE_1$" and, when the present octave slide amount coincides with the set octave slide amount, the octave coincidence signal OSEQ is produced. When the present octave slide amount becomes 0, the octave slide amount 0 detection signal ZR is delivered from the AND gate 226. Since there is a total delay of 12 μs from the time when the count input is applied to the adders 119 and 120 of the octave memory counting circuit 520 via the lines 256 and 261, i.e. 10 μs through the 10-stage shift registers 123 and 124, 1 μs through the delay flip-flops 262 and 263 and 1 μs through the flip-flop 200 or 264 which is delayed by the signal OSEQ or ZR, the channel times of the input and output signals of the octave rise-fall control circuit 54 are in complete synchronization.

UP MODE

The up-down control memory 87 is cleared to 0 by the up mode selection signal UM applied via the NAND gate 213 and, accordingly, the upcounting instruction signal U from the inverter 208 is always "1" and the downcounting instruction signal D is always "0" in the octave rise-fall control circuit 54. When the present octave slide amount coincides with the set octave slide amount, the AND gate 175 delivers a signal "1" of a 1 μs width to a NAND gate 265 upon receipt of the tone production timing pulse TEP'. Since the NAND gate 265 receives as its other input the randum mode selection signal RA which is "1", the output of the NAND gate 265 becomes "0" with a width of a 1 μs in correspondence to the channel in which the tone production timing pulse TEP' is produced, thereby disenabling the AND gates 258 and 259. Accordingly, the storage in the channel in the octave memory counting circuit 520 corresponding to the channel in which the tone production timing pulse TEP' is produced is cleared to 0 whereby the octave instruction signals $OCTV_1$, $OCTV_2$ concerning this channel becomes "00". As the octave slide amount returns to the original one in the above described manner, the octave range in which tone production is made returns to the original octave range. When the tone production timing pulse TEP' is again produced at the specific channel time, a count 1 is added to the contents in that channel in the octave memory counting circuit 520.

In sum, each time the tone production pulse TEP' is produced at a certain channel, a tone pitch of a depressed key assigned to that channel is raised by one octave and when the octave has changed by a predetermined amount, the octave returns to an initial one to which the tone of the depressed key belongs. In the random mode, such octave-by-octave rise of the tone pitch (and repetition thereof) is realized individually with respect to each depressed key (i.e., with respect to each tone production channel). Accordingly, a timing at which the octave changes (i.e. timing at which the tone production timing pulse TEP' is produced differs one tone from another i.e. the channel from another (though somtimes it may coincide). This is because frequency dividing of the basic tempo clock pulse CPL in the frequency dividing circuit 45 (FIG. 8) proceeds individually with respect to each channel in the randum mode. If, accordingly, time at which key depression starts is different, time at which counting in a corresponding channel in the frequency dividing circuit 45 starts is also different and the tone production timing pulses TEP' in the respective channels therefore are produced at different times.

TURN MODE

In the turn mode, the turn mode selection signal TM is "1" and, when a present octave slide amount has amounted to a set octave slide amount (i.e., OSEQ="1") in upcounting (i.e. U="1"), the AND gate 176 (FIG. 9) is in an operable state. Upon receipt of the tone production timing pulse TEP' the AND gate 176 delivers out a signal "1" of a 1 μs width which is applied to the adder 204 of the up-down control memory 87 via the OR gate 206 and the line 205. Storage of the memory 87 corresponding to a channel in which the tone production timing pulse TEP' is produced thereby is turned to "1", instructing downcounting. The AND gate 174 is now brought into an operable state and, upon generation of a next tone production timing pulse TEP', a count 1 is subtracted from contents in the particular channel of the octave memory counting circuit 520. Subsequently, subtraction is likewise conducted each time the tone production timing pulse TEP' is produced. The octave slide amount therefore gradually decreases and the tone pitch falls by one octave each at each pulse TEP'.

When the octave slide amount has reached 0 (i.e. ZR="1") in the downcounting mode (D="1"), the AND gate 177 is brought to an operable state and, upon generation of the tone production timing pulse TEP', the AND gate 177 delivers a signal "1" to the up-down control memory 87 for adding "1" to the stored contents "1" of the particular channel in the up-down control memory 87. The contents of the channel in the memory 87 thereby are turned to "0", thus instructing upcounting. Accordingly, the AND gate 173 delivers out an output "1" upon receipt of a next tone production timing pule TEP' and a count "1" in added to the contents of the particular channel in the octave memory counting circuit 520. Subsequently, the addition is repeated in the same manner each time the tone production timing pulse TEP' is produced and the tone pitch rises by one octave at each pulse TEP'.

Thus, the chord pyramid performance in the turn mode in the random mode in which tone production is made at a predetermined interval To with respect to each channel with a tone pitch rising and falling octave by octave and such rising and falling of the tone pitch on the octave basis is repeated is conducted.

If the tone production timing pulse TEP' is produced during occurrence of the octave coincidence detection signal OSEQ which is produced in an octave range in which a turning point between rise and fall of the tone pitch is located or during occurrence of the octave slide amount 0 detection signal ZR, the counting mode is changed but contents of the octave memory counting circuit 520 remain unchanged (i.e., the AND gates 173 and 174 are not enabled). Accordingly, a tone in the same octave (i.e. the highest octave and the lowest octave to which the tone of the depressed key belongs) is produced twice at the turning point (FIG. 2).

In the random mode, frequency division of the clock pulse CPL in the frequency dividing circuit 45 proceeds individually for each of the channels so that difference in time at which the tone production timing pulse TEP' for each channel is produced corresponds to difference in time at which depression of keys assigned to the respective channels is started. Accordingly, the octave of keys ($D_3$, $G_3$ and $B_3$) assigned to the respective channels is changed while difference in time ($T_1$, $T_2$) at which depression of the keys assigned to the respective channels is started is maintained. Consequently, in the random mode, the chord pyramid performance is conducted with desired tone production intervals ($T_1$, $T_2$, . . . ) being maintained by differentiating a starting time of key depression of the respective keys.

SETTING OF WAITING TIME

A typical performance according to the chord pyramid performance in the regular mode will be to depress a plurality of keys on the lower keyboard (the keyboard for the chord pyramid performance) simultaneously in a chord form and produce tones associated with these depressed keys one by one (in an arpegio manner) by operation of the chord pyramid device 12. A performer may sometimes desire a performance in which the tone pitch is changed in such a manner that tones associated with a plurality of keys depressed on the lower keyboard are simultaneously produced and the tone pitches of these simultaneously produced tones are changed octave by octave. This latter form of performance can be realized by the chord pyramid performance in the random mode.

If the above described performance is desired, a plurality of keys must be simultaneously depressed. There is, however, limitation in precision in term of time achieved in depression of keys by human fingers and it can hardly be expected that a plurality of keys are depressed "simultaneously" in the strict sense of the term (i.e. to a degree of microseconds ($10^{-6}$ sec). Depending upon difference in the length of fingers and other factors, there occurs difference of more or less 10 ms ($10^{-3}$ sec.) in the key depression time beteen the respective depressed keys. In other words, the time difference of more or less 10 ms is perceived as the same time by the human sense. In the electronic musical instrument according to the invention, particularly in the chord pyramid device 12, signals are distinguished and processed in the order of 1 μs. Accordingly, time difference produced by the key depression which the performer intended to be made simultaneously will be introduced in the device as difference in time of key depression. MOre specifically, if plural keys are depressed in what the performer intended to be a simultaneous operation, that is, with a difference of more or less 10 ms between depression of each key, the electronic musical instrument, particularly the chord pyramid device 12, will respond as if there keys had been depressed at different times and a chord pyramid performance which the performer expected will be achieved by depressing the keys simultaneously cannot be realized. If, for example, the performer desires to play the chord pyramid performance by depressing three keys of $D_3$, $G_3$ and $B_3$ simultaneously and thereby producing tones in the order of $D_3$, $G_3$, $B_3$, $D_4$, $G_4$, $B_4$ . . . in the regular mode and the key for $B_3$ has been detected first, the chord pyramid counter 42 will operate before the keys for $D_3$ and $G_3$ have been detected resulting in production of tones in the order of $B_3$, $B_4$, $D_5$, $G_5$, $B_5$ . . ., which is quite disorderly and contrary to the chord pyramid performance expected by the performer. For avoiding occurrence of such inconvenience, the waiting time setting circuit 46 is provided.

The waiting time setting circuit 46 functions to set a waiting time equivalent to a duration of time which is perceived as the "same time" to the human sense (e.g., more or less 10 ms) from detection of the first depressed key and prohibit operations of the component circuits of the chord pyramid device 12 during this waiting time. Since all of the keys depressed substantially simultaneously are detected during this waiting time, signals (key codes $N_1$–$N_4$, $B_1$–$B_3$, $K_1$, $K_2$ attack start signal AS, decay start signal DS etc.) concerning all of the depressed keys start to be produced with a time unit of microseconds upon the lapse of the waiting time as if these keys had been depressed precisely simultaneously.

In FIG. 8, when no key is being depressed on the lower keyboard for the chord pyramid performance, the output of the shift register 72 for storing the lower keyboard key depression signal $LE \cdot \overline{DS}$ for twelve channels is "0" and the output of the OR gate 73 is also "0". Accordingly, the output of the inverter 228 is "1" and a reset signal is supplied to the waiting time counter 81 in the waiting time setting circuit 46 and to delay flip-flops and 268 and 269 via an OR gate 267. Upon detection of the first depressed key, the lower keyboard key depression signal $LE \cdot \overline{DS}$ is applied from the AND gate 68 (FIG. 7) to the OR gate 73. The lower keyboard key depression signal $LE \cdot \overline{DS}$ thereafter is stored in the shift register 72 and the all outputs of the 12-stages thereof are applied to the OR gate 76. The output of the OR gate 73 therefore is a signal "1" in a DC manner, that is, continuously. Accordingly, the output of the OR gate 267 is turned to "0" through the inverter 728 (Outputs of AND gates 270 and 271 to be described later which are also applied to the OR gate 267 are normally "0") and the reset signal thereby disappears. A predetermined waiting time is counted by counting the waiting time setting clock pulse TC by the counter 81 from the time when the counter 81 is released from resetting. The clock pulse TC is rectified into a pulse of a 12 μs width by a differentiating circuit consisting of delay flip-flops 269 and 272, an inverter 373 and an AND gate 274 and thereafter is selected by a portion of only 1 μs through an AND gate 274 at the timing of the system clock pulse $SY_1$. The clock pulse TC thus rectified into a pulse of 1 μs width and delivered out of the AND gate 274 is applied to the count input of the counter 81. The counter 81 counts the clock pulse TC and, when values of less significant five bits $Q_1$–$Q_5$ have all amounted to "1", this state is detected by an AND gate 275. Accordingly, the output of the AND gate 275 becomes "1" when $2^5-1=31$ shots of the clock pulse TC have been applied to the counter 81 from release of the counter 81 from resetting.

The output "1" of the AND gate 275 is applied to the delay flip-flop 268 via an OR gate 276 and stored therein. The storage of the flip-flop 268 is self-held through the output line 229 and the OR gate 268. As the storage of the flip-flop 268 becomes "1", the waiting time setting reset signal WR falls to "0" and the inverted signal $\overline{WR}$ thereof builds up to "1". In the foregoing manner, a waiting time of a duration of substantially the period of the clock pulse TC multiplied by 31 is set. The reset signal WR is "1" during the waiting time and main operations of the chord phyramid device 12 are inhibited by maintaining various counters, flip-flops and memories in a reset state. The operations of the component circuits of the chord pyramid device 12 after completion of the waiting time have already been described.

ENDING OF THE CHORD PYRAMID PERFORMANCE

As will be apparent from the foregoing description, the lower keyboard key depression signal $LE\cdot\overline{DS}$ is generated at a corresponding channel time as long as a key is being depressed on the lower keyboard and the tone production timing pulse TEP is regularly generated. In response to the pulse TEP, the tone production control clear signals CCF and CCV of a 1 μs width are produced and the octave slide control (i.e. rise or fall of the tone pitch octave by octave) is effected. Thus, the rise or fall of the tone pitch ranging over one or more octaves in the chord pyramid performance in the regular mode or the random mode is repeated.

For ending such chord pyramid performance, depression of the key is released. Upon release of the key, the decay start signal DS becomes "1" and the lower keyboard key depression signal $LE\cdot\overline{DS}$ becomes"0", thereby ceasing production of the clear signals CCF and CCV of a 1 μs width. Accessing of the address is continued in the envelope generation circuits 28 and 27 (FIG. 3) for reading the envelope signals $EV_1$ and $EV_2$ (the attack start signal AS is still "1") and, upon reaching the final address, the decay finish signal DF is generated (AND gate 35) due to existence of the decay start signal DS. This signal DF causes the attack start signal As to become "0", thereby stopping application of the clock pulse to the envelope counter. Further, the clear signal CC is produced by the tone production assignment circuit 15 for clearing various storages concerning the particular channel in the electronic musical instrument. Tone production in the channel is thereby ended completely. In the envelope generation circuit 27 in the filter system producing the envelope signal $EV_2$ for the sustained tone, arrangements may be made so that an envelope signal of a suitable decay waveform may be produced for ending the tone production.

The clear signal CC produced in response to the decay finish signal DF is applied to a portion shown in FIG. 10 in the chord pyramid device 12. The clear signal CC is applied to an AND gate 278, an inverter 279 and AND gates 280 and 281 via a 2-stage shift register 277 provided for synchronizing timing.

In the regular mode, the clear signal CC disenables the AND gate 158 by application thereto of the output "0" of the inverter 279 and clears the signal "1" self-held in the shift register 155 for sustaining the filter system chord pyramid tone, thereby ending the tone production.

In the randum mode or playing of an upper keyboard tone or a pedal keyboard tone, the output of the NAND gate 250 (FIG. 10) is "1" and the AND gate 278 is in an operable state. Upon production of the clear signal CC, the clear signal CC becomes the clear signals CCF and CCV through the AND gate 278, and OR gates 140 and 144. Since at this time the clock pulse is not supplied to the envelope counters of the envelope generation circuits 27 and 28, the contents of the envelope counters are simply cleared to 0 by the clear signals CCF and CCV.

In a case where the chord pyramid performance is not made (i.e. CPP,CPV="0"), or in the randum mode, or in a case where the chord pyramid performance is temporarily stopped by a chord pyramid start stop signal CPS, the outputs of the AND gates 139 and 143 are "0", whereby AND gates 280 and 281 are in an operable state through inverters 282 and 283. Upon generation of the clear signal CC, the clear signals CCF and CCV are produced through the OR gates 140 and 144 whereby the contents of the envelope counters are cleared to 0.

A CASE WHERE A DEPRESSED KEY IS CHANGED IN LEGATO FORM (1) In a case where a depressed key is changed in legato form, if the performer desires to stop progress of a preceding chord pyramid performance (i.e. rise or fall of the tone pitch and the octave slide) and start a new chord pyramid performance from the lowest tone in an octave range to which the depressed key belongs, an option switch 284 (FIG. 6) is opened to turn a continuation possible signal OP on a line 285 to "0". Alternatively, the option switch 284 is omitted so that the signal on the line 285 is always maintained at "0".

The change of a depressed key in legato form means a form of key depression operation according to which all depressed keys except at least one are released in the chord pyramid performance which has been started by simultaneously depressing plural keys and then other keys are depressed newly while the unreleased old key or keys are continuously depressed.

An AND gate 286 (FIG. 8) in the chord pyramid start-stop control unit 75 is a circuit provided for detecting change of key depression in legato form. A signal applied to the AND gate 286 from the waiting time counter 81 through a line 287 represents that any key which has been depressed previously is still being depressed. The output signal of the inverter 233 and the lower keyboard key depression signal $LE\cdot\overline{DS}$ applied to the other inputs of the AND gate 286 represent depression of a new key.

As was described above, when any key is initially depressed in a state where no key has been depressed on the lower keyboard, the waiting counter 81 operates. When data of less significant five bits all becomes "1" in the waiting time counter 81 which is a binary counter of 7 bits, the waiting time ends and tone production is started. Since, however, the clock pulse TC is supplied to the counter 81 so long as the AND gate 274 is in an operable state, counting in the counter 81 is continued even after ending of the waiting time. As data of the most significant bit $Q_7$ in the counter 81 becomes "1", the output of the inverter 288 becomes "0" thereby disenabling the AND gate 274. Since the output of the OR gate 73 is always "1" in a DC manner as long as any key is being depressed on the lower keyboard, the counter 81 is not reset and data of the most significant bit $Q_7$ is maintained at "1". Accordingly, a signal "1" on the line 287 on which the output of the most significant bit $Q_7$ of the counter 81 is provided represents that any key has been previously depressed and is still being depressed.

The channel of the lower keyboard key depression signal $LE \cdot \overline{DS}$ applied to the shift register 72 (FIG. 8) coincides with that of a signal appearing on the output line 80 of the final stage of the shift register 72. The signal on the line 80 represents a past state at 12 μs before of the input signal to the shift register 72. Accordingly, as a new key has been depressed and tone production for the new key has been assigned to a certain channel, the signal on the line 80 representing a signal of the particular channel in a state of 12 μs before is "0" when a first key depression signal $LE \cdot \overline{DS}$ has been generated at the particular channel time and applied to the shifts register 72. When the first key depression signal $LE \cdot \overline{DS}$ has reached the final stage of the shift register 72 12 μs later, the signal on the line 80 becomes "1". Accordingly, there occurs a state in which the signal on the line 80 is "0" and the signal $LE \cdot \overline{DS}$ is "1" only during 1 μs in the initial stage of the key depression in that channel. The signal on the line 80 is inverted to "1" by an inverter 233 and, accordingly, there occurs a state in which both the output of the inverter 233 and the signal $LE \cdot \overline{DS}$ are "1" simultaneously only during 1 μs in the initial state of the key depression assigned to the channel. This state represents that the new key has been depressed.

The AND gate 286 is therefore enabled upon change of a depressed key in legato form and a signal "1" is applied to a delay flip-flop 290 via an OR gate 289 and self-held in the flip-flop 290. An output "1" of the flip-flop 290 is applied to the AND gate 271 and also to an inverter 292 in FIG. 7 via a line 291 as a legato form depressed key change signal CHK. The output of the inverter 292 thereupon becomes "0" and disenables the AND gate 105. Accordingly, in the change of a depressed key in the legato form, the tone production timing pulse of a 1 μs width provided by the AND gate 149 is inhibited by the AND gate 150 and no tone production timing pulse $TEP_1$ is supplied to the circuits of the chord pyramid system control unit 71 (FIG. 7). Instead, the tone production timing pulse $TEP_2$ of a 1 μs width delivered from the AND gate 149 is applied to an OR gate 294 (FIG. 8) and AND gate 271 via a line 293.

The AND gate 271 is ready for operation by receiving the regular mode selection signal RE and the output of the delay flip-flop 290 and, upon receipt of the tone production timing pulse $TEP_2$ from the line 293, outputs a signal "1". This signal "1" is applied to the waiting time counter 81 and the delay flip-flops 268 and 269 via the OR gate 267 to reset the counter 81 and flip-flops 268 and 269. The pulse $TEP_2$ on the line 293 is also applied to the reset input of the delay flip-flop 290 via the OR gate 294 thereby causing the output of the flip-flop 290 to fall to "0" 1 μs later. This disenables the AND gate 271 and the counter 81 and the flip-flops 268 and 269 are reset during 1 μs and thereafter are released from resetting. This enables the AND gate 274 of the waiting time setting circuit 46 and, as a result, the clock pulse TC rectified into a pulse of a 1 μs width is applied to the counter 81. Further, by resetting of the flip-flop 268, the waiting time setting reset signal WR builds up to "1" through the inverter 295.

As the waiting time setting reset signal WR becomes "1", the chord pyramid counter 42, coincidence code memory circuit 95, delay flip-flops 96–98, octave counter 52, up-down control memory 87 etc. are reset and the chord pyramid device 12 is brought into the waiting mode. Upon the lapse of the waiting time, the signal WR falls to "0" and the chord pyramid performance in the regular mode is newly started. Accordingly, the counting operations of the chord pyramid counter 42 and the octave counter 52 concerning the preceding chord pyramid performance are interrupted and tone production is started from the lowest tone and the octave slide is started from the octave slide amount 0 in the new chord pyramid performance.

Figure 16:
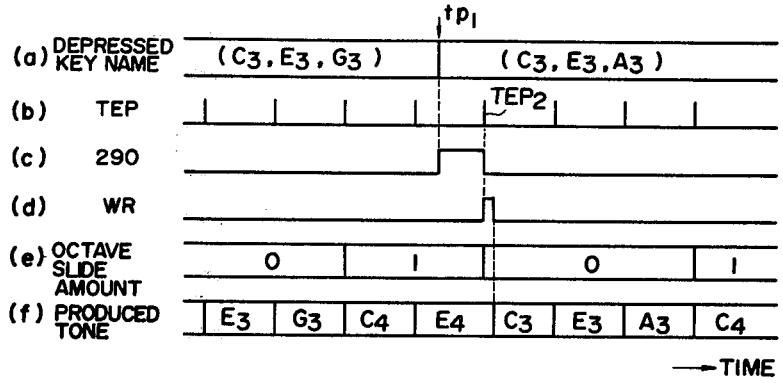
FIGS. 16(*a*) through 16(*f*) are a time chart for macroscopically explaining an operation for interrupting a preceding chord pyramid performance and starting a new chord pyramid performance during the variation in key depression in the legato form.

For a better understanding of the above explained operation, description will be made with reference to FIGS. 16(*a*) through 16(*f*). FIG. 16(*a*) shows an example in which a preceding chord pyramid performance is conducted on the basis of depression of $C_3$, $E_3$ and $G_3$ keys and the $G_3$ key is changed to an $A_3$ key at a time point of $t_{p1}$ while the $G_3$ and $E_3$ keys are kept depressed. FIG. 16(*b*) shows timing of generation of the tone production timing pulse TEP. FIG. 16(*c*) shows contents of the delay flip-flop 290 (FIG. 8) in which a signal "1" is stored upon detection of the change of a depressed key in the legato form at the time point $t_{p1}$ and this storage is reset in response to the tone production timing pulse $TEP_2$ FIG. 16(*d*) shows the waiting time setting reset signal WR. FIG. 16(*e*) shows a present octave slide amount designated by the count of the octave counter 52 (FIG. 9). FIG. 16(*f*) shows note names of tones produced in accordance with the tone production timing pulse TEP. In a case where performance of tones is proceding in the order of $C_3 \rightarrow E_3 \rightarrow G_3 \rightarrow C_4 \rightarrow E_4 \ldots$, if change of a depressed key in the legato form takes place during production of the $E_4$ tone, the tone production is not made at a next occurence of the tone production timing pulse $TEP_2$ and the respective circuits are reset by the reset signal WR. Then, a new chord pyramid performance is started upon the lapse of the waiting time with performance of tones proceeding in the order of $C_3 \rightarrow E_3 \rightarrow A_3 \rightarrow C_4$.

In the change of a depressed key in the legato form, an initial key depression pulse LKDP (FIG. 8) is not produced and, accordingly, the initial key depression reset signal KONR is not produced. The frequency dividing circuit 45 (FIG. 8) therefore is not reset and the timing of generation of the tone production timing pulse TEP is not changed (FIG. 16(*b*)). Accordingly, in shifting from a preceding chord pyramid performance to a new chord pyramid performance, the interval T of tone production is not changed and the tone production timing is not affected.

(2) In a case where a new chord pyramid performance is made without stopping a preceding chord pyramid performance (i.e. rise or fall of the tone pitch and the octave slide) in the change of a depressed key in the legato form, the option switch 284 (FIG. 6) is closed and the continuation possible signal OP on the line 285 (FIg. 8) is turned to "1".

Figure 17:
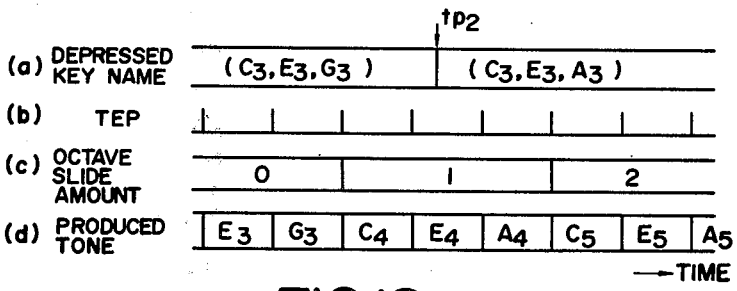
FIGS. 17(*a*) through 17(*d*) are a time chart for explaining a control operation for conducting a new chord pyramid performance in addition to a preceding chord pyramid performance during the variation in key depression in the legato form.

The continuation possible signal "1" is applied to the delay flip-flop 290 via the line 285 and the OR gate 294 to reset the delay flip-flop 290. Accordingly, a signal "1" is not stored in the flip-flop 290 even if the change of a depression key in the legato form is detected. If accordingly, the change of a depressed key in the legato form is made at a time point $t_{p2}$ as shown in FIG. 17(*a*), the waiting time setting circuit 46 does not operate and the reset signal WR is not produced. The initial key depression signal KONR is not produced either. Consequently, the chord pyramid counter, 42 the octave counter 52, the frequency dividing circuit 45 and the up-down control memory 87 etc. continue operations performed in the preceding chord pyramid performance. ASsume that at the time point $t_{p2}$, the octave slide amount is 1 (FIG. 17(*c*)) and an $E_4$ tone which is one octaye higher than the $E_3$ tone is produced. At a next tone production timing pulse TEP (FIG. 17(*b*)), the chord pyramid counter 42 counts up from a value corresponding to a key code of the $E_3$ tone. Since the key for the $A_3$ tone instead of the $G_3$ tone has already been depressed, the coincidence signal CON is produced for the key code of the $A_3$ tone and an $A_4$ tone which is one octave higher is produced.

As described in the foregoing, by always resetting the delay flip-flop 290, a new chord pyramid performance can be initiated while rise or fall of the tone pitch and the octave slide in a preceding chord pyramid performance are continued.

PERFORMANCE CONTROL BY OPERATION OF A FOOT SWITCH

A foot switch 134 (FIG. 6) is used for stopping the chord pyramid performance while playing a manual keyboard. Since the chord pyramid selection switches 57 and 58 (FIG. 6) cannot be manipulated while playing a manual keyboard, the foot switch 134 is required.

Upon closing of the foot switch 134, a foot switch signal $\overline{FS}$ is turned to "0" and this signal is inverted to "1" by an inverter 296 in FIG. 8. The output of the inverter 296 is applied to a delay flip-flop 299 and an AND gate 300 via a 2-stage shift register 297 whose contents are shifted by whose contents are shifted by the main clock pulse $\phi_1$. These circuits 298, 299 and 300 constitute a differentiating circuit which produces a differentiated pulse of a 1 μs width during closure of the foot switch 134. The AND gate 300 is ready for operation when the output of the inverter 301 is "1". The inverter 301 receives an output $\overline{CPSS}$ of a chord pyramid start stop switch 302 (FIG. 6). Upon closing of the switch 302, the signal $\overline{CPSS}$ becomes "0" and the output of the inverter 301 becomes "1". The AND gate 300 is now ready for operation and, upon closing of the foot switch 134, the AND gate 300 gates out a pulse of a 1 μs width to a set input of a flip-flop 303.

As the flip-flop 303 is set by closing of the foot switch 134, an inverter output $\overline{Q}$ of the flip-flop 303 becomes "0" and the chord pyramid start-stop signal CPS on the line 133 thereby becomes "0". The signal "0" on the line 133 is inverted to "1" by an inverter 304 and applied to an OR gate 305 of the chord pyramid start stop control unit 75 and also to the AND gate 270 of the waiting time setting circuit 46. The AND gate 270 which receives the regular mode selection signal RE is enabled by the output "1" of the inverter 304 and the counter 81 and the flip-flops 268 and 269 are reset by the signal gated through the AND gate 270 and the OR gate 267. Accordingly, the reset signal WR becomes "1" and the counters 42, 52 and 87 and the flip-flops in the chord pyramid device 12 are thereby reset. The output "1" of the OR gate 305 is inverted by the NOR gate 83 and delivered on a line 306 of the initial key depression reset signal KONR to reset the frequency dividing circuit 45, the octave memory counting circuit 520 etc. An initial clear signal IC applied to the OR gate 305 is used for once clearing contents of the respective circuits upon turning on of the power switch of the electronic musical instrument.

The chord pyramid start-stop signal CPS which has become "0" is applied to the AND gate groups 127 and 130 of the octave encoder 125 and the AND gates 139 and 143 in FIG. 10 via the line 133, thereby disenabling these AND gates. Accordingly, the clear signals CCF and CCV of a 1 μs width for tone production are not produced and the octave change designation signals FF and VF become of contents representing the octave slide amount 0.

As described in the foregoing, the chord pyramid performance is stopped by operation of the foot switch 134. The output "0" of the flip-flop 303 becomes a stop lamp signal CPSL via an inverter 307 (FIG. 8) which is used for lighting a lamp 308 (FIG. 6) indicating that the chord pyramid performance has been stopped by the foot switch 134. The foot switch 134 is capable of stopping the chord pyramid performance only during closing of the chord pyramid start-stop switch 302.

The stop lamp signal CPSL is applied to the envelope generation circuit 28 (FIG. 3) of the harmonics synthesizing system musical tone forming system 10 and the characteristic of the envelope shape read from the envelope memory is thereby changed to a sustain tone shape, though this is not particularly illustrated. The envelope memory 29 stores a plurality of envelope shapes such, for example, as a decaying tone envelope shown in FIG. 5(*a*) and a sustain tone envelope, one of these envelope shapes being read out in response to the output of the envelope counter 30. During the chord pyramid performance, the decaying tone envelope shown in FIG. 5(*a*) is read out and, upon turning of the stop lamp signal CPSL to "1", the envelope shape is changed to the sustain tone envelope.

A synchronizing and start signal $\overline{SS}$ is "0" when a normally closed start switch 309 (FIG. 6) is closed and a normally opened synchronizing switch 310 is closed. This signal $\overline{SS}$ which is "0" is inverted to "1" by an inverter 311 (FIG. 8) and thereafter is applied to an AND gate 312. The AND gate 312 receives as its other input a lower keyboard key depression indication signal LKD delivered from the OR gate 73 and inverted by an inverter 313. Accordingly, the output of the inverter 313 becomes "1" upon release of all keys on the lower keyboard and a reset signal is applied to the flip-flop 303 via the AND gate 312 and the OR gate 314. The chord pyramid performance having been stopped by operation of the foot switch 134 is thereby resumed. Consequently, if a state in which the signal $\overline{SS}$ is "0" created by closing the start switch 309 and the synchronizing switch 310, the stopping of the chord pyramid performance by the foot switch 134 can be cancelled and the chord pyramid performance can be resumed by releasing all of the depressed keys and depressing a new key.

If the signal $\overline{CPSS}$ is turned to "1" by opening the chord pyramid start-stop switch 302, the flip-flop 303 is reset through the inverters 301 and 315 and the OR gate 314 and stopping of the chord pyramid performance is thereby cancelled. If the chord pyramid selection switches 57 and 58 are opened and the output of the OR gate 92 becomes "0", the flip-flop 303 is reset through the inverter 316 and the OR gate 314. The flip-flop 303 is also reset by the initial clear signal IC.

In the regular mode, when the stopping of the chord pyramid performance has been cancelled by the operation of the foot switch 134, tone production is made in response to fall of the reset signal WR from the waiting time setting circuit 46. In the randum mode, when the stopping of the chord pyramid performance has been cancelled by the operation of the foot switch and the output of the flip-flop 303 (signal CPS) has risen from "0" to "1", a differentiating circuit consisting of a delay flip-flop 317 of the randum mode tone production control circuit 47 (FIG. 8), a delay flip-flop 318 for delivering an inverted output and an AND gate 319 produces a pulse of a 12 μs width. This pulse is applied to an AND gate 320 from the AND gate 319. The AND gate 320 outputs a pulse of a 1 μs width at the channel time of the lower keyboard key depression signal LE·$\overline{DS}$ supplied to the AND gate 320 through a line 321. This output of the AND gate 320 is applied to the AND gates 238 and 239 via the OR gate 237 and one shot of the randum mode clear signal RAF or RAV of a 1 μs width is produced in response to the chord pyramid selection signal CPF or CPV and at the channel time of the assigned key.

Accordingly, upon cancellation of stopping of the chord pyramid performance, whether it is in the regular mode or randum mode, the first tone of the chord pyramid performance is immediately produced if a key is being despressed on the lower keyboard at that time. Upon lapse of a predetermined time T (or To) thereafter, the tone production timing pulse TEP is generated by the frequency dividing circuit 45 and the second tone is thereby produced.

CHORD TONE PRODUCTION SIGNAL CG

The automatic accompaniment apparatus 36 (FIG. 3) capable of performing an automatic bass performance and an automatic chord performance (i.e. simultaneous playing of chord tones) generates a chord tone production signal CG which represents a timing of producing the chord tones. This signal CG becomes the filter system clear signal CCV through the circuit portion shown in FIG. 10 of the chord pyramid device 12. The signal CCV is applied to the filter system musical tone forming system 11. As was previously described, the electronic musical instrument of the present embodiment is so constructed that the chord pyramid tones are produced by the harmonics synthesizing system musical tone forming system 10 and the automatic accompaniment tones (chord tones) are produced by the filter system musical tone forming system 11 when the chord pyramid device 12 and the automatic accompaniment device 36 are simultaneously operated. For this reason, a wiring arrangement is made in such a manner that in a case where the automatic accompaniment performance is made by closing a performance start switch (not shown) of the automatic accompaniment device 36, the selection switch $\overline{CPV}$ will not be produced even if the chord pyramid selection switch 58 (FIG. 6) is closed. A detailed description of this wiring arrangement will however be omitted. In short, in a case where the chord tone production signal CG is supplied to the circuit shown in FIG. 10, the AND gates 143, 161 (FIG. 10) and 239 (FIG. 8) are disenabled.

Figure 18:
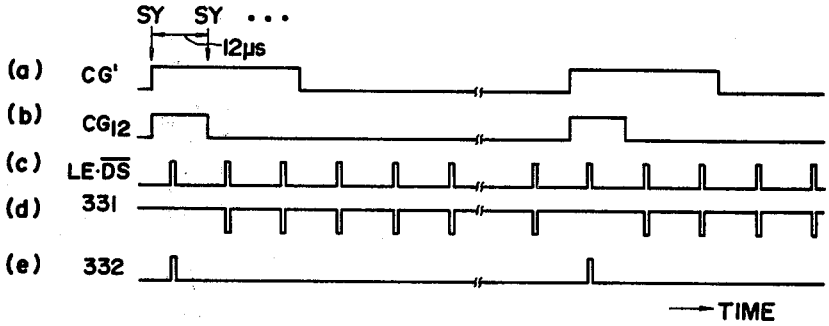
FIGS. 18(*a*) through 18(*e*) are a time chart for explaining an operation for converting a chord tone production timing signal CG to a filter system clear signal CCV in relation to the circuit portion in FIG. 10.

Referring to FIG. 10, the chord tone production signal CG is applied to a delay flip-flop 322 where it is rectified in its waveform at the timing of the system clock signal SY(pulses $SY_1$ and $SY_7$) (Signal CG' in FIG. 18(*a*)). The rectified signal CG' is applied to a delay flip-flop 323 of an inverted output type and an AND gate 324. The chord tone production signal CG therefore is rectified into a pulse of a 12 μs with and delivered out of the AND gate 324 (i.e. pulse $CG_{12}$ in FIG. 18(*b*)). The output CG' of the flip-flop 322 enables an AND gate 325 to gate out the lower keyboard key depression signal LE·$\overline{DS}$ (FIG. 18(*c*)) supplied from the circuit shown in FIG. 8 via a line 326. The gated out signal LE·$\overline{DS}$ is applied to a 12-stage shift register 328 via an OR gate 327. In the present embodiment, it is assumed that the automatic chord performance is conducted by depression of a key on the lower keyboard. Under a condition that the lower keyboard key depression signal LE·$\overline{DS}$ is present, the storage in the shift register 328 is self-held through an AND gate 329. The output of the shift register 328 is inverted by an inverter 330 and thereafter is applied to an OR gate 331. The OR gate 331 receives as its other input the chord tone production signal $CG_{18}$ rectified to a pulse of a 12 μs width and, accordingly, the OR gate 331 delivers out an output as shown in FIG. 18 (*d*). This output of the OR gate 331 is applied to an AND gate 332. Since the AND gate 332 receives as its other input the lower keyboard key depression signal LE·$\overline{DS}$, one shot of a pulse of a 1 μs width as shown in FIG. 18(*e*) is delivered out of the AND gate 332 at the channel time of the depressed key upon application thereto of the chord tone production signal CG. The output of the AND gate 332 is applied to the OR gate 145 via a delay flip-flop 333 provided for synchronizing timing and thereafter is delivered out of the shift register 142 as the filter system clear signal CCV. FIGS. 18(*c*) through 18(*e*) illustrate the respective signals with respect to one tone production channel only. In each of the channels to which tones constituting a chord are assigned, one shot of the clear signal CCV is generated in response to the chord tone production signal CG. In this manner, the chord pyramid performance (arpeggio) is conducted in the harmonics synthesizing system musical tone forming system 10 while the chord performance for producing chord tones is conducted in the filter system musical tone forming system 11.

GENERATION OF AN ASSOCIATED PERCUSSION SOUND

An associated percussion signal LR is produced by the circuit shown in FIG. 10 at the timing of production of the chord pyramid tones and an associated percussion sound is produced by the tone source 38(FIG. 3) in response to this signal LR.

In the regular mode, pulses produced by the AND gate 137 and 138 are applied to AND gates 334 and 335 and further applied to a shift register 337 via an OR gate 336. On the other hand, the randum mode clear signals RAF and RAV are applied to the OR gate 236 via the lines 240 and 241. A pulse of 1 μs width provided from the OR gate 336 to the shift register 337 is converted to a pulse of a 12 μs width via an OR gate 338 which combines all outputs of 12 stages of the shift register 337. This output pulse of the OR gate 338 is used to drive the tone source 38 as the associated percussion signal LR. Thus, the associated percussion sound is produced in synchronism with production of the chord pyramid tones. Further, the chord tone production signal $CG_{12}$ is also applied to the OR gate 336 via a line 339 thereby causing the associated percussion signal LR to be produced. The associated percussion sound therefore is produced also in synchronism with production of the chord tones. At an initial stage of depression of a key, the clear signal CC of a 1 μs width is produced by the tone production assignment circuit 15 and is applied to an AND gate 340 (FIG. 10). If the depressed key is one on the lower keyboard, the lower keyboard key depression signal $LE \cdot DS_1$ from the first stage of the shift register 72 in FIG. 8 is applied to the AND gate 340. A pulse of 1 μs width outputted thereupon and the AND gate 340 is applied to the OR gate 336 to produce the associated percussion signal LR. Accordingly, the associated percussion signal LR is not generated in response to the coincidence signal CON at the initial stage of the key depression. More specifically, the circuit is so contructed that when the coincidence signal CON appearaing just after release of resetting by the waiting time setting signal WR has been applied to a delay flip-flop 341 via an OR gate 342, the output of the flip-flop 341 becomes "1" 1 μs later thereby enabling the AND gates 334 and 335. Accordingly, output pulses of the AND gates 137 and 138 corresponding to the first appearing coincidence signal CON are inhibited by the AND gates 334 and 335. The storage of the delay flip-flop 341 is self-held through an OR gate 342.

TIMING SIGNAL GENERATION CIRCUIT

In the timing signal generation circuit 40 shown in FIG. 11, a chord pyramid tempo counter 343 counts a synchronizing clock pulse ROSC or a free clock pulse FOSC for producing the chord pyramid basic tempo clock pulse CPL. The chord pyramid tempo counter 343 comprises a 4-bit binary counter 344 and 1-bit binary counter 345 counting an output of the final bit (i.e. the fourth bit) of the counter 345 and a 6-bit counter 346 counting an output of a frequency dividing ratio switching circuit 347.

The frequency dividing ratio switch 347 switches the frequency dividing ratio of the 4-bit binary counter 344 either to one of modulo 16 or one of a modulo 12 and further switches the frequency dividing ratio of the 5-bit binary counter consisting of the counters 344 and 345 either to one of modulo 32 or one of modulo 24. More specifically, the frequency dividing ratio of the counter 344 is first switched either to the one of modulo 16 or the one of modulo 12 in accordance with a value of a switching signal $R_1$ and then the frequency divided output (i.e. modulo 16 or modulo 12) of the counter 344 or an output obtained by dividing the output of the counter 344 by two in the counter 345 (i.e. modulo 32 or modulo 24) is selected in accordance with a value of a switching signal $R_2$. When the switching signal $R_1$ is "1" ($\overline{R_1}$="0"), an AND gate 348 becomes operable. When the count of the counter 344($Q_4$, $Q_3$, $Q_2$, $Q_1$) becomes "1100", that is 12 in the decimal notation, the output of the AND gate 348 becomes "1". The output "1" of the AND gate 348 is applied through an OR gate 349 to the 4-bit counter 344 to reset it. Accordingly, the counter 344 becomes a counter of modulo 12, and a counter of modulo 24 combined with the counter 345 for a more significant, i.e. fifth, bit $Q_5$. If the switching signal $R_2$ is turned to "1" ($\overline{R_2}$="0") at this time thereby enabling an AND gate 350, the output of the counter 345 is selected and a frequency divided output of modulo 24 is provided on a line 353 via an OR gate 352. If the switch signal $R_2$ is turned to "0" ($\overline{R_2}$="1") thereby enabling an AND gate 351, the output of the counter 344 is selected and a frequency divided output of modulo 12 is provided on a line 353.

If the switching signal $R_1$ is turned to "0" ($\overline{R_1}$="1"), the AND gate 348 is disenabled so that the counter 344 becomes a counter of modulo 16. Accordingly, the frequency divided output of the counter 345 becomes of modulo 32. If the switching signal $R_2$ is "1" at this time, a frequency divided output of modulo 32 is provided on the line 353 via the AND gate 350. If the switching signal $R_2$ is "0", a frequency divided output of modulo 16 is provided on the line 353 via the AND gate 351. A frequency dividing ratio to be selected is determined by the kind of rhythm used in the chord pyramid performance. If a basic tempo is a rhythm of a triplet, the frequency divided output of modulo 24 or modulo 12 is obtained on the line 353 by turning the switching signal $R_1$ to "1". If the selected rhythm is of a slow tempo, the frequency divided output of modulo 24 is obtained by turning the signal $R_2$ to "1". Since one bar can contain four triplets of quarter note, the number 24 or 12 which is a common multiple of 3 and 4 convenient for phrasing produced tones. As the rhythm using a triplet, ballade, bolero and swing, for example, can be listed.

If the basic tempo is a rhythm of an ordinary note (e.g. an eight note), a frequency divided output of modulo 32 or modulo 16 is obtained on the line 353 by turning the switching signal $R_1$ to "0".

If the selected rhythm is of a slow tempo, the frequency divided output of modulo 32 is obtained by turning the signal $R_2$ to "1". Since a bar of four quarter notes can contain eight notes, the number 32 or 16 which is a common multiple of 4 and 8 is convenient for phrasing produced tones. As the rhythm of the ordinary note, march, jazz rock, tango and many other rhythms can be listed.

As a rhythm of a slow tempo using the slower frequency divided output of modulo 24 of modulo 32, ballad, waltz, swing and slow rock, for example, can be listed.

Relationship between the switching signals $R_1$, $R_2$ and the frequency dividing ratio and the tempo of rhythm is shown in the following Table 5:

Table 5

| $R_1$ | $R_2$ | Frequency dividing ratio | Tempo of rhythm | |
|---|---|---|---|---|
| 1 | 0 | modulo 12 | slow | triplet |
| 1 | 1 | modulo 24 | tempo | |
| 0 | 0 | modulo 16 | slow | ordinary note |
| 0 | 1 | modulo 32 | tempo | |

The frequency divided output selected in accordance with the kind of rhythm is applied to a count input of the counter 346 via the line 353 for further frequency dividing. A frequency divided signal outputted from the first stage (i.e. $Q_6$) of the counter 346 on a line 354 has a period twice as long as that of the signal on the line 353, a frequency divided signal outputted from the second stage ($Q_7$) on a line 355 has a period four times as long as that of the signal on the line 353, and a frequency divided signal outputted from the third stage ($Q_8$) on a line 356 has a period eight times as long as that of the signal on the line 353. If, accordingly, the periods of the signals provided on the lines 353–356 are represented by notes, the signal on the line 356 corresponds to a quarter note, the signal on the line 355 an eight note, the signal on the line 354 a sixteen note and the signal on the line 353 a thirty-two note, respectively.

A beat change circuit 357 is provided for selecting one of the signals on the lines 353–356 in response to a beat change signal $\overline{BT_1}$ or $\overline{BT_2}$. By closing a beat change switch 358 or 359 (FIG. 6), the beat change signal $\overline{BT_1}$ or $\overline{BT_2}$ is turned to "0". The logics of the circuit 357 are so arranged that the signals on the line 353–356 are selected as shown in the following TAble 6 in response to the signal $\overline{BT_1}$ or $\overline{BT_2}$ Table 6

| $\overline{BT_1}$ | $\overline{BT_2}$ | frequency divided signal line | Speed |
|---|---|---|---|
| 0 | 1 | 353 | |
| 0 | 0 | 354 | |
| 1 | 0 | 355 | |
| 1 | 1 | 356 | |

If, for example, the switches 350 and 359 are kept open, the signal on the line 356, i.e. a clock signal at a rate of a quarter note is selected. The output of the beat change circuit 357 is supplied to the chord pyramid device main body 39 (the circuit portion 44 in FIG. 8) as the chord pyramid basic tempo clock pulse CPL via a delay flip-flop 358 and a line 359. Accordingly, the rate (beat) of the basic tempo clock pulse CPL can be changed by operation of the switches 358 and 359.

The frequency dividing ratio switching signals $\overline{R_1}$ and $\overline{R_2}$ are generated in accordance with the kind or rhythm selected by a rhythm selection switch 360 (FIG. 6). These signals $R_1$ and $R_2$ are inverted to signals $\overline{R_1}$ and $\overline{R_2}$ by inverters 361 and 362 in FIG. 11.

Outputs of three more significant stages ($Q_9$, $Q_{10}$ and $Q_{11}$) of the counter 346 in the chord pyramid tempo counter 343 are combined by a NOR gate 363 and thereafter are applied to a NAND circuit 364. The final stage ($Q_{11}$) of the counter 346 produces an output obtained by frequency-dividing the output of the third stage ($Q_8$) corresponding to a quarter note by eight. The NOR gate 363 provided for varying duty factor of this output of the final stage ($Q_{11}$). Thus, the NOR circuit 363 produces a clock pulse with duty factor of $\frac{1}{8}$ which has a period eight times as long as that of the clock pulse on the line 356 corresponding to a quarter note. If the clock pulse on the line 356 is selected as the basic tempo clock pulse CPL, it will be frequency-divided by the frequency dividing circuit 45 (FIG. 8) by eight to become the tone production timing pulse TEP. Accordingly, the output clock pulse of the NOR gate 363 has a period of the same length as the tone production timing pulse TEP. The NAND gate 364 receives as its other input a chord pyramid selection signal CPON obtained by combining the outputs CPF and CPV of the chord pyramid selection switches 57 and 58 by an OR gate 365. When the chord pyramid performance is conducted, the signal CPON is "1".

The pulse with duty factor $\frac{1}{8}$ produced by the NOR gate 363 is inverted by a NAND gate 364 and applied to a one shot circuit 357 via a NAND gate 366. The one shot circuit 367 is a known differentiation circuit comprising a capacitor 368 and a resistor 369. One shot of pulse "1" with a predetermined pulse width is produced through an inverter 370 of the one shot circuit 367 in response to building up of the pulse with duty factor of $\frac{1}{8}$ outputted from the NOR gate 363. The output of the inverter 370 is applied to a tempo indication lamp 372 (FIG. 6) as a tempo indication pulse OTL to light the lamp 372 via a delay flip-flop 371 provided for synchronizing rise and fall of the pulse with the timing of the main clock $\phi_1$. Accordingly, the lamp 372 is lighted at each beat of a quarter note whereby the performer can recognize the basic tempo of the chord pyramid performance by watching lighting of the lamp 372.

If it is desired to synchronize the basic tempo of the chord pyramid performance with the basic tempo of the automatic accompaniment device 36 and the automatic rhythm playing device 37 (FIG. 3), a synchronizing-free selection switch 373 (FIG. 6) is closed to turn a signal $\overline{SM}$/FM to "0". If the signal SM/FM becomes "0" the output of an inverter 374 becomes "1" and a synchronized mode signal SM becomes "1". This synchronized mode SM enables an AND gate 375 to select the synchronizing clock pulse ROSC for using it as a count pulse for the chord pyramid tempo counter 343. In 8-stage rhythm counter 376 always counts the synchronizing clock pulse ROSC applied through a line 377 and the output of its final stage ($Q_8$) which is a result of frequency dividing the clock pulse ROSC by $2^8$ constitutes a basic tempo clock pulse TCL. This basic tempo clock pulse TCL is supplied to the automatic accompaniment device 36 and the automatic rhythm playing device 37 and used therein as the basic tempo clock pulse for producing rhythm of the automatic performance in these devices 36 and 37. In the synchronized mode, the chord pyramid counter 343 also frequency-divides the synchronizing clock pulse ROSC and a signal which has been frequency-divided by $2^8$ at the maximum is supplied to the chord pyramid device 12 via the line 356 and used in the device 12 as the basic tempo clock pulse CPL corresponding in length to a quarter note. Consequently, the basic tempos of the respective automatic performance sounds produced by the devices 12, 36 and 37 synchronize with one another.

If it is desired to set the basic tempo of the chord pyramid performance independently, the synchronizing-free selection switch 373 is opened to turn the signal $\overline{SM}$/FM to "1". The synchronized mode selection signal SM thereby is turned to "0" and the free mode selection signal FM to "1" via an inverter 378. Accordingly, AND gate 379 is enabled to select a free clock pulse FOSC which is applied to the chord pyramid tempo counter 343 via an OR gate 380 and used as a count pulse therefore.

The synchronizing clock pulse ROSC and the free clock pulse FOSC are oscillated by oscillators 381 and 382 (FIG. 6) which are adjustable in their oscillation frequency. The oscillated clock pulses ROSC and FOSC are rectified into pulses of a 12 $\mu$s width in a differentiation circuit consisting of delay flip-flops 383 and 384 and an AND gates 387 and a differentiation circuit consisting of delay flip-flops 385 and 386 and an AND gate 388 respectively and thereafter are applied to AND gates 375 and 379. Accordingly, the performer can adjust the basic tempo by adjusting the oscillators 381 and 382.

RESET CONTROL OF COUNTERS 343 AND 376

(a) Detection of depression of a key on the lower keyboard.

The keyboard code $K_1$, $K_2$ of the key code KC provided by the tone production assignment circuit 15 and the decay start signal DS are applied to the timing signal generation circuit 40. The code for the lower keyboard is $K_1=0$, $K_2=1$. The signal $K_1$ is inverted by an inverter 389 and thereafter applied to an AND gate 390 while the signal $K_2$ is directly applied to the AND gate 390. The decay start signal DS is "0" during depression of the key, so that this signal DS is inverted by an inverter 391 and applied to the AND gate 390. The AND gate 390 therefore produces a lower keyboard key depression detection signal at the channel time to which the depressed key on the lower keyboard is assigned. The output of the AND gate 390 is applied to a 12-stage shift register 392 and all outputs of the 12 stages of the shift register 392 are applied to an OR gate 393 to convert the lower keyboard key depression detection signal into a DC signal. Accordingly, when a key is being depressed on the lower keyboard, the output of the OR gate 393 is always "1".

The output of the OR gate 393 is applied to a 12-stage shift register 394 and an AND gate 395. A delayed signal of a 12 μs before is outputted from the final stage of the shift register 394. This signal is inverted by an inverter 396 and thereafter is applied to the AND gate 395. Accordingly, only when the output of the OR gate 393 has built up from "0" to "1", one shot of differentiated pulse is produced by the AND gate 395. This constitutes the initial key depression pulse LKDP of a 12 μs width.

(b) Counter resetting at the initial stage of key depression

The initial key depression pulse LKDP produced by the AND gate 395 is applied to an AND gate 398 via a delay flip-flop 397 provided for synchronizing a timing and also to an AND gate 400 via an OR gate 399. The AND gate 398 is enabled by the free mode selection signal FM and the AND gate 400 is enabled by the synchronizing mode selection signal SM. Accordingly, the initial key depression pulse LKDP is delivered out via and AND gate 398 or 400 at the initial stage of key depression, whether it is in the synchronizing mode or the free mode. This pulse LKDP is applied through an OR gate 401 and a reset line 402 to the chord pyramid tempo counter 343 (counters 344, 345 and 346) to reset it.

(c) Reset control between the automatic performance devices.

In the present invention, "synchronized mode" signifies control of start or stop of the performance by interaction between the chord pyramid device 12, the automatic accompaniment device 36 and the automatic rhythm playing device 37 etc. and synchronization of timing of the basic tempo clock. For implementing the synchronized mode, the synchronizing-free selection switch 373 is closed to turn the synchronized mode selection signal SM to "1" and thereby produce the chord pyramid basic tempo clock pulse CPL and the rhythm basic tempo clock pulse TCL from the same synchronizing clock pulse ROSC. For synchronizing start or stop of the various automatic performance devices, both the synchronizing switch 310 and the start switch 309 (FIG. 6) are closed to turn the synchronizing start $\overline{SS}$ to "0".

An AND gate 403 having 5 inputs becomes operable when the synchronizing start signal $\overline{SS}$ is "0" (SS="1"), the synchronized mode selection signal SM is "1" and the chord pyramid selection signal CPON is "1". The AND gate 403 receives at the other two inputs thereof an output of the OR gate 393 and a signal obtained by inverting the output of the OR gate 393 by a delay flip-flop 405 of 12 μs. During 12 μs from building up of the output of the OR gate 393 from "0" to "1", the output of the delay flip-flop 405 is "1". Upon the lapse of 12 μs, a rise signal is produced and inverted to "0".

Accordingly, if a key is depressed on the lower keyboard when the synchronized mode is set and the synchronizing start switch is closed in the chord pyramid performance, one shot of pulse of a 12 μs width is delivered from the AND gate 403 at the initial stage of the key depression.

The output of the AND gate 403 is applied through an OR gate 406 to a delay flip-flop 407 for synchronizing timing and resets the rhythm counter 476 via a reset line 408. The output of the AND gate 403 delivered through the delay flip-flop 407 is applied to the AND gate 400 via the OR gate 399, and is gated out of the AND gate 400 if it is in the synchronized mode (i.e. the signal SM is "1"). The output of the AND gate 400 is applied to the chord pyramid tempo counter 343 via the OR gate 401 and the reset line 402 to reset the counter 343. Accordingly, the counters 343 and 376 are stopped simultaneously and start counting simultaneously when a reset signal has disappeared. Consequently, starting and stopping of the basic tempo clock CPL used in the chord pyramid device 12 and the basic tempo clock TCL used in the automatic accompaniment device 36 and the automatic rhythm playing device 37 are in complete synchronism with each other.

In the above described manner, at the synchronized starting time in the synchronized mode, the various automatic performance devices 12, 36 and 37 are set to an operable state in synchronism with each other in accordance with start of key depression on the lower keyboard (i.e. these devices start in accordance with the clock pulses CPL and TCL which are in synchronization with each other).

When all depressed keys have been released, the output of the OR gate 393 becomes "0". This output "0" of the OR gate 393 is inverted to "1" by an inverter 409 and thereafter is applied to a NAND gate 410. The NAND gate 410 receives also the synchronized mode selection signal SM and the chord pyramid selection signal CPON. Upon release of the depressed keys, the output of the NAND gate 410 becomes "0". The output "0" of the NAND gate 410 is applied to a NOR gate 411. The NOR gate 411 receives as its other input the synchronizing start signal $\overline{SS}$. If accordingly, all of the depressed keys have been released during the chord pyramid performance (i.e. CPON is "1") and when the operation mode is set to the synchronized mode (i.e. SM is "1") and also to the synchronizing start (i.e. $\overline{SS}$ is "0"), the output of the NOR gate 411 becomes "1".

The output "1" of the NOR gate 411 is supplied through a delay flip-flop 412 provided for synchronizing timing to a 4-stage shift register 413 shifted by the system clock signal $SY(SY_1, SY_7)$ of a period of 12 μs and also to an AND gate 414. The output of the shift register 413 is applied to the AND gate 414 via an inverter 415. These circuit 413–415 constitute a differentiation circuit producing a pulse of a width of 48 μs at the building up of the output "1" of the OR gate 411.

As described in the foregoing, when the mode is set to the synchronized mode and the synchronizing start, one shot of pulse of a width of 48 μs is produced by the AND gate 414 upon release of the depressed key on the lower keyboard, thereby conducting a field-effect transistor 416 only during 48 μs. The conduction of the transistor 416 turns the reset signal $\overline{RS}$ to "0" which is applied to the automatic accompaniment device 36 and the automatic rhythm playing device 37 via a line 417 to reset the performance operations of these device 36 and 37. Thus, the automatic bass performance, the automatic chord performance and the automatic rhythm performance are stopped. The reset signal $\overline{RS}$ is also applied to a differentiation circuit consisting of a delay flip-flop 418, a delay flip-flop 419 of an inverted output type and an AND gate 420. When the reset signal $\overline{RS}$ is turned to "1" from "0" thereby cancelling resetting, one shot of pulse of a 12 μs width is produced by the AND gate 420. The output pulse of the AND gate 420 is applied to the reset lines 408 and 402 via the OR gate 406 to reset the chord pyramid tempo counter 434 and the rhythm counter 376 in synchronization.

Chord pyramid performance synchronized with starting of other automatic performance devices As described above, the reset signal $\overline{RS}$ is generated by the chord pyramid device and supplied to the automatic performance devices 36 and 37 to reset them. On the other hand, the reset signal $\overline{RS}$ is generated also by the automatic performance devices 36 and 37 and supplied to the chord pyramid device 12 via a line 417.

The automatic accompaniment device 36 receives a rhythm pulse from the automatic rhythm playing device 37 to produce a timing pulse for the performance of a bass accompaniment or a chord accompaniment and, accordingly, the automatic accompaniment device 36 is not in operation when the automatic rhythm playing device 37 is not in operation. The automatic rhythm playing device 37 or the automatic accompaniment device 36 can produce the reset signal $\overline{RS}$ independently from each other and this reset signal $\overline{RS}$ is supplied to the devices 12, 36 and 37 via the line 417. When the reset signal $\overline{RS}$ is present (i.e. $\overline{RS}$ is "0"), the automatic accompaniment device 36 and the automatic rhythm playing device 37 are not in operation. When the device 36 or 37 starts its operation, that is, the automatic rhythm playing is started (because the automatic accompaniment device 36 necessitates the automatic rhythm playing), these devices turn the reset signal $\overline{RS}$ to "1" to enter a state wherein these devices are ready for operation. Since the chord pyramid device 12 utilizes the building up portion of the reset signal $\overline{RS}$ only, its performance does not stop even when the reset signal $\overline{RS}$ is "0". In the synchronized mode, however, the chord pyramid device 12 is set to its initial stage of the chord pyramid performance even when the chord pyramid performance is in progress in synchronization with building up of the result signal $\overline{RS}$ provided by the device 36 or 37 at the start of the automatic rhythm playing.

At the start of the automatic rhythm playing, the reset signal $\overline{RS}$ provided through the line 417 builds up from "0" to "1". A differentiation circuit (FIG. 11) consisting of a delay flip-flops 418 and 419 and an AND gate 420 thereupon produces a differentiated pulse of a 12 μs width which is applied to an AND gate 421 via the OR gate 406.

The AND gate 421 receives as its other input the synchronized mode selection signal SM and is enabled in the synchronized mode. In the synchronized mode, the differentiated pulse from the AND gate 420 is delivered through an AND gate 421 and a delay flip-flop 422 provided for synchronizing timings of rise and fall of the waveforms and is applied as an automatic rhythm start pulses ORO of a 12 μs width to the circuit 44 (FIG. 8) of the chord pyramid device main body 39 via a line 423. The counters 343 and 376 are once reset as was previously described.

In FIG. 8, one shot of the automatic rhythm start pulse ORO is applied to the chord pyramid start-stop control unit 75. The pulse ORO is applied to a NAND gate 425 via a delay flip-flop 424 for synchronizing timing. The NAND gate 425 is operable when the regular mode selection signal RE is produced and the chord pyramid device 12 therefore is in the regular mode. Accordingly, the output of the NAND gate 425 is "0" only during 12 μs corresponding to the pulse ORO. This output signal "0" of the NAND gate 425 becomes an automatic rhythm starting time clear signal $\overline{OROC}$ through a delay flip-flop 426 and disenables the AND gate group 86 of the frequency dividing circuit 45 during 12 μs, thereby clearing the count of the frequency dividing circuit 45 to 0. The automatic rhythm starting time clear signal $\overline{OROC}$ is also inverted by an inverter 427 to a signal "1" of a 12 μs width and a signal "1" of a 12 μs width is thereby provided on the gate line 70 via the OR gate 110 bringing the AND gate 69 into an operate. If, accordingly, the coincidence detection signal COIN is produced in this 12 μs period, the coincidence signal CON is generated and a chord pyramid tone is thereby produced. Upon the lapse of time T from generation of the automatic rhythm start pulse ORS, the tone production timing pulse TEP is produced by the frequency dividing circuit 45.

In the above described manner, the chord pyramid performance is started in synchronization with startin of the automatic rhythm playing in the synchronized mode even if the chord pyramid performance has been implemented in precedence to the automatic rhythm playing.

OTHER EMBODIMENT

The embodiment of the chord pyramid device described with reference to FIG. 6 through 18 is of a construction having both functions of the regular mode and the random mode and being capable of selecting either one of them. Besides, the embodiment is capable of producting the chord pyramid tone both in the harmonics synthesizing system and filter system. In respect of a timing relation with the other automatic performance devices, the embodiment is capable of selectively providing either the synchronized mode or the free mode. Having so many functions concurrently, the embodiment of the chord pyramid deive 12 shown in FIG. 6 (FIGS. 7 through 11) is of such a large capacity (with a great number of connecting pins) that the chord pyramid device main body circuit 39 and the timing signal generation circuit 40 are composed of integrated circuits in separate chips.

Another preferred embodiment of the invention described hereinbelow has less functions than the above described embodiment and can be constructed with an integrated circuit of one chip.

Figure 19:
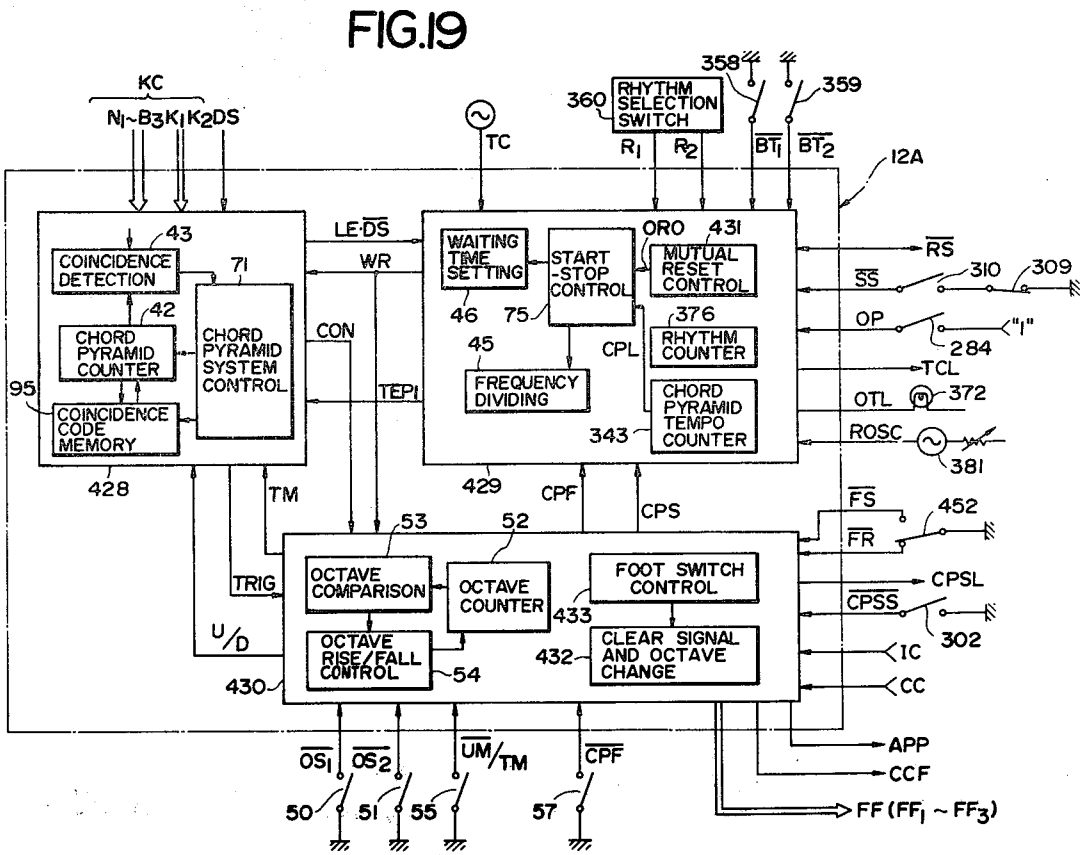
FIG. 19 is a block diagram of another embodiment of the chord pyramid device in FIG. 3 showing interrelations between three circuit portions separately illustrated in FIGS. 20 through 22.
Figure 20:
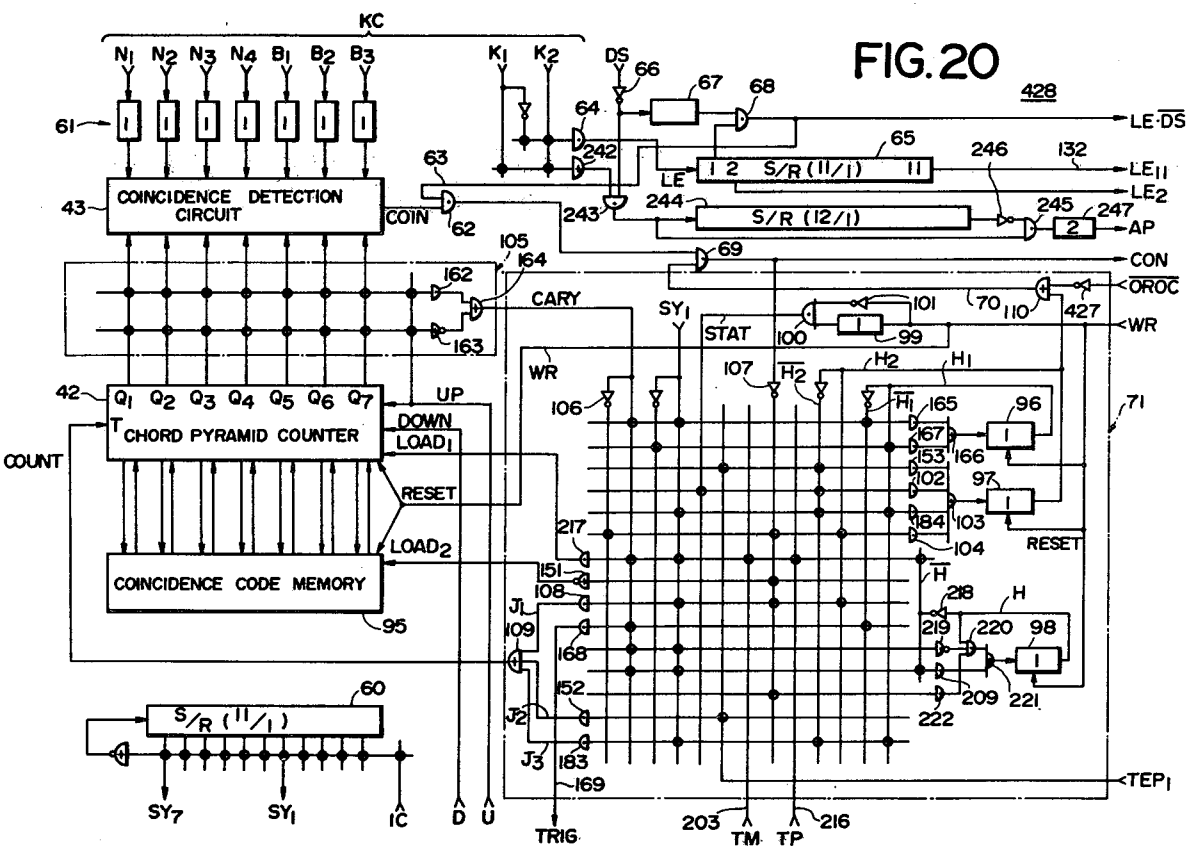
FIG. 20 is a circuit diagram showing a circuit portion 428 in detail.
Figure 21:
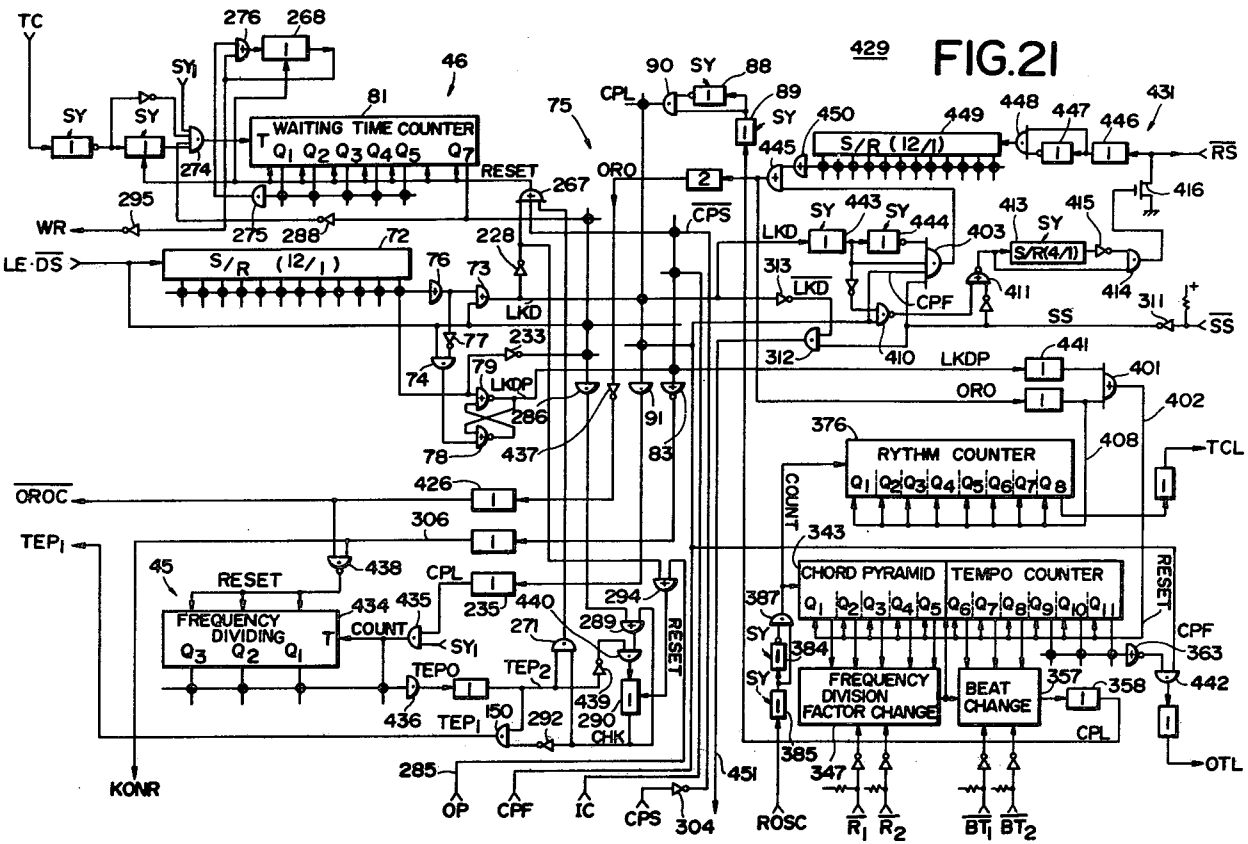
FIG. 21 is a circuit diagram showing a circuit portion 429 in detail.
Figure 22:
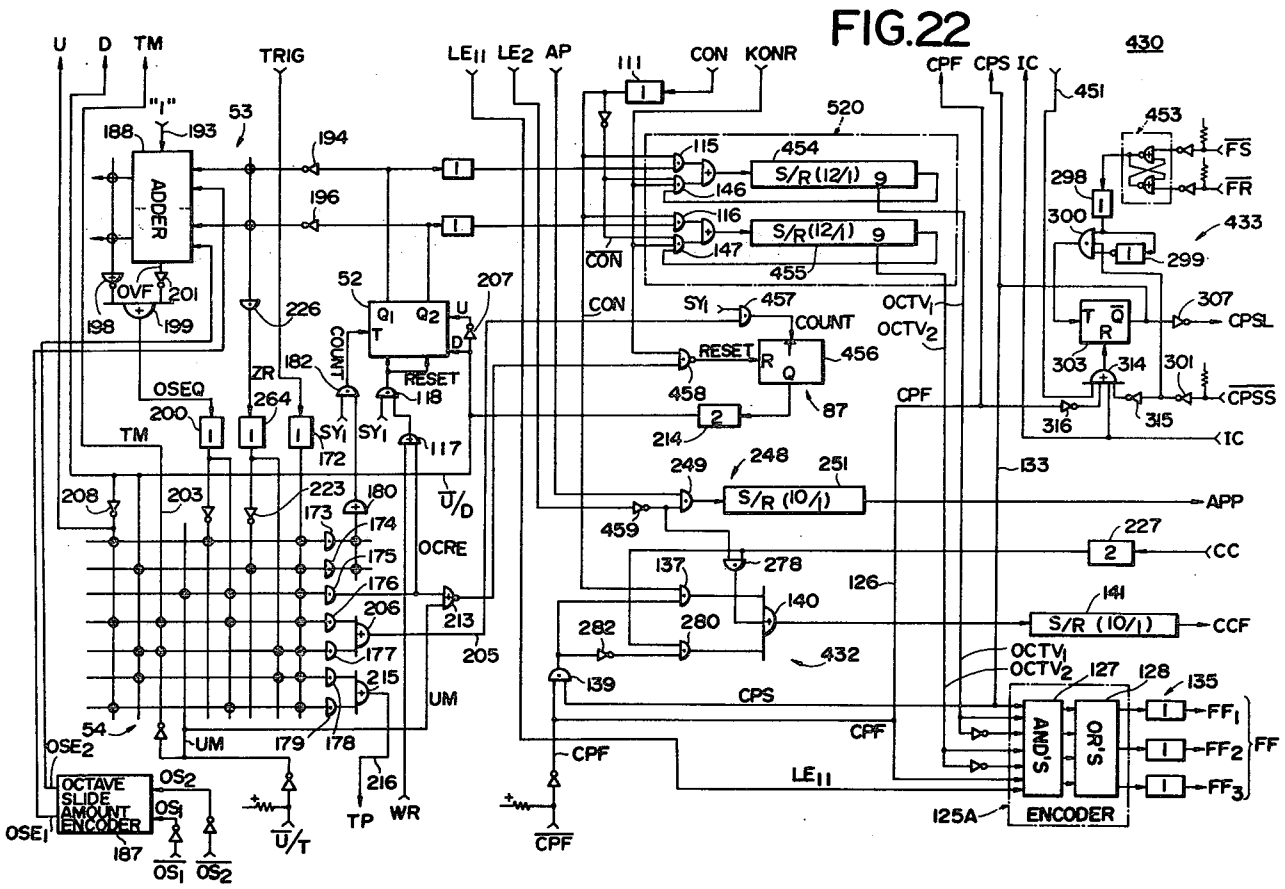
FIG. 22 is a circuit diagram showing a circuit portion 430 in detail.

This other embodiment of the chord pyramid device is shown in FIGS. 20 through 22 in three divided portions. FIG. 19 schematically shows interrelationship between the respective portions. In FIG. 19, all connecting lines are not shown but only main connecting lines are illustrated. The chord pyramid device 12A shown in FIGS. 19 through 22 is capable of conducting the chord pyramid performance in the regular mode only (selection between the up mode and the turn mode is possible) and the chord pyramid tone is produced only in the harmonics synthesizing system musical tone forming system 10. With respect to relations with other automatic performance devices (i.e. the automatic accompaniment device 36 and the automatic rhythm playing device 37), the synchronized mode only is possible.

The device 12A shown in FIGS. 19 through 22 is different from the device 12 shown in FIGS. 6 through 11 in that the circuit for the random mode, the circuit for producing the filter system clear CCV and the octave change designation signal VF, the circuit for selecting one of the regular mode and the random mode and the circuit for selecting one of the synchronized mode and the free mode are omitted in the device 12A. Throughout FIGS. 19 through 22, the same circuits (i.e. provided for the same purpose and performing the same function and operation) as those shown in FIGS. 6 through 11 are designated by the same reference numerals and a detailed description thereof will be omitted. Further, reference numerals newly affixed to circuit components in FIGS. 19 through 22 are number 428 and subsequent numbers.

In FIG. 19 and FIGS. 20 through 22, the chord pyramid device 12A is shown in three divided portions. This division however, bears no important significance but is simply made for convenience of preparing drawings. In FIG. 19 a circuit portion 428 comprises a chord pyramid counter 42, a coincidence detection circuit 43, a coincidence chord memory circuit 95 and a chord pyramid system control unit 71. The circuit 428 is substantially of the same construction as the circuit portion 41 shown in FIG. 7. Details of the circuit 428 are shown in FIG. 20. A circuit portion 429 comprises circuit which are equivalent to a part of the circuit portion 44 shown in FIG. 8, i.e., a waiting time setting circuit 46, a chord pyramid basic tempo clock frequency dividing circuit 45 and a chord pyramid start-stop control unit 75 as well as circuit which are equivalent to a part of the circuit portion 40 shown in FIG. 11, i.e., a chord pyramid tempo counter 343, a rhythm counter 376 and a mutual reset control unit 431. Details of the circuit portion 429 are shown in FIG. 21. A circuit portion 430 comprises circuits which are an equivalent to a part of the circuit portion 49 shown in FIG. 9, i.e., a chord pyramid octave counter 52, an octave comparison circuit and an octave rise-full control unit 54, circuits which are an equivalent to a part of the circuit portion 56 shown in FIG. 10, i.e., a clear signal and octave change designation signal generator 432 and circuits which are equivalent to a part of the circuit portion 44 shown in FIG. 8, i.e., a foot switch control unit 433 etc. Details of the circuit portion 430 are shown in FIG. 22.

The circuit portion 428 is different from the circuit portion 41 shown in FIG. 7 in that the tone production timing pulse $TEP_1$ applied to the chord pyramid system control unit 71 has a pulse width of 1 μs (In FIG. 7, the pulse $TEP_1$ is obtained by processing the pulse TEP of a 12 μs width by the control unit 71.). The other circuits in FIG. 20 are of the same construction as those in FIG. 7.

The tone production timing pulse $TEP_1$ is already of a pulse width of 1 μs when it has been generated by the frequency dividing circuit 45 in FIG. 21. The frequency dividing circuit 45 is used only in the regular mode so that a time sharing operation thereof for each channel is not required. The frequency dividing circuit 45 may therefore be constituted by a 3-bit binary counter 434. The chord pyramid basic tempo clock pulse CPL of a 12 μs width supplied from an AND gate 91 of the chord pyramid start-stop control unit 75 via a delay flip-flop 235 is applied to an AND gate 435 and only a portion of 1 μs of the pulse CPL is selected upon application of the system clock pulse $SY_1$ to the AND gate 435 and applied to a count input of a counter 434. When contents of the three bits of the counter 434 have all become "1" and the output of the AND gate 435 has become a signal "1" of 1 μs width at the timing of a next shot of the clock pulse CPL, an AND gate 436 is enabled to produce a tone production timing pulse $TEP_0$ of a 1 μs width.

In FIG. 21, the waiting time setting circuit 46 operates in the same manner as that shown in FIG. 8. A shift register 72, OR gates 73 and 76, an AND gate 74, NOR gates 78 and 79 and inverters 77 and 233 for producing a lower keyboard key depression indication signal LKD and an initial key depression pulse LKDP in response to a lower keyboard key depression signal $LE \cdot \overline{DS}$ operate in the same manner as those designated by the same reference numerals in FIG. 8.

A circuit related to the random mode is omitted from the chord pyramid start-stop control unit 75. The AND gate 91 is enabled when a chord pyramid selection signal CPF, the lower keyboard key depression signal LKD and the basic tempo clock pulse CPL of a 12 μs width are all "1". A NOR gate 83 produces a signal "0" when either one of the initial clear signal IC, the initial key depression pulse LKDP or a signal $\overline{CPS}$ obtained by inverting a chord pyramid start-stop signal CPS by an inverter 304 (when $\overline{CPS}$="1", the chord pyramid stops) is "1". The output "0" of the NOR gate 83 is delivered to a line 306 and is used as a key depression initial reset signal KONR. An automatic rhythm start pulse ORO of a 12 μs width is inverted by an inverter 437 and becomes an automatic rhythm starting time clear signal $\overline{OROC}$ via a delay flip-flop 426. The reset signal KONR or the clear signal $\overline{OROC}$ is applied to a counter 434 via a NAND gate 438 to reset the counter 434.

A circuit operating in the legato form upon change of a depressed key, an AND gate 286, a delay flip-flop 290 and OR gates 289 and 294 operate in the same manner as the circuits designated by the same reference numerals in FIG. 8. In the same manner as has previously been described, a legato operation depressed key change signal CHK is applied to an AND gate 150 via an inverter 292 to disenable the AND gate 150. Even if a tone production timing pulse $TEP_0$ of a 1 μs is produced by the AND gate 436 at this time, the tone production timing pulse $TEP_1$ to be supplied to the chord pyramid system control unit 71 is not produced, but a pulse $TEP_2$ disenables an AND gate 440 through an inverter 439 thereby releasing a flip-flop 290 from a self-held state.

An AND gate 220 (FIG. 8) provided on the input side of an OR gate 267 supplying a reset signal to the waiting time setting circuit 81 can be omitted because the selection signal RE is not used in the circuit shown in FIG. 21, In this case a signal $\overline{CPS}$ obtained by inverting the chord pyramid start-stop signal CPS is directly applied to the OR gate 267.

In FIG. 21, a chord pyramid tempo counter 343, a frequency division factor change circuit 347, a beat change circuit 357, a rhythm counter 376 etc. operate in the same manner as the circuits designated by the same reference numerals in FIG. 11. In the present embodiment, the free mode is not used but the synchronized mode only is used, so that a synchronizing clock pulse ROSC rectified by a differentiation circuit consisting of circuits 384, 385 and 387 into a pulse of a 12 μs width is supplied solely to counters 343 and 376 as a count pulse. Further, the initial key depression pulse LKDP is applied to a delay flip-flop 441 via the chord pyramid start-stop control unit 75 and is applied to the chord pyramid tempo-counter 343 through an OR gate 401 and a reset line 441 to reset the counter 343. Outputs of more significant bits ($Q_9$, $Q_{10}$, $Q_{11}$) of the counter 343 are combined by a NOR circuit 363 and gated out of an AND gate 442 as a signal OTL which is used to light a tempo indication lamp 372. The AND gate 442 is brought into an operable state by a harmonics synthesizing system chord pyramid selection signal CPF.

If a synchronized start in the synchronized mode is to be selected in a mutual reset control unit 431, both a synchronizing switch 310 and a start switch 309 (FIG. 19) are closed to turn a synchronized start signal $\overline{SS}$ to "0". An AND gate 403 becomes operable when the operation mode is set to the synchronized start (i.e. $\overline{SS}=0$, $SS=1$) during the chord pyramid performance (i.e. $CPF=1$), in the same manner as was described with reference to FIG. 11. A differentiation circuit consisting of delay flip-flops 443 and 444 and an AND gate 403 produces a pulse of a 12 μs width at an initial stage of key depression in response to the lower keyboard key depression indication signal LKD supplied via the chord pyramid start-stop control unit 75. A NAND gate 410 is provided, as in FIG. 11, to detect release of a depressed key on the lower keyboard during the chord pyramid performance. If release of a depressed key on the lower keyboard is detected during time when the operation mode is set to the synchronized start, differentiation circuit consisting of a NOR gate 411, a 4-stage shift register 413, an AND gate 414 and an inverter 415 operates in the same manner as a corresponding circuit in FIG. 11 to apply a pulse of a 48 μs width to a field-effect transistor and thereby produce a reset signal $\overline{RS}$ (="0") of a 48 μs width.

The reset signal $\overline{RS}$ is transmitted between the automatic performance device 36 or 37 and the chord pyramid device 12A in the previously described manner. The reset signal $\overline{RS}$ is differentiated into a pulse of a 1 μs width in the building up portion thereof by a differentiation circuit consisting of delay flip-flops 446 and 447 and an AND gate 448 and thereafter is converted to a pulse of a 12 μs width through a shift register 449 and an OR gate 450. This pulse of a 12 μs width appearing at the rise of the reset signal $\overline{RS}$ is applied through an OR gate 445 to an inverter 437 of the chord pyramid start-stop control unit 75 as an automatic rhythm start pulse ORO. The reset signal $\overline{RS}$ is converted to a pulse of 12 μs after being differentiated to a pulse of a 1 μs first for minimizing a time delay between start of automatic rhythm performance (i.e. building up of the reset signal $\overline{RS}$ from "0" to "1") and occurrence of the pulse ORO of a 12 μs and thereby setting the chord pyramid performance to a start state with a high responsibility to the start of the automatic rhythm performance.

If a depressed key on the lower keyboard is released at the synchronized start time, an output of an AND gate 312 (FIG. 21) becomes "1" thereby resetting a flip-flop 303 in FIG. 22 via a line 351. This arrangement has been made for enabling the chord pyramid performance to be resumed when the depressed key is released after the chord pyramid performance has been stopped by operation of a foot switch.

In a foot switch control unit 433 in FIG. 22, a foot switch set signal $\overline{FS}$ is an output of a make contact of a foot switch 452 (FIG. 19) and a foot switch reset signal $\overline{FR}$ is an output of a break contact of the foot switch 452. The signal $\overline{FS}$ sets a flip-flop 453 and the signal $\overline{FR}$ resets it. Delay flip-flops 298 and 299, and AND gate 300, a flip-flop 303, an OR gate 314 and inverters 301, 307, 315 and 316 of a foot switch control unit 433 operate in the same manner as the circuits designated by the same reference numerals in FIG. 8. The flip-flop 453 is used for absorbing chatterings of the foot switch 452. In the present embodiment, a stop lamp signal CPSL is used not for lighting a lamp but for changing an envelope generated in the harmonics synthesizing system envelope generation circuit 28 to one of a sustained tone, as was previously described.

An octave change pulse TRIG supplied to the circuit in FIG. 22 from the circuit in FIG. 20 is directly applied to an octave rise-fall control unit 54 via a delay flip-flop 172. The octave rise-fall control unit 54 performs the same operation as the circuit designated by the same reference numeral in FIG. 9. The circuit portions shown in FIGS. 9 and 10 excluding the selection gate for switching between the random mode and the regular mode, the circuits used exclusively for the random mode, the filter system clear signal generation circuit and the filter system octave change designation signal generation circuit are equivalent to the circuit portion shown in FIG. 22. Accordingly, in an octave comparison circuit 53 shown in FIG. 22, an output of an octave counter 52 only is inverted by inverters 194 and 196 and applied to an adder 188. Further, an octave memory counting circuit 520 need not perform a counting operation for the random mode but has only to store contents of the octave counter 52. The circuit 520 therefore does not require adders 119 and 120 as shown in FIG. 9 but only comprises 12-stage shift registers 454 and 455. Octave instruction signals $OCTV_1$ and $OCTV_2$ are delivered out of the ninth stage of these shift registers 454 and 455.

An up-down control memory 87 in FIG. 22 need not make storage for each channel required for the random mode so that a counter 456 (flip-flop) of one bit may be employed in the case where the regular mode only is used. A signal "1" of a pulse width of 12 μs applied from an OR gate 206 of the octave rise-fall control unit 54 to an AND gate 457 is selected by a width of 1 μs by the system clock pulses $SY_1$ and this selected portion of a 1 μs width is used as a count pulse in the counter 456. Contents of the counter 456 turn to either 0 or 1 upon receipt of each count pulse (at each turning point in the turn mode) and the counting mode changes in accordance with a signal $\overline{U}/D$. A NAND gate 458 is a circuit for resetting the counter 456 by the initial key depression reset signal KONR or a signal "0" from a NOR gate 213 (always "0" in the up mode).

The clear signal and octave change designation signal generation control circuit 432 in FIG. 22 is different from the circuit portion 56 in FIG. 10 in that the circuit portion in FIG. 10 comprises the filter system clear signal generation control circuit 880, the AND gates 138, 281, OR gates 144, 145 and the shift register 142 etc. for generating the filter system clear signal CCV, the AND gate group 130 and OR gate 131 for encoding the filter system octave change designation signal VF, the circuits 322–333 for producing the filter system clear signal CCF by processing the signal CG representing a timing of chord tones and the circuits 334–342 for generating the associated percussion signal LR, whereas the clear signal and octave change designation signal generation circuit 432 does not comprise these circuits.

An AND gate 249 of an attack pulse processing circuit 248 receives the attack pulse AP from the circuit shown in FIG. 20 and a signal obtained by inverting the lower keyboard key detection signal $LE_2$ by an inverter 459. In the embodiment shown in FIG. 10, the regular mode selection signal RE and the lower keyboard key detection signal $LE_2$ are applied to the NAND gate 250, but this construction is unnecessary because the embodiment shown in FIG. 22 is used exclusively for the regular mode.

A circuit for applying the coincidence signal CON to an AND gate 137 and producing the harmonics synthesizing system clear signal CCF through an OR gate 140 and a shift register 141 and AND gates 139, 280 and 278 operate in the same manner as the circuits designated by the same reference numerals in FIG. 10.

Details of an octave slide amount setting encoder 187 in FIG. 22 is the same as the encoder 187 in FIG. 9, producing the octave slide amount setting signals $OSE_1$ and $OSE_2$ in response to the outputs $\overline{OS}_1$ and $\overline{OS}_2$ of switches 50 and 51 (FIG. 19) as shown in Table 4.

An octave encoder 125A in FIG. 22 consists of an AND gate group 127 and an OR gate group 128 of the same construction as those in FIG. 10 and converts the octave instruction signals $OCTV_1$ and $OCTV_2$ to the harmonics synthesizing system octave change designation signals $FF_1$, $FF_2$ and $FF_3$ as shown in TAble 3.

Figure 23:
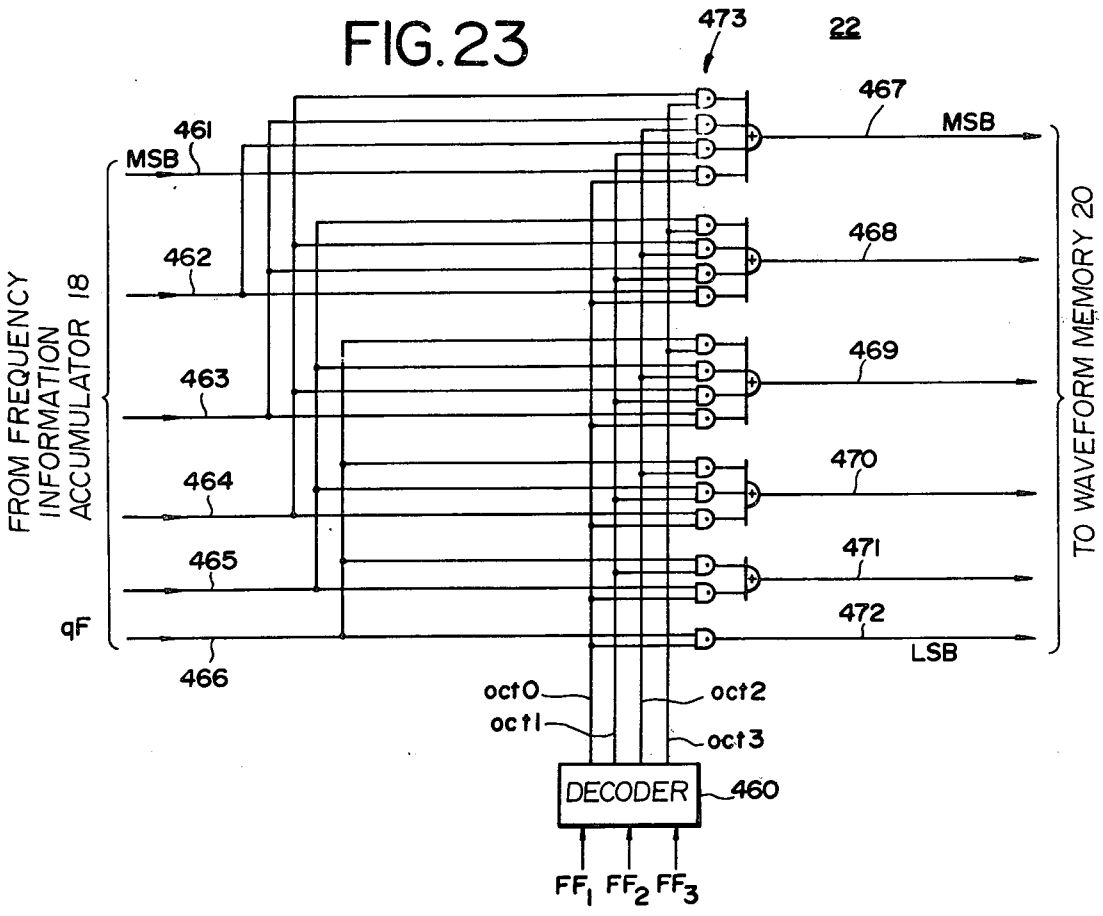
FIG. 23 is a circuit diagram showing an example of a footage change circuit in FIG. 3.

A footage change circuit 22 (or 23) can be constructed as shown in FIG. 23. The octave change designation signals $FF_1$, $FF_2$ and $FF_3$ are applied to a decoder 460 for producing octave slide amount signals oct 0, oct 1, oct 2 and oct 3 in response to the octave slide amounts 0, 1, 2 and 3 The octave slide amount signals oct 0 through oct 3 designate a shift amount of a waveform memory reading address designation signal qF. Lines 461–466 are provided for six more significant bits of the address designation signal qF (an integer portion) outputted from the accumulator 18, a line 461 for the most significant bit MSB and a line 466 for a digit of 1 (in integer) (i.e. having a weight of the fifteenth digit in Table 2). Lines 467–472 are signal lines actually connected to address input lines of the musical tone waveform memory 20. The line 467 carries an address data of the most significant bit MSB and the line 472 that of the least significant bit LSB.

Logical circuits are arranged in such a manner that signals on the respective input lines 461–466 are delivered to the predetermined output lines 467–472 in accordance with the contents of shift of four kinds on the first through third digits. When the octave slide amount designated by the octave change designation signals $FF_1$–$FF_3$ is 0, the AND gate among the AND gate group 473 to which the signal oct 0 is applied becomes operable. Accordingly, the signals on the lines 461–466 are delivered to the output lines 467–472. When the AND gate becomes operable upon receipt of the signal oct 1 designating the octave slide amount 1, the signals on the input lines 462–466 are delivered to the output lines 467–471 which are respectively one digit more significant. At this time, a signal on the input line 461 of the most significant digit is inhibited and a signal on the input line 462 which is one digit less significant is provided on the output line 467 of the most significant digit. When the AND gate becomes operable upon receipt of a signal oct 2 designating the octave slide amount 2, the signals on the input lines 463–466 are delivered to the output lines 467–470 which are two digits more significant. At this time, the signals on the input lines 461 and 462 are inhibited and the signal on the input line 463 which is two digits less significant is delivered to the output line 467 of the most significant digit. When the AND gate becomes operable upon receipt of the signal oct 3 designating the octave slide amount 3, the signals on the input lines 464–466 are delivered to the output lines 467–469. The signals on the input lines 461, 462 and 463 of the more significant three digits are inhibited and the signal on the input line 464 which is three digits less significant is delivered to the output line 467 of the most significant digit. Thus, the signals on the input lines 461–466 are provided on the output lines 467–472, being shifted by one digit, two digits or three digits to a more significant digit side, in response to the octave slide amount designation signals $FF_1$–$FF_3$. By this arrangement, a value of an actual reading address of the waveform memory 20 becomes double (in the case of shift by one digit), four times (in the case of shift by two digits), or eight times (in the case of shift by three digits) a value designated by the output of the frequency counter 18. Accordingly, a rate at which the reading address is advanced becomes double, four times or eight times and the frequency of the waveform read from the waveform memory 20 therefore becomes double, four times and eight times. Consequently, the tone pitch of the musical tone obtained becomes higher than the original tone pitch by one octave, two octaves or three octaves.

Figure 24:
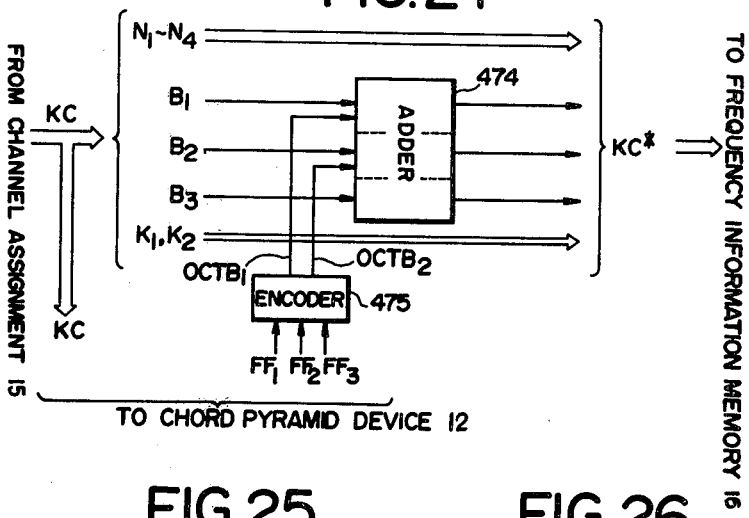
FIG. 24 is a block diagram showing an example of a circuit for changing an octave code in a key code by an octave change designation signal FF (or VF)

A method for automatically changing the octave of a produced tone is not limited to the one using the above described footage change circuits (22 and 23) but contents of the octave code $B_1$, $B_2$, $B_3$ of the key code KC may be changed. FIG. 24 shows one example of the latter method.

In FIG. 24, an adder 474 is inserted between the channel assignment circuit 15 and the frequency information memory 16 and the octave code $B_1$, $B_2$. $B_3$ is applied to the adder 474. The key code KC is distributed to the chord pyramid device 12 before it is applied to the adder 474. The octave change designation signals $FF_1$, $FF_2$ and $FF_3$ provided by the chord pyramid device 12 is applied to an encoder 475 in which these signals are converted to binary octave slide amount signals $OCTB_1$ and $OCTB_2$. The encoder 475 is constructed in such a manner that the signals $OCTB_1$ and $OCTB_2$ become of the same contents as the octave instruction signals $OCTV_1$ and $OCTB_2$ (see Table 3). In the adder 474, the octave slide amount signals $OCTB_1$ and $OCTB_2$ are added to the least significant bit $B_1$ and the next bit $B_2$ of the octave code $B_1$–$B_3$ and a carry signal thereof is added to the most significant bit $B_3$. In this manner, the octave code $B_1$–$B_3$ is converted in response to the octave change designation signals $FF_1$–$FF_3$ whereby a modified key code KC* is obtained. The modified key code KC* is applied to the frequency information memory 16 for reading a corresponding frequency information F therefrom As will be apparent from Table 1, the octave rises by one each time the value of the octave code $B_1$–$B_3$ increases by 1, so that musical tones are obtained whose tone pitch varies on octave basis in accordance with the octave change designation signals $FF_1$–$FF_3$.

By constructing the device as shown in FIG. 24, the present invention is applicable to an electronic musical instrument employing a tone source device adapted to produce a musical tone signal without using a musical tone waveform memory. For instance, the present invention is applicable to an electronic musical instrument of a type wherein the modified key code KC* is decoded to form a key gate signal corresponding to each of the keys, a predetermined analog tone pitch voltage is gated by this key gate signal and a voltage-controlled type oscillator is driven by a gated out tone pitch voltage to produce a tone source signal.

According to the present invention, a tone pitch of a produced tone is changed on octave basis by digitally processing signals (the address data qF or the key code) so that a tone of an extremely high tone pitch which is not provided on the keyboard may be produced. If, for example, keys of $G_6$ and $G_7$ tones are depressed and the octave slide amount is set to 3 octave, extremely high tones are produced in the order of $G_6 \rightarrow C_7 \rightarrow G_7 \rightarrow C_8 \rightarrow G_8 \rightarrow C_9 \rightarrow G_9 \rightarrow C_{10} \ldots\ldots$, even though some of these tones may not be audible.

Figure 25:
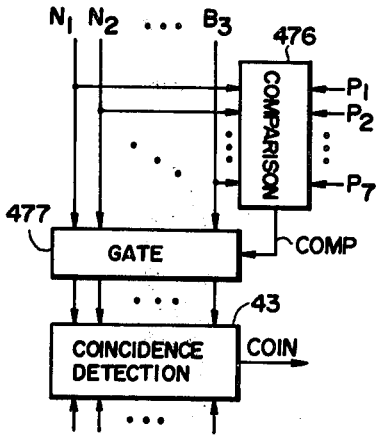
FIG. 25 is a block diagram of a circuit for limiting a range of coincidence detection to a desired key range by limiting a range of key codes applicable to a coincidence detection circuit 43 shown in FIG. 7 or FIG. 20.

In the foregoing embodiment, detection of coincidence of key codes of depressed keys for the chord pyramid performance is possible over the whole keyboard range of the lower keyboard. This is because the chord pyramid counter 42 of modulo 128 sequentially counts and scans data of the key codes over the whole keyboard range. If, for example, keys of $C_3$, $G_4$ and $C_7$ tones are depressed, the chord pyramid performance proceeds like $C_3 \rightarrow G_4 \rightarrow C_7 \rightarrow G_4 \rightarrow G_5 \rightarrow C_8 \rightarrow \ldots\ldots$ However, the range of keys over which the coincidence detection of depressed keys is possible may be limited to one or several octave ranges. One example of such limitation is to limit a range of input of the key code data $N_1$–$B_3$ to be applied to the coincidence detection circuit 43, as shown in FIG. 25. In FIG. 25, the key code data $N_1$–$B_3$ supplied from the tone production assignment circuit 15 is applied to a comparison circuit 476 and a gate 477 before it is applied to the coincidence detection circuit 43. Reference data $P_1$–$P_7$ is previously supplied to the comparison circuit 476 and the input key code data $N_1$–$B_3$ is compared with the reference data $P_1$–$P_7$. The gate 477 is opened in response to a signal COMP representing a result of comparison in the comparison circuit 476 and the input key code data $N_1$–$B_3$ is thereby applied to the coincidence detection circuit 43. If, for instance, the range of input of the key code data $N_1$–$B_3$ is limited to key ranging over two octaves counting from the lowest octave side (i.e., $C_1$–$C_3$), the value of the reference data $P_7, P_6 \ldots P_1$ is set to "0101110", the gate 477 is opened in response to the comparison result signal COMP at a time when the value $N_1 - B_3 \leqq$ the value $P_1 - P_7$ and the key code data $N_1 - B_3$ is thereby applied to the coincidence detection circuit 43.

Figure 26:
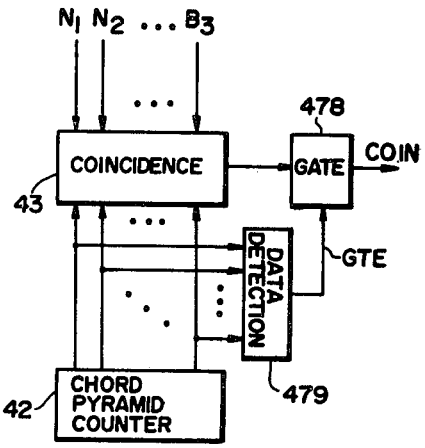
FIG. 26 is a block diagram of a circuit for limiting a range of coincidence detection to a desired key range by limiting generation of a coincidence detection signal from the coincidence detection circuit 43 in accordance with contents of the chord pyramid counter 42 shown in FIG. 7 or FIG. 20.

In another example shown in FIG. 26, a gate 478 is provided on the output side of the coincidence detection circuit 43 and the gate 478 is controlled in accordance with contents of the chord pyramid counter 42 for restricting generation of the coincidence detection signal COIN. A data detection circuit 479 (a kind of comparison circuit) produces a gate open signal GTE for opening the gate 478 only when the count of the chord pyramid counter 42 is equal or below a predetermined value. The predetermined value of the data detection circuit 479 is, for example, the above described reference data $P_1$–$P_7$.

By limiting the range of coincidence detection of depressed keys for the chord pyramid performance in the described manner, the chord pyramid performance can be conducted only when keys within a predetermined key range have been depressed while a normal performance is made in the rest of the key range. For example, the performer can conduct the chord pyramid performance by a left hand in a key range covering low tones while conducting a normal performance by a right hand in a key range covering middle and high tones. This arrangement is particularly useful in an electronic musical instrument of a type having only one manual keyboard.

In the above described embodiment, the chord pyramid performance can be conducted on the lower keyboard.

The invention, however, is not limited to this but any keyboard such as an upper keyboard and a pedal keyboard may be used for conducting the chord pyramid performance. In case a keyboard other than the lower keyboard is used, it will suffice if input connections are partially altered so as to enable the AND gate 64 in FIG. 20 to detect a code $K_1$, $K_2$ of the keyboard selected for the chord pyramid performance.

For agreeing phrases in the chord pyramid performance with those in the automatic rhythm playing in a case where both performances are concurrently made by operating the chord pyramid devices 12 or 12A and the automatic rhythm playing device 37 together in the synchronized mode, the following arrangements can be employed.

One way for achieving such phrase agreement is to construct the device such that the beat change signals $\overline{BT}_1$, $\overline{BT}_2$ of the beat change circuit 357 in the chord pyramid tempo counter 343 are preset to predetermined values in accordance with a rhythm kind played by the automatic rhythm playing device 37 and that the octave slide amount set signals $\overline{OS}_1$, $\overline{OS}_2$ are automatically preset to predetermined values. By automatically adjusting the clock rate of the chord pyramid basic tempo clock CPL in accordance with the rhythm kind and adjusting a timing of repetition of rise (or rise and fall) in the octave slide control by the above described construction, phrases in the chord pyramid performance can be made to agree with those in the rhythm playing.

Figure 27:
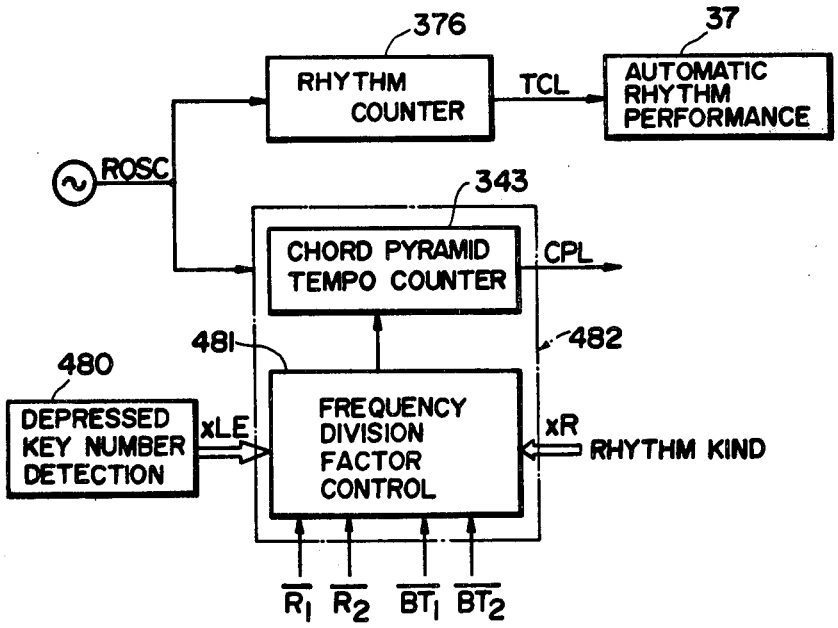
FIG. 27 is a block diagram showing an example of a circuit for matching phrases of the chord pyramid performance and the automatic rhythm performance in association with a chord pyramid tempo counter 343 shown in FIG. 11 or FIG. 21.

Alternatively, the phrase agreement can be achieved by automatically changing the clock rate of the chord pyramid basic tempo clock pulse CPL in accordance with a kind of rhythm to be played and the number of depressed keys on a keyboard allotted for the chord pyramid performance. FIG. 27 shows an example of such alternative arrangement. In this example, a depressed key number detection circuit 480 is provided for detecting a depressed key number xLE on the keyboard for the chord pyramid performance by counting the number of channels containing the lower keyboard key detection signal LE among all of the tone production channels (i.e. 12 channels). The detected depressed key number xLE and a signal xR which represents the kind of rhythm being played are applied to a frequency division factor control circuit 481 to control a frequency division factor of the chord pyramid tempo counter 343. A circuit 482 consisting of the frequency division factor control circuit 481 and the chord pyramid tempo counter 343 may be constructed of a digital type variable frequency dividing circuit. The circuit 482 may also be constructed of a voltage-controlled tye oscillator and its oscillation frequency may be controlled in an analog manner in accordance with the depressed key number xLE and the rhythm kind xR to variably adjust the basic tempo clock pulse CPL. The control of the clock rate of the basic tempo clock pulse CPL in accordance with the depressed key number xLE enables adjustment of the tone production interval T in accordance with the number of the chord pyramid tones, so that phrases in the chord pyramid performance can be made to agree with those in the rhythm playing.

In the present invention, the chord pyramid performance is conducted in response to the key code KC. The key code KC used in the chord pyramid device 12(or 12A), however, is not limited to one of a depressed key on the keyboard. The present invention is applicable, for example, to a case where a key for a root tone of a chord only is depressed and key codes for subordinate tones having suitable note intervals, e.g. three and five degrees respectively above the root tone, are produced by processing a key code for the root tone whereby a musical tone is produced on the bais of such key codes for the root tone and the subordinate tones. In this case, the key codes obtained by processing the key code for the depressed key are assigned to proper channels in the tone production assignment circuit 15 and the assigned key codes KC are applied to the inputs of the chord pyramid device 12 irrespective of the distinction of the key code, i.e. a key code for the depressed key and a key code obtained by processing the key code for the depressed key.

In the foregoing embodiments, the signals designating timing of the tone production are supplied to the envelope generation circuits 27 and 28 in the form of the clear signals CCF and CCV. The form of the signal designating timing of the tone production, however, is not limited to this. The form of such signal depends on structure of the envelope generation circuit. No matter what type of the envelope generation circuit may be used, production of a tone is started at timing of generation of the coincidence signal CON. The structure of the envelope generation circuit 28 in the block in FIG. 3 is shown only by way of example and the envelope generation circuit may take other suitable forms.

An envelope characteristic which decays with time may be imparted to a plurality of tones produced sequentially in accordance with the progress of the chord pyramid performance as a whole. To this end, an analog type envelope imparting circuit consisting of e.g. an attenuator or a voltage-controlled type amplifier, may be provided on the output side of each of the musical tone forming systems 10 and 11, thereby imparting a single envelope of tones of the respective channels being outputted from a single line. In this case, the decaying time is set to be sufficiently longer than time required for production of each tone.

What we claim is:

1. In a polyphonic keyboard electronic musical instrument, the improvement for producing a random mode arpeggio effect, comprising, first means for establishing separate sets of repetitive tone production timing pulses, each set beginning upon depression of a corresponding one of a group of depressed keys designating the tones in an arpeggio chord, and second means for separately, repetitively enabling the production of each selected arpeggio tone in response to each occurrence of a tone production timing pulse in the set corresponding to the depressed key for that tone.

2. The random mode arpeggio effect improvement of claim 1 wherein said first meas includes circuitry for producing tone production timing pulses which occur at uniform time intervals ($T_0$) in each set, the uniform time intervals being the same for all sets, whereby each individual arpeggio tone is repeated at regular intervals, but wherein the time separation ($T_1$, $T_2$, . . .) between different tones in said arpeggio chord is established by the time relationship between depression of the keys in said group.

3. The random mode arpeggio effect improvement of claim 1 wherein said musical instrument includes a time-shared tone generator, and channel assignment means for assigning each depressed key to a respective time-shared channel, and wherein said first means includes:

a separate temp clock dividing circuit associated with each time-shared channel, all of said circuits receiving the same tempo clock pulses from a common clock source, each of said circuits dividing said tempo clock pulses by the same fixed value to establish the set of tone production timing pulses for the associated channel, the division by each of said circuits starting at the time of depression of the key assigned to the associated channel.

4. The random mode arpeggio effect improvement of claim 1 wherein said musical instrument includes a time-shared tone generator, and channel assignment means for assigning each depressed key to a respective time-shared channel, said tone generator having a footage changer for modifying the footage of each produced tone in accordance with a footage change control signal, and wherein said second means includes:

arpeggio mode selection controls for selecting the order and extent of octave modification during arpeggio production and for providing selection signals indicative thereof, and a separate octave counter means for each time-shared channel, each being responsive to said selection signals and to occurrence of the tone production timing pulses for the depressed key assigned to the corresponding channel, for supplying separate footage change control signals to said footage changer for each produced arpeggio tone.

5. In a keyboard electronic musical instrument the improvement comprising:

arpeggio circuitry for producing arpeggio effects by scanning signals indicative of depressed keys which specify the notes in an arpeggio chord, first key depressed detection means for producing a signal upon detection of the first key to be depressed, waiting time means, cooperating with said detection means, for producing a wait signal which is true during a fixed waiting time period beginning at the occurrence of a first key detected signal, and which goes false at the end of said waiting time period, and reset/enable means, cooperating with said arpeggio circuitry and with said waiting time means, for enabling the scanning of said depressed key indicative signals only when said wait signal goes false, whereby the initial scanning by said arpeggio circuitry at the end of said waiting time period will encompass all of the keys that were depressed during said waiting time period.

6. The improvement of claim 5 in which progress of the arpeggio effect is stopped and restarted in legato form when at least one new key is depressed so as to change at least one note in the arpeggio chord, comprising:

new key depressed detection means, operative during production of arpeggio, for providing a signal upon detection of a newly depressed key, said waiting time means being connected to said new key depressed detection means so that occurrence of said new key detection signal causes said wait signal again to go true for a like waiting time period, said true wait signal causing said reset/enable means to reset said arpeggio circuitry, said wait signal subsequently going false at the end of said like waiting time period, thereby again enabling said arpeggio circuitry so that said at least one newly depressed key will be included in the subsequent arpeggio production.

7. The improvement of claim 6 wherein said electronic musical instrument includes a common time-shared tone generator, and assignment circuitry for assigning each depressed key to a respective time-shared channel, and wherein said first key depressed detection means and said new key depressed detection means both utilize a common storage device synchronized with said assignment circuitry, said storage device having a storage location corresponding to each time-shared channel and adapted to hold a signal indicating that the corresponding channel has assigned to it a depressed key included in the arpeggio chord, and further comprising means, cooperating with said arpeggio circuitry, for including in the arpeggio scanning only signals associated with depressed keys that are indicated by the contents of said storage device.

8. In an electronic musical instrument, the improvement for synchronized production of arpeggio and other automatic accompaniment effects, comprising:

clock source means for providing a basic tempo clock pulse train at a selected rate, arpeggio timing pulse control means for deriving from said basic tempo clock pulse train successive arpeggio timing pulses synchronized thereto, arpeggio tone production means, cooperating with said pulse control means, for successively producing tones in an arpeggio chord, production of each successive arpeggio tone being initiated upon occurrence of an arpeggio timing pulse, and automatic accompaniment device means utilizing said basic tempo clock pulses for synchronization of a produced accompaniment effect.

9. An electronic musical instrument according to claim 8 and having two separate tone generators of two different types, said arpeggio tone production means being connected to utilize one of said tone generators for production of said arpeggio chord tones, said automatic accompaniment device being connected to the other of said tone generators for the production of said automatic accompaniment effect.

10. A keyboard electronic musical instrument comprising:

storage means for storing binary key codes identifying the note name and octave of each depressed key;

detection means for detecting the one or more stored key codes associated respectively with a depressed key or keys sequentially and individually at a predetermined time interval with respect to each of the stored key codes, said detection means including, scanning circuitry, operative at the beginning of each predetermined time interval, and including a binary counter for rapidly counting through a range of binary values encompassing said key codes in a very short time period compared with said predetermined time interval, a binary comparator connected to compare the contents of said binary counter and said stored binary key codes and to provide a signal indicative of coincidence therebetween; and tone production means for producing a tone corresponding to the key code detected by said detection means upon occurrence of said coincidence signal.

11. An electronic musical instrument according to claim 10 wherein the sequential detection of the stored key codes associated with a depressed key or keys by said detection means is cyclically repeated; and octave change means for producing an octave range control signal independent of the octave identifying portion of said stored key codes, upon completion of each cycle of the sequential detection of the stored key codes, said tone production means including a footage changer for changing the octave range of the produced tone in response to said octave range control signal.

12. An electronic musical instrument as defined in claim 11 wherein said detection means conducts detection sequentially either in ascending order from the key code for the depressed key having the lowest note or in descending order from the key code for the depressed key having the highest note, and wherein said octave change means produces an octave range control signal which causes the tones produced by said tone production means to change sequentially over predetermined octave ranges toward either of a higher octave range and a lower octave range upon completion of each cycle of the sequential detection of the stored key codes by said detection means.

13. An electronic musical instrument as defined in claim 11 wherein:

said detection means alternately repeats the sequential and cyclical detection of stored key codes first beginning from the key code for the lowest tone associated with a depressed key and subsequently beginning from the key code for the highest tone associated with a depressed key, and wherein:

said octave change means causes a change in the octave range of produced tones by an amount corresponding to the number of cycles of the sequential and cyclical detection of stored key codes, said change being toward a higher octave range while said detection means is conducting the sequential and cyclical detection of key codes from the key code for the lowest tone, and toward a lower octave range while said detection means is conducting the sequential and cyclical detection of key codes from the key code for the highest tone.

14. An electronic musical instrument as defined in claim 11 wherein said detection means comprises:

performance selection means for selecting a desired mode of performance from among modes including repetition of rise, repetition of fall, and alternate rise and fall of the pitch of notes for which tones are produced, and control means for controlling selection of a detection mode in accordance with the mode of performance selected by the performance selection means, said detection modes including a rise mode in which the sequential and cyclical detection of key codes proceeds upwardly from the lowest tone, and a fall mode in which the sequential and cyclical detection of key information proceeds downwardly from the highest tone, said octave change means changing the octave range of produced tones by an amount corresponding to the number of cycles of the sequential and cyclical detection of key codes toward a predetermined higher octave range while said detection means is operating in the rise mode, and toward a predetermined lower octave range while said detection means is, operating in the fall mode, said detection modes also including a turn mode in which said sequential and cyclical detection of key codes proceeds alternately upwards and downwards, said detection modes corresponding to said performance modes of repetition of rise, repetition of fall, and alternate rise and fall of the produced tones.

15. An electronic musical instrument as defined in claim 11 wherein said detection means detects stored key codes only for depressed keys within a predetermined key range on a predetermined keyboard among one or more keyboards on said instrument.

16. An electronic musical instrument as defined in claim 13 which further comprises rise-fall control means for controlling said detection means so that the highest tone and the lowest tone are produced only once at respective turning points between rise and fall in the tone pitch of the produced tones.

17. An electronic musical instrument as defined in claim 16 wherein said rise-fall control means controls said detection means in such a manner that, when a single key code is stored by said storage means and when the tone range wherein the tone pitch of the produced tones rises is the same octave as the tone range wherein the tone pitch of the produced tones falls, a tone corresponding to said single stored key code is produced during one but not the other of the tone rising range or the tone falling range.

18. An electronic musical instrument as defined in claim 11 which further comprises:

legato detection means for detecting a legato operation wherein at least one new key is depressed while one or more of previously depressed keys are still being depressed; and reset means for resetting progress of the detection operation by said detection means and progress of the octave range change operation by said octave change means and said foot changer upon detection of the legato operation and for thereafter causing said detection operation and said octave range change operation to proceed from an initial state thereof.

19. An electronic musical instrument as defined by claim 18 which further comprises means for inhibiting the resetting operation of said reset means in response to detection of the legato operation by said legato detection means, the progress of the detection operation by said detection means and the octave range change operation by said octave change means and said foot changer being thereby continued even during the legato operation.

20. An electronic keyboard musical instrument in which one or more keys are depressed to select tones, comprising:

a first performance device which sequentially selects key information corresponding to said one or more depressed keys at a predetermined time interval, which repeats the sequential selection of the key information and which generates a tone production instruction upon selection of each key information and an octave instruction corresponding to the number of repetitions of the sequential selection of key information;

a second performance device which generates, for each depressed key, an octave instruction which sequentially changes at each predetermined interval of time from start of depression of the key and generates a tone production instruction at said predetermined interval of time; and a tone production device which selects the tone production instruction and the octave instruction from either said first performance device or said second performance device and selectively produces tones in accordance with the selected tone production instruction and octave instruction.

21. In a polyphonic time shared electronic musical instrument wherein each key is represented by a digital key code, all such key codes being within a fixed range of digital values, and wherein a common tone generator is time-shared to produce musical tones corresponding to the key codes of selected keys, said instrument having channel assignment circuitry for storing the key codes of said selected keys and assigning these to respective time-shared channels, and for providing these stored key codes to said tone generator sequentially and repetitively to accomplish time shared tone production, the amplitude of the tone produced for each time-shared channel being controlled by an envelope signal provided by envelope generating circuitry, the improvement for producing an arpeggio comprising:

timing means for establishing the duration of production of each tone in the arpeggio, "chord pyramid" counter means, cooperating with said timing means and operative at the beginning of each arpeggio tone production duration established by said timing means, for rapidly counting through a count range within said fixed range of digital key code values, coincidence means, cooperating with said counter means, for stopping said counting when the contents of said counter means corresponds to a key code stored by said channel assignment circuitry and for providing an envelope control signal to said envelope generating circuitry to cause production of an amplitude envelope signal for the corresponding tone produced by said tone generator, whereby repeated counting and coincidence operation at the beginning of each arpeggio tone production duration results in an arpeggio performance.

22. The improvement of claim 21 further comprising "chord pyramid" control means, cooperating with said coincidence means and said timing means, for causing said "chord pyramid" counter means to retain its contents when stopped by said coincidence means and to restart counting in the same direction at the beginning of the next arpeggio tone production duration, whereby the next successive tone in the arpeggio will be produced upon the next successive stopping of said counter means.

23. The improvement of claim 21 configured for "turn mode" chord pyramid arpeggio production, further comprising:

a coincidence code memory, a "chord pyramid" control unit, cooperating with said coincidence means, for causing the contents of said counter means at the time of said stopping to be stored in said coincidence code memory, said coincidence code memory thereby holding the code of the last produced note in said arpeggio during the continued counting of said counter means at the beginning of the next tone production duration, and means for reversing the direction of counting of said "chord pyramid" counter means when said counter means has counted to a value at either end of said fixed range of digital values, and for loading the contents of said coincidence code memory into said "chord pyramid" counter means at the time of said reversal so that counting will continue from a contents value corresponding to the key code of the last produced tone, whereby said last tone will not be repeated upon reversal of direction of counting at the "turn" of said arpeggio.

24. The improvement of claim 21 wherein said tone generator includes a footage changer which changes the footage of each produced tone in accordance with an octave change designation signal, said improvement further comprising:

octave range selection switches for selecting the number of octaves ranges to be included in said arpeggio production, octave counter means, cooperating with said "chord pyramid" counter means, for selectively incrementing or decrementing said octave counter each time that said "chord pyramid" counter means counts to the upper or lower limit of said fixed range of digital values, the extent of said incrementing and decrementing being controlled by said octave range selection switches, and footage control means for providing an octave change designation signal in response to the contents of said octave counter, said designation signal being supplied to said footage changer to control the footage of the produced tone.

25. The improvement of claim 24 further comprising:

arpeggio mode selection means for controlling the direction of counting of said "chord pyramid" counter means in response to the contents of said octave counter and in accordance with a selected arpeggio mode.

26. The improvement of claim 21 wherein said key codes are binary, and wherein consecutive notes in a scale are represented by key codes having consecutive binary values in a binary sequence, said values ranging between binary zero and a binary number having all binary one bits, and further comprising a carry detection circuit, cooperating with said "chord pyramid" counter means, for producing a "carry" signal whenever the contents of said counter means reaches either extreme value of all binary zeros or all binary ones, and arpeggio mode control means for utilizing said "carry" signal to modify the direction of continued counting by said counter means in accordance with a selected arpeggio mode.

27. The improvement of claim 21 further comprising waiting time circuitry, actuated upon selection of the first key in an arpeggio chord, for establishing a time duration during which the depression of any additional keys will add the corresponding notes to the produced arpeggio.

28. The improvement of claim 21 wherein said instrument includes plural keyboards, and further including arpeggio keyboard discrimination means for including in the arpeggio production only tones corresponding to keys within a certain one of said keyboards.

29. The improvement of claim 28 wherein said keyboard discrimination means includes a register, synchronized with said channel assignment circuitry, for storing an enable signal for each channel indicative of whether the key code assigned to that channel designates a key within said certain one keyboard, and cooperating with said coincidence means to enable stopping of said counting only for those channels for which an enable signal is stored.

30. In a time-shared keyboard polyphonic electronic musical instrument having two separate time-shared tone generator systems, a first tone generator in which a common envelope generator is time-shared by a plurality of time-shared channels and including a storage device for storing the present envelope amplitude for each such individual time-shared channel, and a second tone generator in which separate envelope generator circuits are assigned to each time-shared channel, the improvement for arpeggio production comprising:

timing means for establishing a repetitive arpeggio tone production interval, scanning means, cooperating with said timing means, for ascertaining, at the beginning of each tone production interval established by said timing means, the channel to which the corresponding arpeggio tone is assigned, first envelope control means, cooperating with said common envelope generator, for producing concurrently with said ascertaining, an envelope enable signal for the corresponding channel, said enable signal causing said time-shared common envelope generator in said first tone generator to initiate an envelope waveform for the tone generated in the corresponding time-shared channel, and second envelope control means, cooperating with said separate envelope generator circuits, for producing a set of control signals for the respective envelope generator circuits associated with all of the channels to which notes in the arpeggio chord are assigned, said second envelope control means being operative at the beginning of each tone production interval to send an envelope enable signal to the one envelope generator circuit for the arpeggio tone next to be produced and to send envelope inhibit signals to all other envelope generator circuits.

* * * * *